US010253598B2

(12) United States Patent
Crews et al.

(10) Patent No.: US 10,253,598 B2
(45) Date of Patent: Apr. 9, 2019

(54) DIAGNOSTIC LATERAL WELLBORES AND METHODS OF USE

(71) Applicant: BAKER HUGHES INCORPORATED, Houston, TX (US)

(72) Inventors: James B. Crews, Willis, TX (US); Robert Samuel Hurt, Tomball, TX (US); Hyunil Jo, Houston, TX (US); Tianping Huang, Spring, TX (US); Naima Bestaoui-Spurr, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 216 days.

(21) Appl. No.: 15/147,449

(22) Filed: May 5, 2016

(65) Prior Publication Data

US 2016/0326859 A1 Nov. 10, 2016

Related U.S. Application Data

(60) Provisional application No. 62/158,161, filed on May 7, 2015.

(51) Int. Cl.
*E21B 41/00* (2006.01)
*E21B 43/17* (2006.01)

(52) U.S. Cl.
CPC ..... *E21B 41/0035* (2013.01); *E21B 43/17* (2013.01)

(58) Field of Classification Search
CPC ..... E21B 41/0035; E21B 43/17
See application file for complete search history.

(56) References Cited

U.S. PATENT DOCUMENTS 5,144,590 A * 9/1992 Chon ..... G01V 1/42 367/38
5,524,709 A * 6/1996 Withers ..... B09B 1/006 166/250.1

(Continued)

FOREIGN PATENT DOCUMENTS

WO 2012173924 A2 12/2012

OTHER PUBLICATIONS

Depavia, Luis, et al., "Next-Generation Crosswell EM Imaging Tool," SPE 116344, Sep. 2008.

(Continued)

*Primary Examiner* — Michael R Wills, III
(74) *Attorney, Agent, or Firm* — Mossman, Kumar & Tyler, P.C.

(57) ABSTRACT

Improving the knowledge about how hydraulic fracture networks are generated in subsurface shale volumes in unconventional wellbores may be accomplished with various configurations of at least one diagnostic lateral wellbore using at least one diagnostic device disposed in the diagnostic lateral wellbore. By extending diagnostic lateral wellbores from adjacent lateral wellbores and/or separately drilling diagnostic lateral wellbores, and analyzing signals received by diagnostic devices placed in the diagnostic lateral wellbores, knowledge about fracture networks, the parameters that control fracture geometry and reservoir production and how reservoirs react to refracturing techniques may be greatly improved. Additionally, such diagnostic lateral wellbores can provide quicker location of sweet-spot horizons in reservoirs.

20 Claims, 34 Drawing Sheets

(56) References Cited

U.S. PATENT DOCUMENTS

| | | | | |
|---|---|---|---|---|
| 5,868,210 | A * | 2/1999 | Johnson | B04B 1/08 166/313 |
| 5,926,437 | A * | 7/1999 | Ortiz | G01V 1/46 175/40 |
| 5,963,508 | A | 10/1999 | Withers | |
| 6,119,776 | A * | 9/2000 | Graham | E21B 43/17 166/245 |
| 6,330,914 | B1 | 12/2001 | Hocking et al. | |
| 7,134,492 | B2 | 11/2006 | Willberg et al. | |
| 7,819,181 | B2 | 10/2010 | Entov et al. | |
| 8,253,417 | B2 | 8/2012 | Pislak et al. | |
| 8,347,958 | B2 | 1/2013 | Hartog et al. | |
| 8,789,587 | B2 | 7/2014 | Tubel et al. | |
| 2006/0023567 | A1 | 2/2006 | Uhl et al. | |
| 2007/0215345 | A1 | 9/2007 | Lafferty et al. | |
| 2009/0188665 | A1 | 7/2009 | Tubel et al. | |
| 2009/0277630 | A1 | 11/2009 | McDaniel et al. | |
| 2012/0048538 | A1 | 3/2012 | Brannon | |
| 2012/0116681 | A1 | 5/2012 | Fuller et al. | |
| 2013/0087325 | A1 | 4/2013 | Bartko et al. | |

OTHER PUBLICATIONS

Morea, Michael et al., "Cross-Well EM Images Fluid Dynamics," American Oil & Gas Reporter, Feb. 2010.

Cipolla, C., et al., "A Practical Guide to Interpreting Microseismic Measurements," SPE 144067, Jun. 2011.

Dutta, Sushant M., et al., "Novel Borehole System for Reservoir Monitoring Using Transient Electromagnetics," SPE 142510, Sep. 2011.

Bolshakov, Alexei et al., "Deep Fracture Imaging Around the Wellbore Using Dipole Acoustic Logging," SPE 146769, Nov. 2011.

Sengupta, Soumyadipta, "An Innovative Approach to Image Fracture Dimensions by Injecting Ferrofluids," SPE 162365, Nov. 2012.

Molenaar, Mathieu M. et al., "Field Cases of Hydraulic Fracture Stimulation Diagnostics Using Fiber Optic Distributed Acoustic Sensing (DAS) Measurements and Analyses," SPE 164030, Jan. 2013.

Downie, Robert et al., "Utilization of Microseismic Event Source Parameters for the Calibration of Complex Hydraulic Fracture Models," SPE 163873, Feb. 2013.

Al-Shenri, Abdullah A., et al., "Illuminating the Reservoir: Magnetic NanoMappers," SPE 164461, Mar. 2013.

Patterson, Doug et al., "Unconventional Reservoir Fracture Evaluation Utilizing Deep Shear-Wave Imaging," IPTC 16958, Mar. 2013.

Nalonnil, A., et al., "New Advances in Interwell Seismic and Electromagnetic Imaging," IPTC 16899, Mar. 2013.

Rahmani, Amir Reza et al., "Crosswell Magnetic Sensing of Superparamagnetic Nanoparticles for Subsurface Applications," SPE 166140, Sep. 2013.

Basu, Saptaswa et al., "A New Method for Fracture Diagnostics Using Low Frequency Electromagnetic Induction," SPE 168606, Feb. 2014.

Deeplook-EM, "Crosswell Imaging Accurately Images Fluid Flow on a Reservoir Scale for ADCO," downloaded Aug. 2016, www.slb.com-deeplook_e (date unknown).

X. Weng et al., "Modeling of Hydraulic Fracture Network Propagation in a Naturally Fractured Formation," SPE 140253, 18 pp (Jan. 20-26, 2011).

H. Gu et al., "Hydraulic Fracture Crossing Natural Fracture at Non-orthogonal Angles, A. Criterion, Its Validation and Applications," SPE 139984, 11 pp. (Jan. 20-26, 2011).

Fraser McNeil, et al., "New Hydraulic Fracturing Process Enables Far-Field Diversion in Unconventional Reservoirs," SPE 152704, 11 pp. (Mar. 20-22, 2012).

Dave Allison, et al., "Hydrocarbon Recovery Boosted by Enhanced Fracturing Technique," SPE 167182, 13 pp. (Nov. 5-7, 2013).

* cited by examiner

DIAGNOSTIC LATERAL WELLBORES AND METHODS OF USE

CROSS-REFERENCE TO RELATED APPLICATION

This application claims the benefit of U.S. Provisional Patent Application Ser. No. 62/158,161 filed May 7, 2015, incorporated herein by reference in its entirety.

TECHNICAL FIELD

The present invention relates to methods of obtaining information about subterranean formations and features therein using multiple wellbores, and more particularly relates, in one non-limiting embodiment, to methods of obtaining information about unconventional shale subterranean formations and features thereof using multiple wellbores comprising at least one primary lateral wellbore and at least one diagnostic lateral wellbore adjacent thereto.

TECHNICAL BACKGROUND

It is well known that hydrocarbons (e.g. crude oil and natural gas) are recovered from subterranean formations by drilling a wellbore into the subterranean reservoirs where the hydrocarbons reside, and using the natural pressure of the hydrocarbon or other lift mechanism such as pumping, gas lift, electric submersible pumps (ESP) or another mechanism or principle to produce the hydrocarbons from the reservoir. Conventionally most hydrocarbon production is accomplished using a single wellbore. However, techniques have been developed using multiple wellbores, such as the secondary recovery technique of water flooding, where water is injected into the reservoir to displace oil. The water from injection wells physically sweeps the displaced oil to adjacent production wells. Potential problems associated with water flooding techniques include inefficient recovery due to variable permeability or similar conditions affecting fluid transport within the reservoir. Early breakthrough is a phenomenon that may cause production and surface processing problems.

Hydraulic fracturing is the fracturing of subterranean rock by a pressurized liquid, which is typically water mixed with a proppant (often sand) and chemicals. The fracturing fluid is injected at high pressure into a wellbore to create, in shale for example, a network of fractures in the deep rock formations to allow hydrocarbons to migrate to the well. When the hydraulic pressure is removed from the well, the proppants, e.g. sand, aluminum oxide, etc., hold open the fractures once fracture closure occurs. In one non-limiting embodiment chemicals are added to increase the fluid flow and reduce friction to give "slickwater" which may be used as a lower-friction-pressure placement fluid. Alternatively in different non-restricting versions, the viscosity of the fracturing fluid is increased by the addition of polymers, such as crosslinked or uncrosslinked polysaccharides (e.g. guar gum) or by the addition of viscoelastic surfactants (VES).

Recently the combination of directional drilling and hydraulic fracturing has made it economically possible to produce oil and gas from new and previously unexploited ultra-low permeability hydrocarbon bearing lithologies (such as shale) by placing the wellbore laterally so that more of the wellbore, and the series of hydraulic fracturing networks extending therefrom, is present in the production zone permitting more production of hydrocarbons as compared with a vertically oriented well that occupies a relatively small amount of the production zone. "Laterally" is defined herein as a deviated wellbore away from a more conventional vertical wellbore by directional drilling so that the wellbore can follow the oil-bearing strata that are oriented in a non-vertical plane or configuration. In one non-limiting embodiment, a lateral wellbore is any non-vertical wellbore. In another non-limiting embodiment, a lateral wellbore is defined as any wellbore that is at an inclination angle from vertical ranging from about 45° to about 135°. It will be understood that all wellbores begin with a vertically directed hole into the earth, which is then deviated from vertical by directional drilling such as by using whipstocks, downhole motors and the like. A wellbore that begins vertically and then is diverted into a generally horizontal direction may be said to have a "heel" at the curve or turn where the wellbore changes direction and a "toe" where the wellbore terminates at the end of the lateral or deviated wellbore portion. The "sweet-spot" of the hydrocarbon bearing reservoir is an informal term for a desirable target location or area within an unconventional reservoir or play that represents the best production or potential production. The combination of directional drilling and hydraulic fracturing has led to the so-called "fracking boom" of rapidly expanding oil and gas extraction in the US beginning in about 2003.

Improvements are always needed in the driller's ability to find and map sweet-spots to enable wellbores to be placed in the most productive areas of the reservoirs. Sweet-spots in shale reservoirs may be defined by the source rock richness or thickness, by natural fractures present therein or by other factors. Conventionally, geological data, e.g. core analysis, well log data, seismic data and combinations of these are used to identify sweet-spots in unconventional plays.

Improvements are also needed in the amount of and quality of knowledge about fracture networks, the parameters that control fracture geometry and reservoir production, how reservoirs react to refracturing techniques, and the like.

SUMMARY

There is provided in one non-limiting embodiment a method for diagnosing a subsurface volume containing at least one primary lateral wellbore that is adjacent to at least one diagnostic lateral wellbore, where the method includes disposing at least one diagnostic device in the at least one diagnostic lateral wellbore; emitting at least one signal between the subsurface volume and the at least one diagnostic device; detecting at least one received signal associated with the at least one emitted signal; and analyzing the at least one received signal to ascertain at least one parameter of the at least one primary lateral wellbore and/or the subsurface volume.

Figure 1:
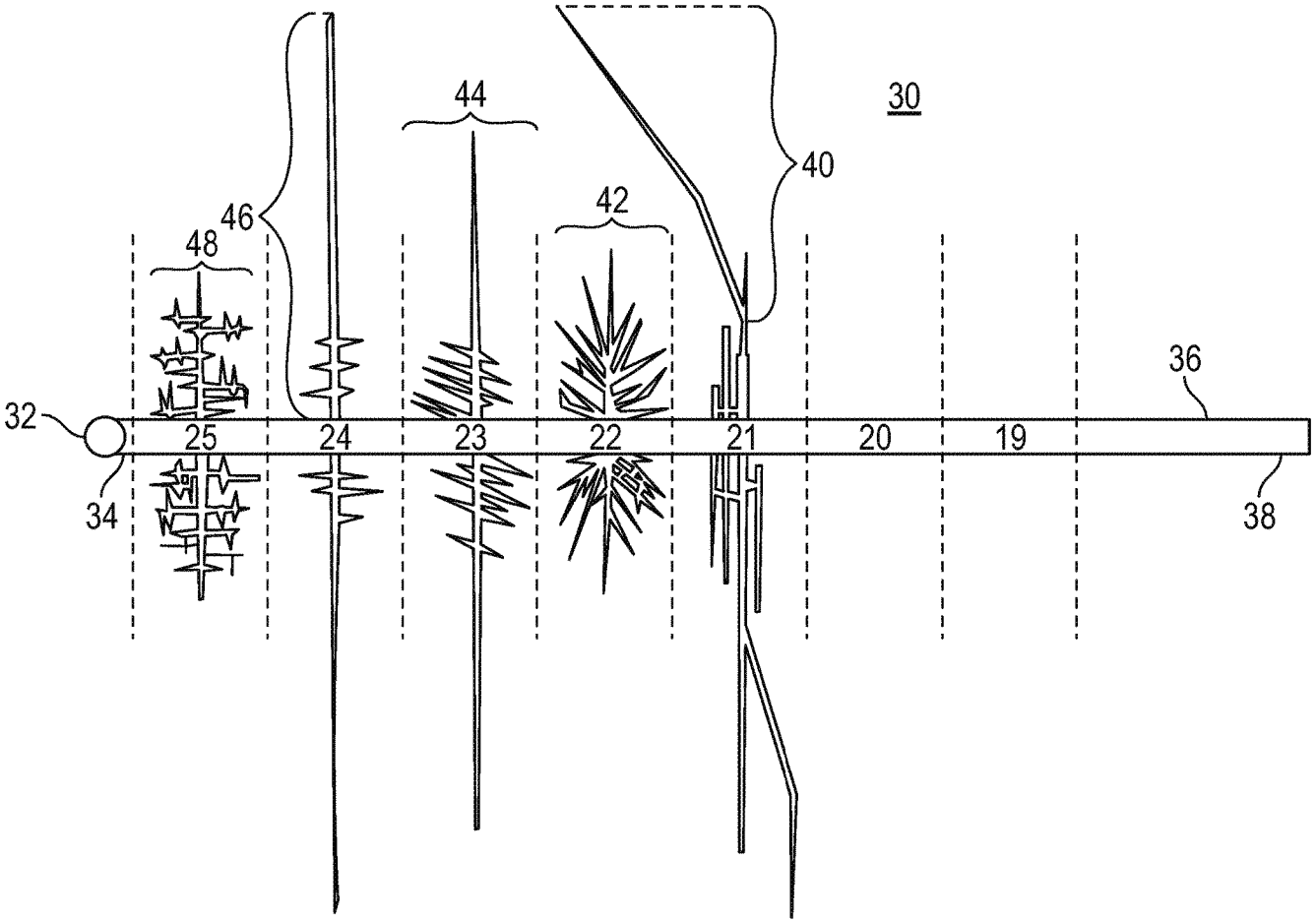
FIG. 1 is a schematic, plan view of a series of shale intervals in a subsurface volume illustrating along a primary lateral wellbore different types of complex fracture networks.

It will be appreciated that the drawings are schematic and should be understood as not necessarily to scale or proportion, and that certain features are exaggerated for emphasis. Furthermore, the methods and configurations described herein should not be limited to particular embodiments illustrated in the drawings.

DETAILED DESCRIPTION

Obtaining subterranean formations using a single wellbore or "mono-bore" approach, even implementing directional drilling and hydraulic fracturing, has a number of limitations, including, but not necessarily limited to, only obtaining information about the immediate environment of the single wellbore and the single wellbore wall.

It has been discovered that the use of at least one diagnostic lateral wellbore adjacent or proximate to at least one primary lateral wellbore or another diagnostic lateral wellbore may provide a wealth of information about the at least one primary lateral wellbore and/or diagnostic lateral wellbore and/or the subsurface volume surrounding these wellbores. As defined herein, in one non-limiting embodiment, primary lateral wellbores are lateral wellbores drilled for performing primary diagnostic-based treatments within one or more fracturing interval locations along the length of the lateral, for understanding and improving how best to stimulate and produce geo-specific shale reservoirs, and may include eventual production of hydrocarbons from the reservoir into which they are placed for many types of treatments and/or treatment conditions and how best to influence reservoir hydrocarbon production.

As also defined herein, in one non-limiting embodiment, "near-wellbore" is within 20 feet (6 m) of the wellbore, alternatively within 60 feet (18 m) of the wellbore. In one non-limiting embodiment, "far-field" is defined as greater than 60 feet (15 m) from the wellbore; alternatively as 100 feet (30 m) or greater from the wellbore.

A further limitation with conventional mono-bore approaches is that after a fracturing treatment of shale formation in a subsurface volume bearing a hydrocarbon reservoir it is difficult to know what actually happened within the reservoir. FIG. 1 is a schematic, plan view of a series of shale intervals 19, 20, 21, 22, 23, 24 and 25 in a subsurface volume or subterranean formation 30 illustrating a vertical wellbore 32 and a primary lateral wellbore 36 having a heel 34 and a toe 38. Schematically illustrated along a primary lateral wellbore 36 are different types of complex fracture networks 40, 42, 44, 46, and 48. It will be appreciated that these different types of complex fracture networks do not illustrate all possible types of complex fracture networks, and are instead illustrative of the fact that each fracture network is different from the next, even comparing adjacent fracture intervals.

By "fracture networks" or "complex fracture networks" is meant that a series and/or distribution of multiple fractures are generated hydraulically that provide fluid flow pathways and communication through the ultra-low permeability shale reservoir or other reservoir type to the wellbore or wellbores, in contrast to simply forming a single fracture and/or a few fractures within the shale reservoir that connect to the wellbore. It is much more desirable to create fracture complexity both in the near-wellbore region and far-field regions than to have a single fracture or a few large fractures. The more surface area of the shale reservoir that is exposed and connected to a wellbore or wellbores (i.e. complex fracture network) through hydraulic fracturing the better, that is, close to the wellbore (near wellbore complex fractures) as well as far from the wellbore (far-field complex fractures). In most cases, when hydraulically fracturing, far-field complex fracture networks are more difficult to create, and as compared to near wellbore complex fracture, typically have reduced number of fractures, surface area, and less flow path systems in further relation to the wellbore.

Additionally, FIG. 1 illustrates how different geo-specific shales may react to the same fracture treatment. Furthermore, the methods described herein will help diagnose, analyze and interpret these complex fracture networks, as well as to obtain more accurate information about other subsurface volume structures including the wellbore wall and earth and rock around the wellbore. Parameters that can be determined using one or more of the methods described herein include, but are not necessarily limited to, parameters that control fracture geometry in geo-specific shales, and parameters that control reservoir production for geo-specific shales. These methods may also be used for quicker location of sweet-spot horizons in reservoirs (defined herein as the strata within a shale interval that represents the best production or potential production of hydrocarbons) and how produced reservoirs react to refracturing (refrac) techniques. In other words, accuracy in targeting and fracturing sweet-spot horizons may be improved.

It has been discovered that many of these problems and limitations may be overcome using multiple lateral wellbores—beyond conventional "mono-bore" approaches. The use of multiple lateral wellbores can provide knowledge about processes including, but not necessarily limited to, fracture network closure, fracture network cleanup, optimized production enhancement and/or remediation treatments, multi-lateral refracturing ("refrac") treatments, and combinations of these.

The method includes combinations of one or more diagnostic lateral wellbores adjacent and/or proximate to one or more primary lateral wellbores for fracture imaging during and after diagnostic treatments. The method can, through optimized, close proximity to ultra-close proximity of diagnostic instruments to the fractured interval (i.e. solely for improving imaging resolution of stimulated interval) image shale complex fracture networks in real-time; that is during the different stages of hydraulic fracture treatment to a rock volume. By placement of these one or more diagnostic lateral wellbores in close proximity to ultra-close proximity for high to ultra-high imaging resolution of the fracture interval, these methods help observe and thereby learn and understand how treatment parameters control complex fracture network growth and geometry in geo-specific shales. As defined here-in, moderately-close proximity is defined as between 300 to 600 feet (91 meters and less than 183 meters) from the primary lateral, close proximity is defined as between 200 feet to less than 300 feet (61 and less than 91 meters) from the primary lateral, very-close proximity is defined as between 100 and less than 200 feet (30 and less than 61 meters) from the primary lateral, and ultra-close proximity is defined as between 0 feet to less than 100 feet (0 and less than 30 meters) from the primary hydraulic fracture and/or fracture plane generated during a primary diagnostic treatment. The use of diagnostic laterals and their proximity placements herein is to obtain the highest imaging resolution possible for gathering as much information about physical changes to the immediate reservoir rock volume, during diagnostic hydraulic fracturing processes, during cleanup of the treatment fluid, during diagnostic well induced cleanup of the fracture network and/or interval (i.e. assisted cleanup to understand the importance of degree of treatment fluid cleanup to production), importance of fracture network closure processes, during production optimization treatments originating from the primary and/or diagnostic lateral, and/or parameters that improve fracture network growth and treatment fluid recovery for refrac treatments.

More specifically, the use of diagnostic lateral wellbores can improve fracture imaging and diagnostic treatments. Fracture imaging includes, but is not limited to, imaging hydraulic fracture generation, mapping fracture network cleanup, production fluid mapping, imaging fractures during refracs, and wildcat field development data, and the like. Diagnostic treatments include, but are not necessarily limited to, diagnostic frac treatments, diagnostic closure experiments, improving fracture network cleanup, optimizing production treatments, and diagnostic refrac treatments. Diagnostic information that may be generated includes, but is not necessarily limited to, parameters that control fracture geometry in geo-specific shales, parameters that control reservoir production for geo-specific shales, parameters for quicker location of sweet-spot horizons in reservoirs, parameters and materials and chemical processes for more effective treatment fluid recovery and resultant fracture network permeability and/or conductivity, and/or determining how produced reservoirs react to refracturing techniques.

In new field evaluations, the use of multiple diagnostic lateral wellbores can assist in locating economical horizons. In early field learning, these multiple diagnostic lateral wellbores can help in identifying and landing in sweet-spot horizons; help determine the primary lateral wellbore location and length, help determine diagnostic lateral wellbore type, placement and purposes; map fracture treatments (design parameters vs. fracture network complexity); help design the number of fracture intervals, improve the basic frac treatment design, investigate aggressive frac processes, and improve fracture network cleanup and treatment cleanup techniques. In main field completions, the use of multiple lateral diagnostic wellbores can assist in optimizing frac treatments and cleanup designs. In mid- to late well production, multiple lateral wellbores can help with production fluid mapping, evaluation of production optimization treatments and the applications of treating chemicals. In refracs, the multiple lateral wellbores may assist with the selection of candidate fields, fracture intervals, the fracture treatment design and mapping, and fracture cleanup techniques. The use of one or more diagnostic lateral wellbore can help optimize fracturing treatment design for geo-specific shale reservoirs, that is, shale formations at a geographically specific location. It is important to the shale completion industry to learn more specifically and much more quickly how each shale reservoir should be hydraulically fractured for optimum fracture complexity, surface area generated, amount and distribution of fracture conductivity, determination of high permeability and/or hydrocarbon sweet-spot horizons and the like.

Learning and diagnosing shale hydraulic fracturing includes at least seven areas: (1) fracture geometry, (2) fracture diversion and fracture complexity, (3) fracture conductivity, (4) fracture closure, (5) fracture cleanup, (6) dual-wellbore and multi-wellbore improvements (going beyond mono-bore stimulation and production), and (7) sweet-spots (the parameters controlling access to and stimulation of sweet-spot horizons). (1) Fracture geometry includes, but is not necessarily limited to (a) effects of fluid parameters, (b) effects of treatment parameters, (c) effects of reservoir parameters, and (d) how to detect sweet-spot horizons. (2) Fracture diversion and fracture complexity includes, but is not necessarily limited to (a) how to control fractures in specific locations, (b) effects of various treatment fluids, (c) effects of materials, concentrations, and staging, (d) effects of pump rate, and (e) effects of reservoir parameters. (3) Fracture conductivity includes, but is not necessarily limited to (a) proppant transport and distribution, (b) complex fracture network conductivity, (c) primary fracture plane conductivity, and (d) transitional conductivity versus choke points. (4) Fracture closure includes, but is not necessarily limited to (a) primary fractures, (b) complex fracture networks, (c) effects on fracture conductivity, and (d) optimum location(s) for inducing closure. (5) Fracture cleanup includes, but is not necessarily limited to (a) effects of natural cleanup methods, (b) effects of induced cleanup methods, (c) importance of complex fracture network cleanup, (d) importance of primary fracture network cleanup, (e) importance of distance and conductivity to perforations, and (f) effects on sweet-spot productivity.

In another non-limiting embodiment, the process of establishing communication between adjacent lateral production wellbores, for improving methods to induce fracture network closure, for cleaning up fracture networks, injecting production chemicals, performing refracs, and the time between drilling primary laterals and assisting laterals can be several years, and after primary laterals or other lateral wellbores have been produced for several years. In other words, acreage and a field of lateral production wellbores may already exist where in-field drilling of additional lateral wellbores between or adjacent to existing lateral wellbores may be configured to diagnose the multi-lateral stimulation and production benefits. In one non-limiting example, the newer production lateral wellbores drilled may be labeled as "primary laterals" and the existing or older and already produced lateral wellbores as "assisting laterals". The in-fill new lateral wellbores could then be multi-laterally stimulated with use of the existing production lateral wellbores, where the new lateral wellbore is first near-wellbore fractured followed by then generating a conductive primary fracture into the older laterals' fracture network and/or to or very near the older laterals' wellbores, followed by release of treatment pressure through the older lateral wellbores to induce closure of the new primary lateral fracture network, and then eventually the older lateral wellbores are used to supply energy and mass or cleanup fluid to clean-up the prior and/or the newly created fracture network, where the cleanup fluid and the residual treatment fluid is produced into the new primary lateral wellbore. By "in-fill" is meant a wellbore that is positioned between or more pre-existing wellbores. In summary, the function of a lateral wellbore may (or may not) change over time, and/or the physical configuration of lateral and vertical wellbores, and their spatial relationships to each other may change over time as new wellbores are introduced.

The first drilling and producing conventional field lateral wellbores followed by later time in-fill lateral drilling may be advantageous for many reasons to the operator. The methods described here using diagnostic lateral wellbores can help diagnose factors including, but not necessarily limited to, (a) determining hydrocarbon production economics, (b) determining areas of the acreages and shale reservoir which may indicate having higher total hydrocarbon content, (c) lessons learned through different completion parameters (such as interval spacing, perforation spacing and density, and the like), (d) better indication of horizons of the shale interval that are the sweet spots, and the like, and these factors can play a role in a later in-fill drilling program that utilizes the bi-directional communication of laterals established between old and new lateral wellbores that are stimulated between the multiple lateral wellbores. In one non-limiting embodiment, all laterals, both old and new, can then be producing laterals. There can be a wide range of variables in how the old laterals and perforated intervals are utilized in respect to the newly drilled adjacent laterals.

In another non-limiting example, the older lateral wellbores may be refractured followed by the new primary lateral stimulation process, where the re-stimulation includes a new in-fill completion process. In yet another non-limiting example, once the new lateral wellbore is stimulated and cleaned up through use of the older adjacent lateral wellbores, the older lateral wellbores can initially or later become the far-field complex fracture network in relation to the new primary lateral wellbore and its production characteristics. By using diagnostic lateral wellbores, the in-fill process may also, in another non-limiting example, provide a wide range of diagnostic information in drilling, stimulating, closing, cleanup and production of the new in-fill primary lateral wellbores. The diagnostic information may be different or similar as compared to all adjacent lateral wellbores being newly drilled and non-produced prior to stimulation, closure and cleanup process by lateral-to-lateral communication established in multi-lateral completions as described herein. The more complete and more accurate information about processes and events downhole can have considerable economic value about how to better improve stimulation and completions of shale reservoirs in general or in geo-specific areas.

There are a multitude of suitable configurations for one or more diagnostic lateral wellbores in proximity to or adjacent to one or more primary lateral wellbores. Only a limited number can be described herein.

Figure 2B:
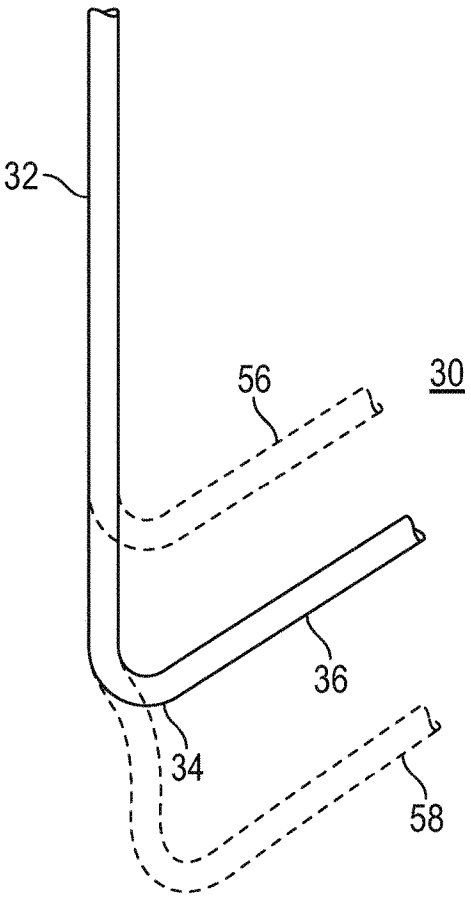
FIG. 2B is a schematic, three-quarters view illustrating a vertical wellbore with a primary lateral wellbore extending therefrom and placement of a parallel diagnostic lateral wellbore from the same vertical wellbore above the primary lateral wellbore and also placement of a parallel diagnostic lateral wellbore below and parallel to the primary lateral wellbore.
Figure 2A:
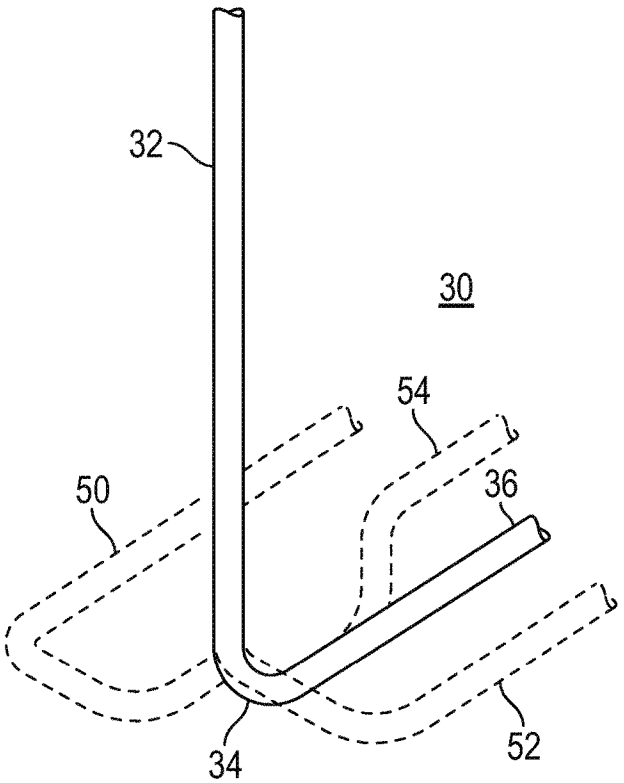
FIG. 2A is a schematic, three-quarters view illustrating a vertical wellbore with a primary lateral wellbore extending therefrom and various placements of diagnostic lateral wellbores from the same vertical wellbore to either side and also a diagnostic lateral wellbore extending parallel from the primary lateral wellbore.

Turning to the Figures, FIG. 2A is a schematic, three-quarters view illustrating a vertical wellbore 32 with a primary lateral wellbore 36 extending therefrom and turning at heel 34. FIG. 2A illustrates various placements of diagnostic lateral wellbores from the same vertical wellbore 32, for instance diagnostic lateral wellbore 50 on the left side and diagnostic lateral wellbore 52 on the right side, and also a diagnostic lateral wellbore 54 extending from the primary lateral wellbore itself and placed above primary lateral wellbore 36. FIG. 2B is a schematic, three-quarters view illustrating a vertical wellbore 32 with a primary lateral wellbore 36 extending therefrom and placement of a parallel diagnostic lateral wellbore 56 from the same vertical wellbore 32 above the primary lateral wellbore 36 and also placement of a parallel diagnostic lateral wellbore 58 below the primary lateral wellbore 36. All diagnostic lateral wellbores 50, 52, 54, 56 and 58 are parallel to and adjacent and/or proximate primary lateral wellbore 36.

In non-limiting embodiments, when at least one diagnostic lateral wellbore is substantially adjacent to and/or proximate to at least one primary lateral wellbore, this is defined herein as within about 50 independently to about 1200 feet (about 15 independently to about 366 meters) of each other, alternatively within about 100 independently to about 800 feet (about 30 independently to about 244 meters) of each other. "Substantially parallel" is defined herein as within 0 independently to about 8° of the same angle as each other; alternatively within from about 0° independently to about 5° of each other. That is, the adjacent lateral wellbores do not need to be precisely parallel to be considered substantially parallel. The term "independently" as used herein with respect to a range means that any lower threshold may be combined with any upper threshold to give a suitable alternative range. As will be explained and shown, however, the adjacent diagnostic lateral wellbore need not be parallel or even substantially parallel to the primary lateral wellbore and the subsurface volume that is being diagnosed.

Figure 3:
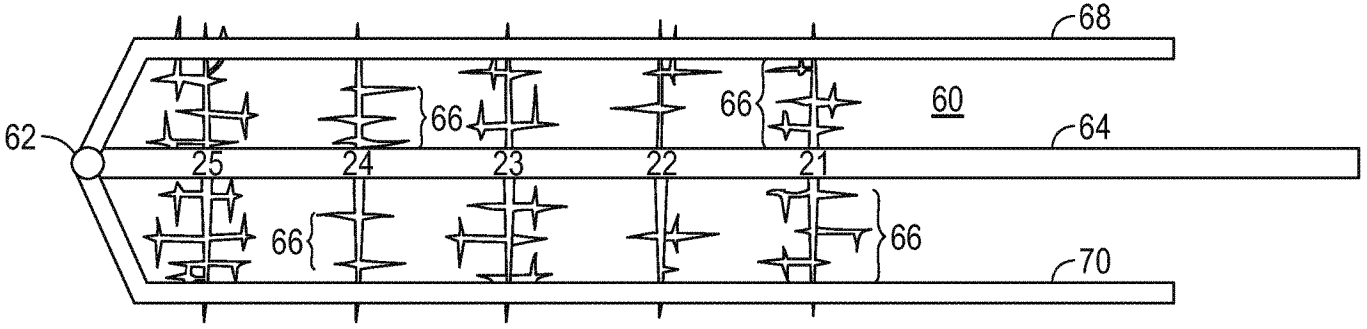
FIG. 3 is top down, plan sectional view of a subsurface volume illustrating a primary lateral wellbore having fracture networks extending from either side thereof in numbered fracture intervals, where there are diagnostic lateral wellbores parallel to and on either side of the primary lateral wellbore and in the same plane as the primary lateral wellbore.

FIG. 3 is top down, plan sectional view of a subsurface volume 60 illustrating a vertical wellbore 62 (viewed on end) a primary lateral wellbore 64 having fracture networks 66 extending from either side thereof in numbered fracture intervals 21, 22, 23, 24 and 25, where there is a left diagnostic lateral wellbore 68 and a right diagnostic lateral wellbore 70, parallel to and on either side of the primary lateral wellbore 64 and in the same plane as the primary lateral wellbore 64. Left diagnostic lateral wellbore 68 and a right diagnostic lateral wellbore 70 may be used to diagnose subsurface volume 60, fracture networks 66 and surface of primary lateral wellbore 64.

Figure 4:
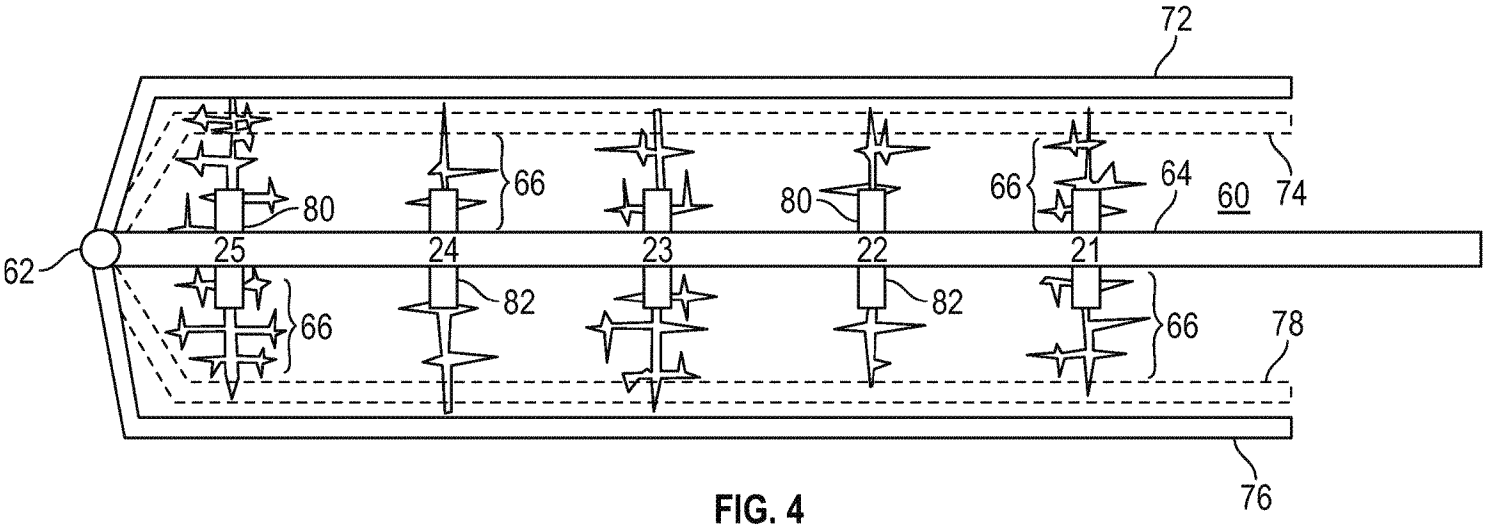
FIG. 4 is top down, plan sectional view of a subsurface volume illustrating a primary lateral wellbore having fracture networks extending from either side thereof in numbered fracture intervals, where there are two diagnostic lateral wellbores parallel to and on either side of the primary lateral wellbore, one pair of diagnostic lateral wellbores in a plane above the plane of the primary lateral wellbore and one pair of diagnostic lateral wellbores in a plane below (shown in dashed lines) the plane of the primary lateral wellbore, as well as showing boreholes crossing through upper shale horizons from the primary lateral wellbore and boreholes crossing through lower shale horizons from the primary lateral wellbore.

FIG. 4 is top down, plan sectional view of a subsurface volume 60 similar to that of FIG. 3 so the same reference numbers are used for the same components, illustrating a primary lateral wellbore 64 having fracture networks 66 extending from either side thereof in numbered fracture intervals 21-25. However, in this embodiment, there are two diagnostic lateral wellbores parallel to and on either side of the primary lateral wellbore 64: left upper imaging diagnostic lateral wellbore 72, left lower imaging diagnostic lateral wellbore 74 (dashed lines), right upper imaging diagnostic lateral wellbore 76, and right lower imaging diagnostic lateral wellbore 78 (dashed lines). More specifically, one pair of diagnostic lateral wellbores 72 and 76 are in a plane above the plane of the primary lateral wellbore 64 and one pair of diagnostic lateral wellbores 74 and 78 in a plane below the plane of the primary lateral wellbore 64. FIG. 4 also shows boreholes 80 crossing through upper shale horizons from the primary lateral wellbore 64 and boreholes 82 crossing through lower shale horizons from the primary lateral wellbore 64. Diagnostic devices (such as those discussed in more detail below) may be used to diagnose subsurface volume 60, fracture networks 66, the direction and extent of boreholes 80 and 82, and the surface of primary lateral wellbore 64.

Figure 5:
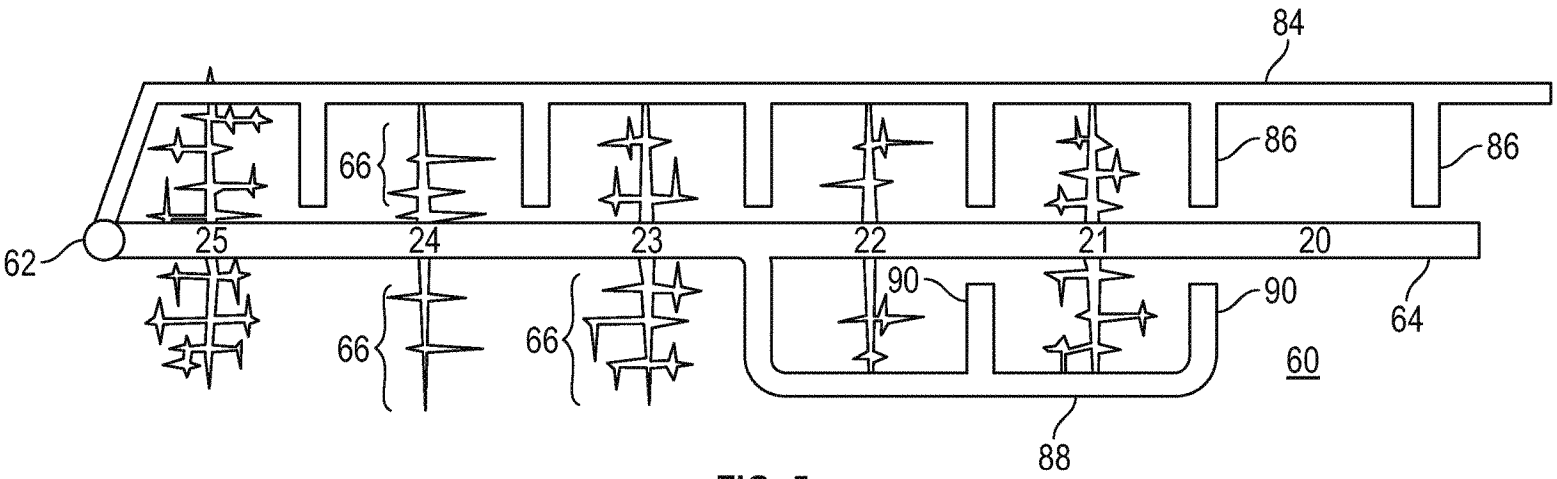
FIG. 5 is a top down, plan sectional view of a subsurface volume illustrating a primary lateral wellbore having fracture networks extending from either side thereof in numbered fracture intervals, where there is a first diagnostic lateral wellbore parallel to and on the left side of the primary lateral wellbore having imaging diagnostic lateral wellbores between all of the fracture intervals and a second diagnostic lateral wellbore parallel to and on the right side of the primary lateral wellbore having imaging diagnostic lateral wellbores between certain the fracture intervals further along the primary lateral wellbore.

FIG. 5 presents a top down, plan sectional view of a subsurface volume 60 illustrating a primary lateral wellbore 64 having fracture networks 66 extending from either side thereof in numbered fracture intervals 20-25, where there is a first diagnostic lateral wellbore 84 parallel to and on the left side of the primary lateral wellbore 64 having imaging diagnostic lateral wellbores 86 perpendicular to the first diagnostic lateral wellbore 84 between all of the fracture intervals 21-25. Also shown is a second diagnostic lateral wellbore 88 on the right side of the primary lateral wellbore 64 having imaging diagnostic lateral wellbores 90 perpendicular to the second diagnostic lateral wellbore 88 between certain the fracture intervals 20-22 further along the primary lateral wellbore 64 on the right side thereof. Second diagnostic lateral wellbore 88 extends from primary lateral wellbore 64 between intervals 22 and 23 and extends parallel to primary lateral wellbore 64, in one non-limiting embodiment.

Figure 6:
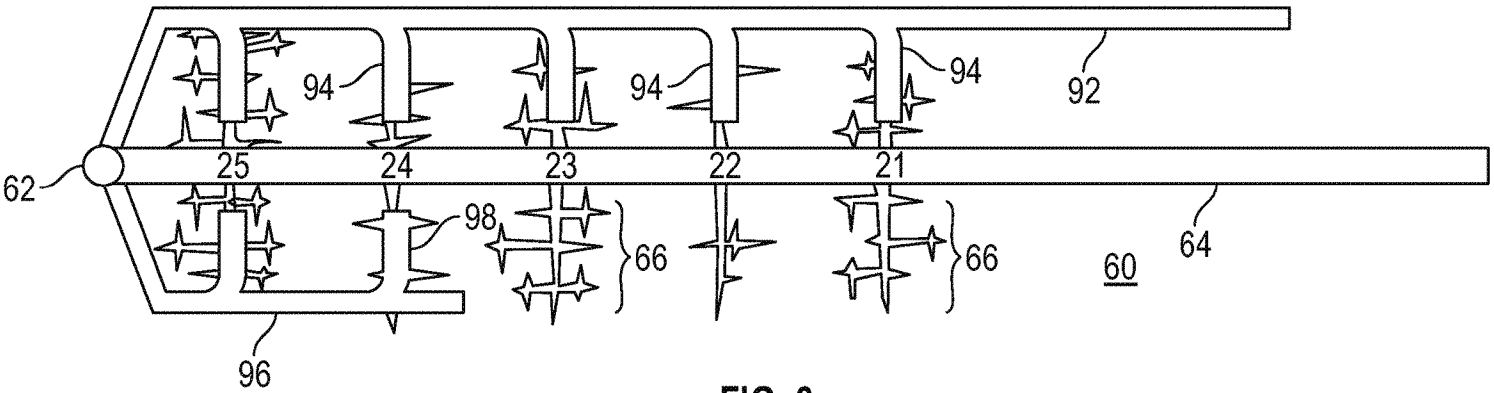
FIG. 6 is a top down, plan sectional view of a subsurface volume illustrating a primary lateral wellbore having fracture networks extending from either side thereof in numbered fracture intervals, where there are diagnostic lateral wellbores parallel to and on the left and right sides of the primary lateral wellbore having imaging diagnostic lateral wellbores in the fracture planes perpendicular to the primary lateral wellbore.

FIG. 6 presents a top down, plan sectional view of a subsurface volume 60 illustrating a primary lateral wellbore 64 having fracture networks 66 extending from either side thereof in numbered fracture intervals 21-25, where there is a first diagnostic lateral wellbore 92 parallel to and on the left side of the primary lateral wellbore 64 having imaging diagnostic lateral wellbores 94 perpendicular to the first diagnostic lateral wellbore 92 where the imaging diagnostic lateral wellbores 94 are in the fracture plane of fracture intervals 21-25. Also shown is a second diagnostic lateral wellbore 96 on the right side of the primary lateral wellbore 64 having imaging diagnostic lateral wellbores 98 perpendicular to the second diagnostic lateral wellbore 88 which are in the fracture plane of only fracture intervals 24 and 25 along the primary lateral wellbore 64 on the right side thereof. FIG. 6 shows the option of diagnosing only a few fracture intervals. Second diagnostic lateral wellbore 96 extends from vertical wellbore 62 parallel to primary lateral wellbore 64 and only goes to intervals 24 and 25, in one non-limiting embodiment. As may be seen in FIGS. 5 and 6, imaging diagnostic lateral wellbores 86, 90, 94 and 98 may contain diagnostic devices (such as those discussed in more detail below) used to diagnose subsurface volume 60, fracture networks 66, the direction and extent of and the surface of primary lateral wellbore 64.

Figure 7:
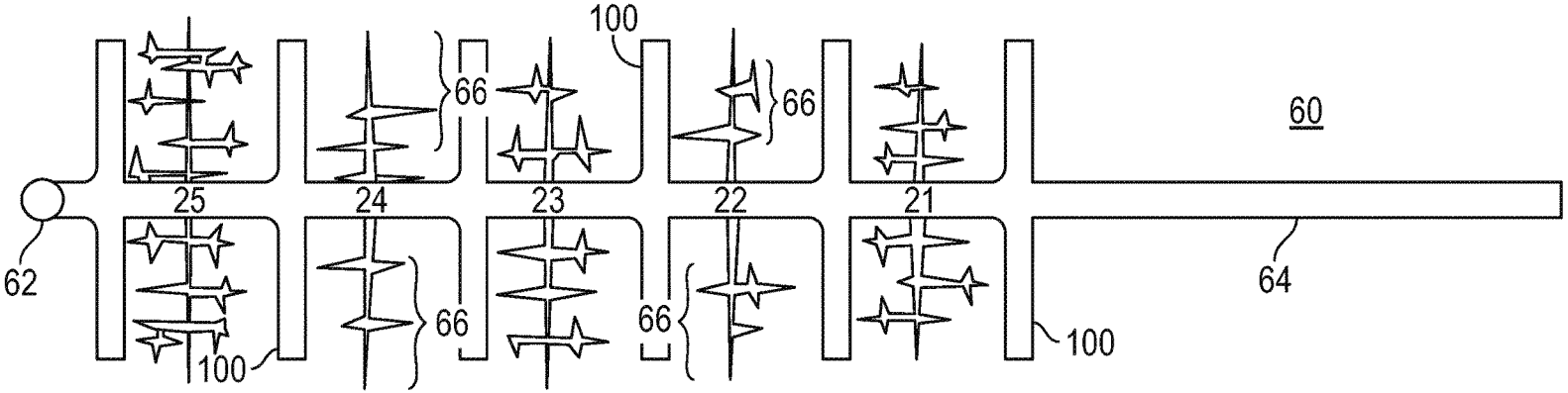
FIG. 7 is a top down, plan sectional view of a subsurface volume illustrating a primary lateral wellbore having fracture networks extending from either side thereof in numbered fracture intervals, where there are imaging diagnostic lateral wellbores extending perpendicularly from the primary lateral wellbore in between fracture intervals in generally the same plane thereof.
Figure 8:
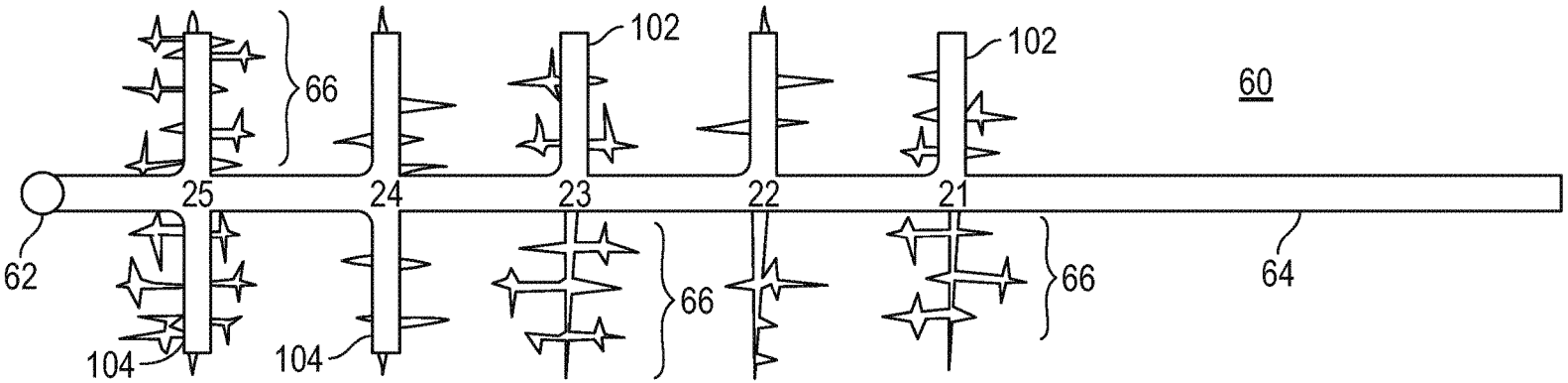
FIG. 8 is a top down, plan sectional view of a subsurface volume illustrating a primary lateral wellbore having fracture networks extending from either side thereof in numbered fracture intervals, where there are imaging diagnostic lateral wellbores extending perpendicularly from the primary lateral wellbore in the same plane as the fracture intervals.

FIG. 7 illustrates a top down, plan sectional view of a subsurface volume 60 illustrating a primary lateral wellbore 64 having plurality of fracture networks 66 extending from either side thereof in numbered fracture intervals 21-25, where there are imaging diagnostic lateral wellbores 100 extending perpendicularly from the primary lateral wellbore 64 in between fracture intervals 21-25 and in generally the same plane thereof. FIG. 8 is a top down, plan sectional view of a subsurface volume 60 illustrating a primary lateral wellbore 64 having fracture networks 66 extending from either side thereof in numbered fracture intervals 21-25, where there are imaging diagnostic lateral wellbores 102 extending perpendicularly from the primary lateral wellbore 64 on the left side thereof in the same plane as and in all of the fracture intervals 21-25. FIG. 8 also shows imaging diagnostic lateral wellbores 104 extending perpendicularly from the primary lateral wellbore 64 on the right side thereof in the same plane as and in only fracture intervals 24 and 25, showing that optionally only a few of the fracture intervals may have an imaging diagnostic lateral wellbore. Again, as may be seen in FIGS. 7 and 8, imaging diagnostic lateral wellbores 100, 102 and 104 may contain diagnostic devices (such as those discussed in more detail below) used to diagnose subsurface volume 60, fracture networks 66, the direction and extent of and the surface of primary lateral wellbore 64. FIGS. 3-8 illustrate just a few of the various acceptable and suitable configurations of at least one diagnostic lateral wellbore adjacent to or proximate to at least one primary lateral wellbore.

Figure 9:
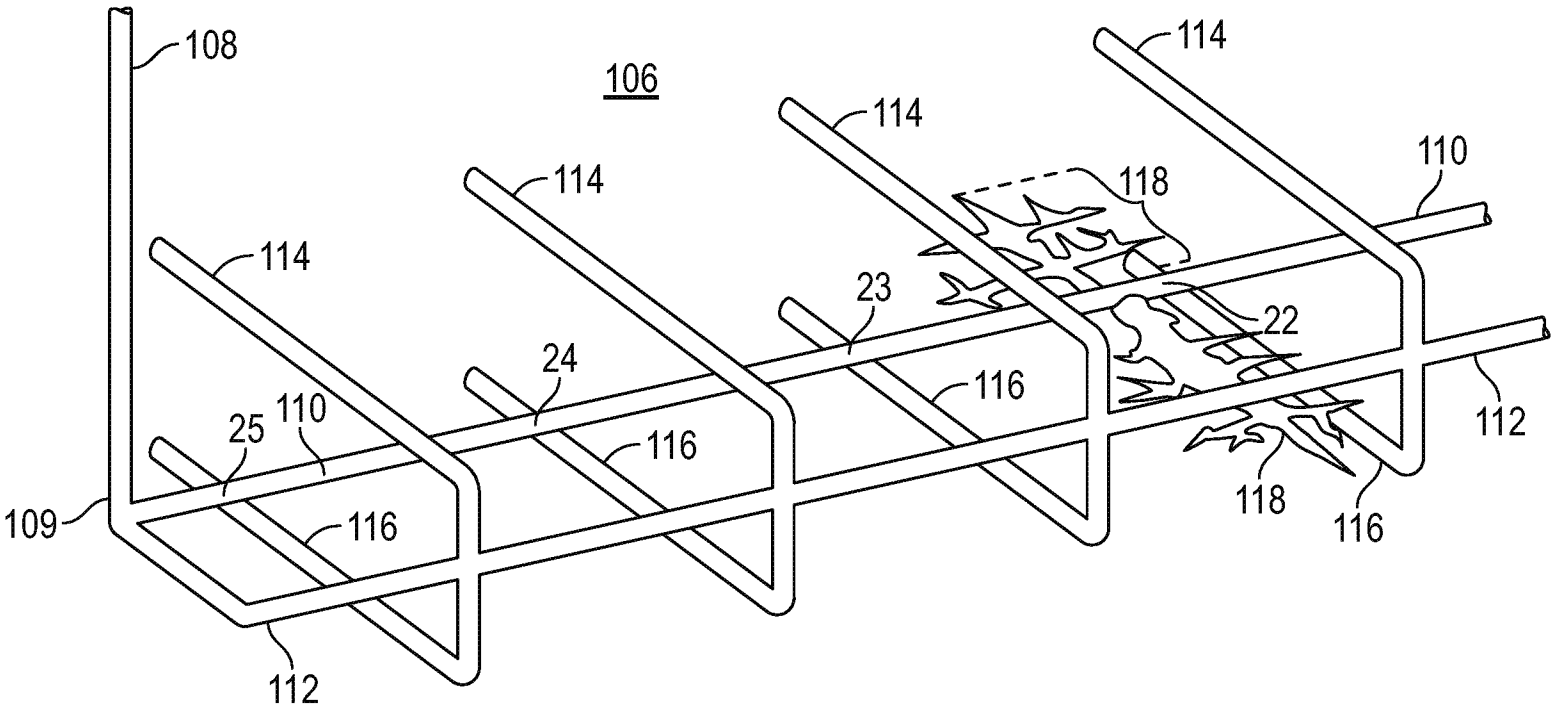
FIG. 9 is a schematic, three-quarters view of a subsurface volume showing a primary lateral wellbore extending from the bottom of a vertical wellbore and a diagnostic lateral wellbore also extending from the bottom of the vertical wellbore, where the diagnostic lateral wellbore is parallel to the primary lateral wellbore, and the diagnostic lateral wellbore has upper and lower imaging diagnostic lateral wellbores extending perpendicular from the diagnostic lateral wellbore over and under the primary lateral wellbore, respectively, between the fracture intervals.

FIG. 9 is a schematic, three-quarters view of a subsurface volume 106 showing a primary lateral wellbore 110 extending from the bottom 109 of a vertical wellbore 108 and a diagnostic lateral wellbore 112 also extending from the bottom of the vertical wellbore 108, where the diagnostic lateral wellbore 112 is parallel to the primary lateral wellbore 110, and the diagnostic lateral wellbore 112 has upper imaging diagnostic lateral wellbores 114 and lower imaging diagnostic lateral wellbores 116 initially extending perpendicular upward and downward, respectively, from the diagnostic lateral wellbore 112 and then over and under the primary lateral wellbore 110, respectively, between the fracture intervals 22-25. Complex fracture network is schematically illustrated at 118. It will be appreciated that in an expected implementation, all of fracture intervals 22-25 will each have its own complex fracture network 118 although only one is shown in FIG. 9 for illustration purposes. It will be appreciated that in the embodiment of FIG. 9, the upper imaging diagnostic lateral wellbores 114 and lower imaging diagnostic lateral wellbores 116 are less directly connected to primary lateral wellbore 110 than in the embodiments previously illustrated in the drawings, but that upper imaging diagnostic lateral wellbores 114 and lower imaging diagnostic lateral wellbores 116 are nevertheless adjacent to and/or proximate to primary lateral wellbore 110 even though they are in different planes of subsurface volume 106.

Figure 10:
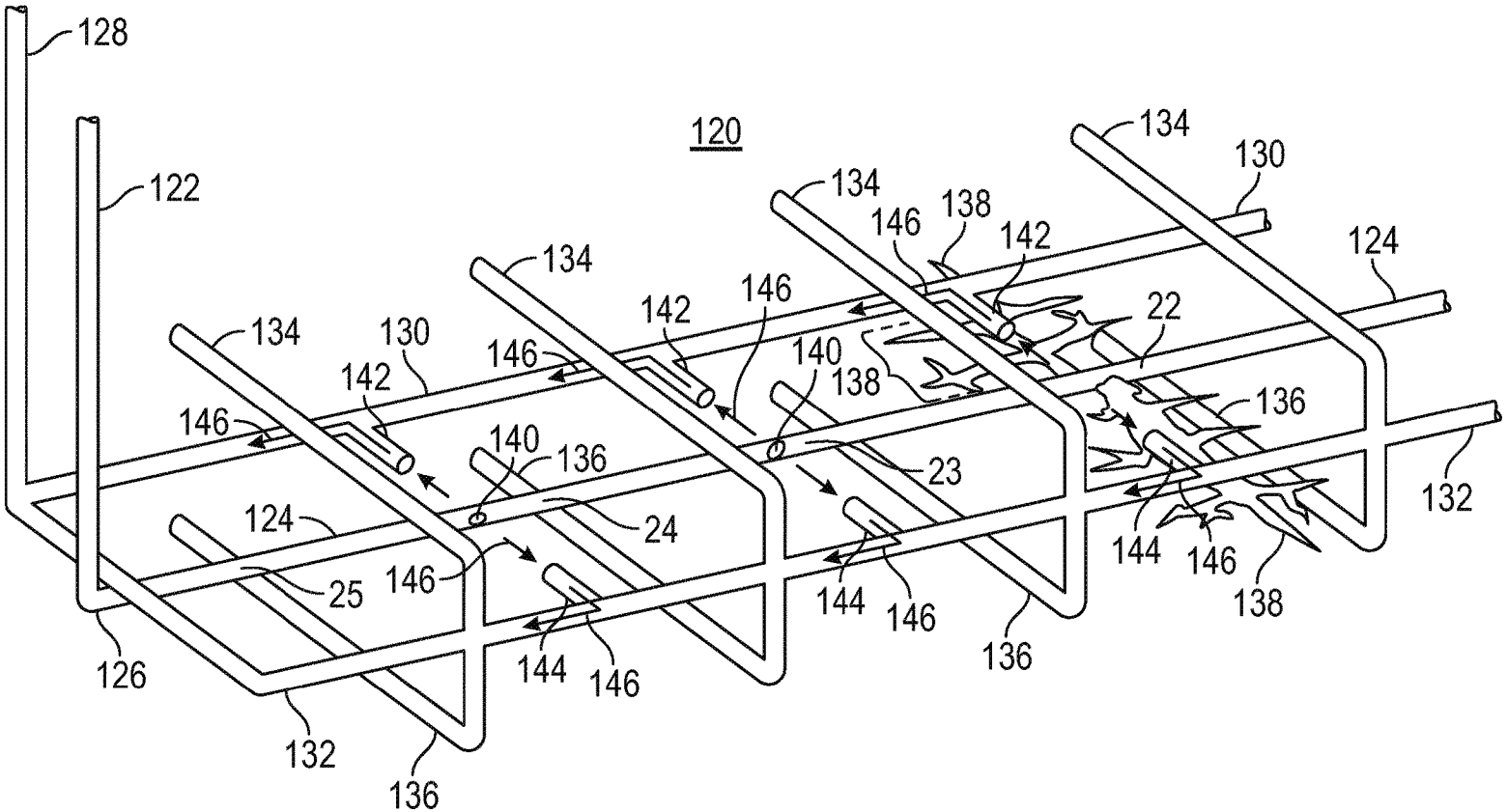
FIG. 10 is a schematic, three-quarters view of a subsurface volume showing a primary lateral wellbore extending from the bottom of a vertical wellbore and a pair of diagnostic lateral wellbore extending from the bottom of a different vertical wellbore, where the diagnostic lateral wellbores are parallel to the primary lateral wellbore, and the diagnostic lateral wellbores have fracture interval outer laterals extending toward the primary lateral wellbore in the same plane as the fracture intervals where the arrows show flow into the outer laterals to facilitate fracture closure.
Figure 11:
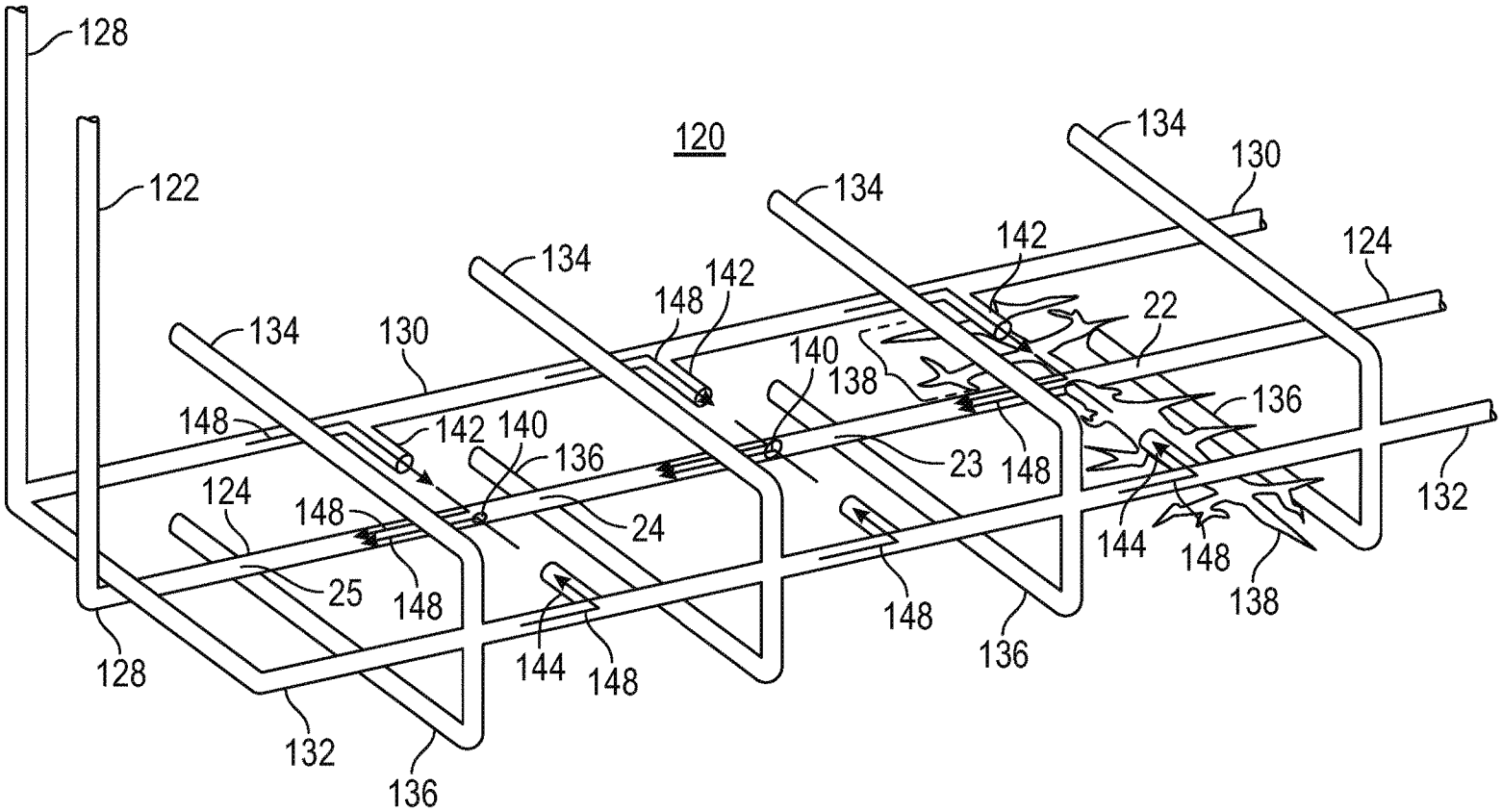
FIG. 11 is a schematic, three-quarters view of the subsurface volume of FIG. 10 where the arrows show that flow is reversed for fracture cleanup.

A somewhat different configuration of primary lateral wellbore and diagnostic lateral wellbores is shown in FIGS. 10 and 11 as compared with the configuration of FIG. 9. Shown in FIGS. 10 and 11 is subsurface volume 120, having a first vertical wellbore 122 therein from which extends a primary lateral wellbore 124 having a heel 126. (It will be appreciated that in all of the embodiments illustrated herein shown and described herein where wellbores are schematically shown to make a sharp turn, as at heel 126 in FIGS. 10 and 11 that in actuality the turning of a bit using directional drilling will, in fact, be more gradual than what is only schematically depicted.) A separate, second vertical wellbore 128 is shown from which extends a left diagnostic lateral wellbore 130 and a right diagnostic lateral wellbore 132. In the non-restrictive embodiment shown in FIG. 10, left diagnostic lateral wellbore 130 and a right diagnostic lateral wellbore 132 are parallel to primary lateral wellbore 124 and generally in the same plane thereof and on either side thereof. Right diagnostic lateral wellbore 132 has upper imaging diagnostic lateral wellbores 134 and lower imaging diagnostic lateral wellbores 136 initially extending perpendicular upward and downward, respectively, from the diagnostic lateral wellbore 132 and then over and under the primary lateral wellbore 124, respectively, between the fracture intervals 22-25.

Also shown in FIGS. 10 and 11 is complex fracture network 138 at interval 22. It will be appreciated that all intervals may have a complex fracture network such as 138, but only one network 138 is shown for simplicity of illustration. Complex fracture network 138 may be formed from perforations 140 schematically illustrated in intervals 23 and 24. Left diagnostic lateral wellbore 130 has fracture interval outer laterals 142 extending toward the primary lateral wellbore 124 in the same plane as the complex fracture networks 138, and right diagnostic lateral wellbore 132 has fracture interval outer laterals 144 extending toward the primary lateral wellbore 124 also in the same plane as the complex fracture networks 138. Arrows 146 show flow into the outer laterals to facilitate, in one non-limiting example, fracture closure. An objective is to generate complex fracture networks 138 by hydraulic fracturing through the perforations 140 in primary lateral wellbore 124 where proppant is squeezed into place in fracture networks 138 created between the wellbores. After the complex fracture networks 138 are created, the treatment pressure is removed after each multi-lateral fracture treatment to timely induce fracture network closure by allowing flow and/or withdrawing fluid from the fracture networks in the directions of the arrows 146 in FIG. 10 via diagnostic lateral wellbores 130 and 132. For the fracture networks 138 around primary lateral wellbore 124, the fracture treatment pressure and quantity of fluid is removed in two directions, to the left and to the right, as schematically illustrated in FIG. 10 facing along the direction of the primary lateral wellbore 124 away from the heel 126. This inducement of closure of the fracture network after each multi-lateral fracture treatment more assuredly places and retains the proppant in the correct places (i.e. vertical distribution in fractures) to provide enhanced vertical conductivity while inhibiting or preventing the proppant from settling in undesirable locations, such as at the bottom of the hydraulic fractures due to extended closure times typical of shale fracturing; that is, fracture closure locks the proppant in place. It should be remembered that generally, in a planar shale formation, the fractures are generally oriented vertically, that is perpendicular to the shale plane. Thus, the depictions of fractures in some of the Figures herein may not be or appear what would in fact occur in a fractured formation. In one non-limiting reservoir treatment evaluation, the ability to induce fracture network closure without having to induce flow into perforations 140 and wellbore 124 can be a diagnostic method towards gaining understanding of the value of enhanced vertical conductivity on reservoir hydrocarbon productivity, in general; that is, to comparative production from loss of vertical conductivity completions, and also if the "sweet-spot" horizon resides in the upper section of subsurface volume 120.

FIG. 11 is a schematic, three-quarters view of the subsurface volume 120 of FIG. 10 where the arrows 148 show that flow is reversed for fracture cleanup. That is, schematically illustrated in FIG. 11 is a multi-lateral fracture network 138 cleanup procedure indicated by arrows 148. In the fracture network 138 cleanup procedure flow is reversed, the cleanup fluid, such as water or brine, or an inert gas (e.g. $N_2$ or $CO_2$) or other treatment fluid with cleanup agents, is injected in a concerted order and time into fracture interval 22 and complex fracture network 138 from outer laterals 142 and 144, and removed by flow into perforations (and/or sliding sleeve) 140 and primary lateral wellbore 124. Conventional diversion techniques may also be used to expand and/or direct treatments within complex fracture network 138 during flow from outer laterals 142 and 144, such as an acidizing treatment; for instance by using crosslinked or uncrosslinked polymers and/or aqueous fluids viscosified with a polymer and/or a VES to divert acid. While all of these wells 124, 130 and 132 may eventually be producing wells once completion is accomplished, it is expected that primary lateral wellbore 124 will be the primary producing wellbore for understanding how particular diagnostic treatment processes and conditions may influence positively or negatively the cleanup and producibility of geo-specific reservoirs.

Alternatively, fracture interval outer laterals 142 and 144 from the parallel diagnostic lateral wellbores 130 and 132 can be injection points for gas, slickwater and the like during a fracturing treatment to control far-field complex fracture development, i.e. as in a dual frac treatment process. The rate, volume, etc. of the injection from the frac interval laterals 142 and 144 can be varied for each interval and the shale interval rock response, fracture complexity, fracture network geometry and the like may be observed using diagnostic devices described herein. Also of particular importance are parameters that control treatment fluid diversion and distribution, such as type and amount of chemical diverter material, staged or continuous addition of diverter, viscosity of fluids, staging and volumes of the fluids, fluid pump rates, presence of natural fissures in the shale and the like. Methodical diagnostic treatments can be performed to determine factors which create near wellbore fracture network complexity, far-field fracture complexity capability, and the like. An important part of changing diagnostic treatment parameters may be finding the parameters that promote optimum treatment fluid interaction with reservoir natural fractures and anisotropy stresses laterally and/or vertically in the reservoir.

It will be appreciated that the fracture interval outer laterals 142 and 144 may be used for a wide variety of purposes and methods, including, but not necessarily limited to, imaging, dual fracturing, forced closures of fracture networks, fracture cleanup, tracer and remedial injections, refracturing treatments and combinations of these methods—most likely in a sequential order.

Besides for mapping hydraulic fracture/natural fracture interaction during hydraulic fracturing treatments, and related flow and distribution of hydraulic fracturing fluid and materials during diagnostic hydraulic fracturing treatments in geo-specific shales, the cleanup of hydraulic fracturing fluids can potentially be mapped in 2D and/or 3D through the combined use of diagnostic lateral wellbores (such as 130 and 132 in FIG. 11 or upper and lower imaging diagnostic lateral wellbores 134 and 136, respectively, but also in many of the other embodiments schematically illustrated herein), reservoir imaging instruments and diagnostic cleanup procedures and materials. The importance of complex fracture interval cleanup may be a larger issue for the productivity of shale reservoirs than many operators recognize, and the generation of information on network cleanup may be very valuable to the industry. It may be possible that laterally assisted forced fracture network closure along with laterally assisted displacement methods and treatments may show which geo-specific shale regions may require dual-bore treatments to achieve maximum hydrocarbon production and maximized return on investment (ROI).

Figure 26:
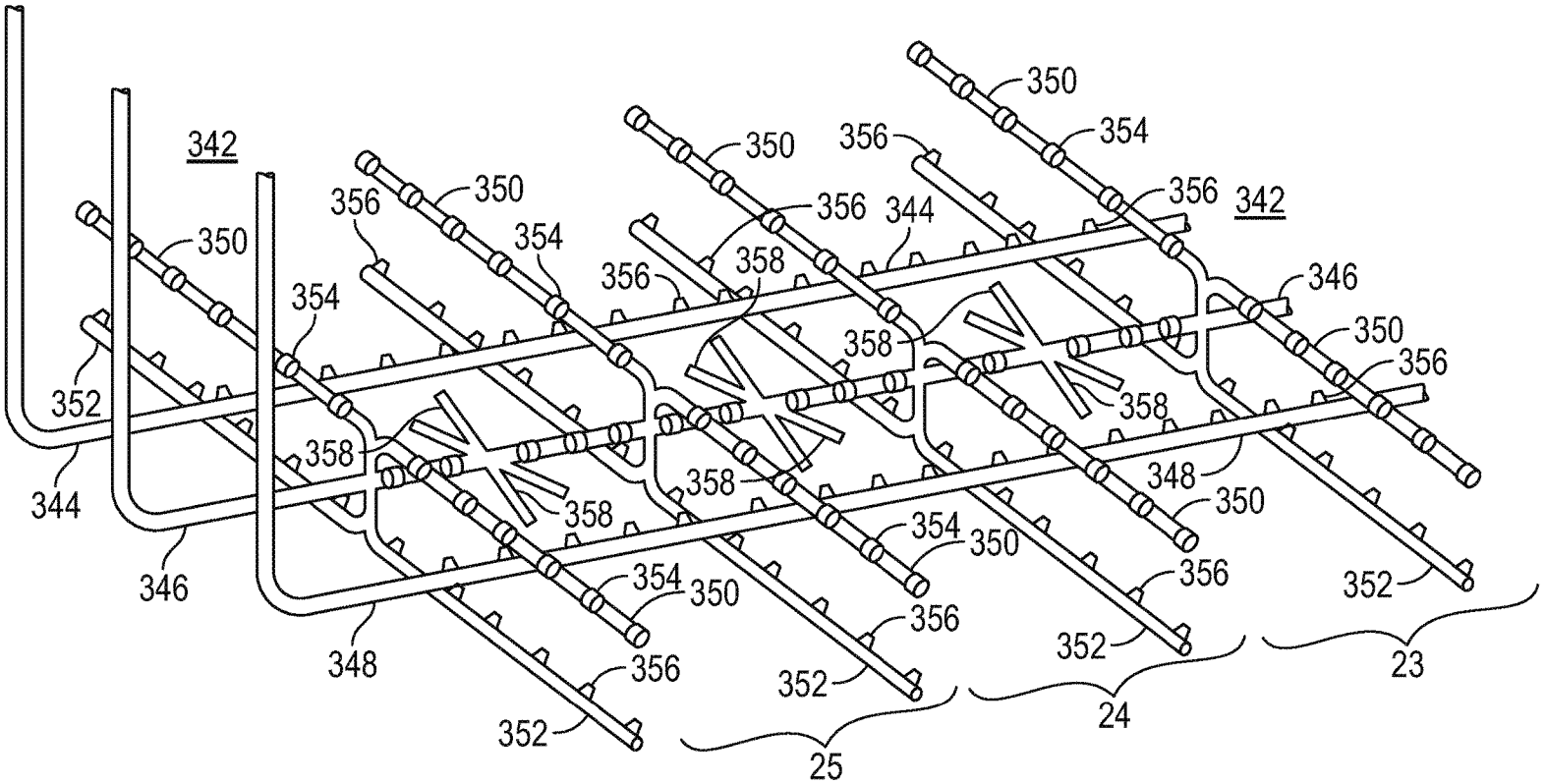
FIG. 26 is a schematic, three-quarters view of a configuration of a pair of primary lateral wellbores having a diagnostic lateral wellbore between them, where the diagnostic lateral wellbore has dual-V oriented fracture interval laterals of moderate length in the fracture plane for fracture network cleanup.

In a non-limiting example, FIG. 26 illustrates a schematic, three-quarters view of a subsurface volume 342 having a configuration of a left primary lateral wellbore 344 and a right primary lateral wellbore 348 having a diagnostic lateral wellbore 346 between them, all in the same generally horizontal plane. Three fracture intervals 23, 24 and 25 are shown for the purposes of simplicity, although a plurality of further fracture intervals beyond 23 may be easily imagined. Diagnostic lateral wellbore 346 has a plurality of upper imaging diagnostic lateral wellbores 350 extending up and over the left and right primary lateral wellbores 344 and 348, respectively, in an upper horizontal plane, as well as a plurality of lower imaging diagnostic lateral wellbores 352 extending down and under the left and right primary lateral wellbores 344 and 348, respectively, in an upper horizontal plane. Diagnostic lateral wellbore 346 and upper imaging diagnostic lateral wellbores 350 have a plurality of acoustic generators 354 placed therein, and lower imaging diagnostic lateral wellbores 352 and primary lateral wellbores 344 and 348 have a plurality of acoustic sensors 356 placed therein.

Diagnostic lateral wellbore 346 has dual-V oriented fracture interval laterals 358 of moderate length in the fracture plane for fracture network closure and cleanup. By "in the fracture plane" is meant that complex fracture networks (not shown) are generated from primary lateral wellbores 344 and 348 via perforations therein (not shown). By "moderate length" is meant from about 20 to about 200 feet (about 6 to about 61 meters). The angles of the dual-V oriented fracture interval laterals 358 relative to the fracture plane may range from about 20° independently to about 80°, up and down; alternatively from about 30° independently to about 60°.

In the FIG. 26 configuration, the evaluation of treatment fluid movement and removal can be compared to neighboring frac intervals (23, 24, 25) by placing diagnostic lateral wellbores 346 around and in the hydraulic fracture networks (not shown for clarity) followed by injection of $CO_2$ gas, e.g., from the far-field parallel diagnostic lateral wellbore (not shown, but in a non-limiting example a diagnostic lateral wellbore to the left of primary lateral wellbore 344 and a diagnostic lateral wellbore to the right of primary lateral wellbore 348) and/or from the V-oriented fracture interval laterals 358 extending from the parallel diagnostic lateral wellbore 346. (It will be appreciated that there may just be one fracture interval lateral 358' on either side of diagnostic lateral wellbore 346 for each interval 23, 24, and 25, etc., in which case they may be called "I-oriented" fracture interval laterals because there is only one. See, for instance imaging diagnostic lateral wellbores 94 and 98 in the fracture plane in the embodiment of FIG. 6 and fracture interval outer laterals 142 and 144 in the fracture plane in the embodiment of FIG. 10.) Imaging the real-time gas placement process (i.e. displacement of treatment fluid in fractures) may show regions of the hydraulic fracture system that did not effectively clean up on their own (i.e. compared to data from neighboring intervals). Thus, diagnostic evaluation of the degree of fracture network system cleanup can be determined for geo-specific shales, including processes, parameters and/or treatment materials for improved treatment fluid load recovery and for determining the related impact and/or importance load recovery on improving reservoir hydrocarbon production.

The diagnostic cleanup fluid may be any suitable treatment fluid, such as an inert gas, e.g. nitrogen ($N_2$) or carbon dioxide ($CO_2$), light brines like 2% KCl, other types aqueous fluids containing formation and/or fracture cleanup chemicals, such as but not necessarily limited to: clay inhibitors, KCl substitutes, clay control agents, corrosion inhibitors, iron control agents, mutual solvents, water wetting surfactants, foaming agents, microemulsion cleanup agents, alkyl silanes and/or other hydrophobic inducing agents to plate on the walls of the fracture and/or on the proppants, biocides, polymer breakers, tracers or tracing agents, non-emulsifiers, reducing agents, chelants such as aminocarboxylic acids and salts thereof, organic acids, esters, resins, mineral acids, viscoelastic surfactants, internal breakers for VES fluids such as mineral oils and/or natural plant and fish oils high in unsaturated fatty acids, polymeric-based friction reducers, inorganic nanoparticles, organic nanoparticles, salts, organic scale inhibitors, inorganic scale inhibitors, slow release scale inhibitor agents like ScaleSORB™ available from Baker Hughes, pH buffers, and the like and combinations thereof.

In shale reservoir cleanup after hydraulic fracture treatments, a return of 10-20 vol % of the hydraulic fracture treatment fluid is considered typical or average. The rest of the fluid is retained in the formation for various reasons and may cause formation damage of various types that restrict and/or reduce hydrocarbon production immediately and/or sometime after the fracture treatment. Many geo-specific reservoirs may be highly sensitive to the amount of residual treatment fluid left in the fracture network. The diagnostic cleanup treatment methods presented herein can help increase the unloading percentages of the treatment fluids, thus helping remove as much fluid as possible to inhibit or prevent or reduce them from causing possible damage. Learning how to obtain returns of about 30 vol % or more, alternatively about 40 vol % or more, and in another non-limiting embodiment about 60 vol % or more are expected with the configurations and methods described herein.

Figure 12:
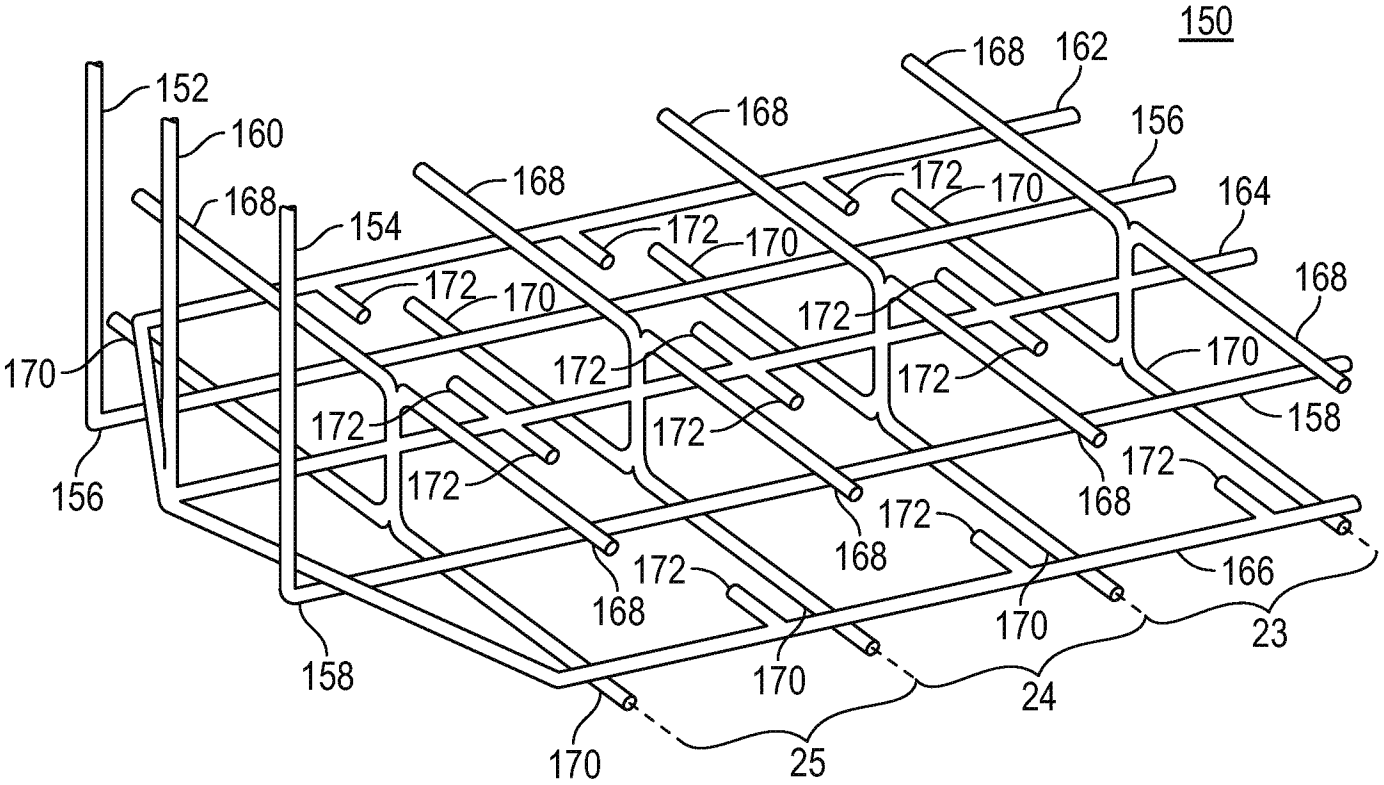
FIG. 12 is a schematic, three-quarters view of a subsurface volume illustrating two vertical wellbores, each with its own primary lateral wellbore and a vertical diagnostic wellbore having three diagnostic lateral wellbores extending therefrom, where the diagnostic lateral wellbores are parallel to and in the plane of the primary lateral wellbores and interdigitated between them, and where the middle diagnostic lateral wellbore has upper and lower imaging diagnostic lateral wellbores extending perpendicularly therefrom and over and under the primary lateral wellbores in planes above and below the primary lateral wellbores.

FIG. 12 illustrates a schematic, three-quarters view of a subsurface volume 150 illustrating two vertical wellbores 152 and 154, each with its own primary lateral wellbore, first primary lateral wellbore 156 and second primary lateral wellbore 158, respectively. Also shown is a single vertical diagnostic wellbore 160 having three diagnostic lateral wellbores extending therefrom: left diagnostic lateral wellbore 162, middle diagnostic lateral wellbore 164 and right diagnostic lateral wellbore 166. The diagnostic lateral wellbores 162, 164, and 166 are parallel to and in the plane of the primary lateral wellbores 156 and 158 and interdigitated between them, i.e. first primary lateral wellbore 156 is between left diagnostic lateral wellbore 162 and middle diagnostic lateral wellbore 164, and second primary lateral wellbore 158 is between middle diagnostic lateral wellbore 164 and right diagnostic lateral wellbore 166. Middle diagnostic lateral wellbore 164 has upper imaging diagnostic lateral wellbores 168 and lower imaging diagnostic lateral wellbores 170 extending perpendicularly therefrom and then over and under the primary lateral wellbores 156 and 158 in planes above and below the plane of primary lateral wellbores 156 and 158, respectively. Diagnostic lateral wellbores 162, 164, and 166 are also shown having fracture interval outer laterals 172 directed toward the nearest primary lateral wellbore, and in the same plane as the primary lateral wellbores 156 and 158. For instance, left diagnostic lateral wellbore 162 has fracture interval outer laterals 172 directed toward primary lateral wellbore 156 for each of intervals 23, 24 and 25. Middle diagnostic lateral wellbore 164 has fracture interval outer laterals 172 directed toward both primary lateral wellbore 156 and primary lateral wellbore 158 for each of intervals 23, 24 and 25. Finally, right diagnostic lateral wellbore 166 has fracture interval outer laterals 172 directed toward primary lateral wellbore 158 for each of intervals 23, 24 and 25. It will be appreciated that there are a variety of places in the relatively more complex configuration of FIG. 12 where diagnostic devices may be placed to emit and/or detect signals to analyze at least one parameter of one or more of the primary lateral wellbores and the subsurface volume around them. Such locations include, but are not limited to diagnostic lateral wellbores 162, 164, and 166, upper imaging diagnostic lateral wellbores 168, lower imaging diagnostic lateral wellbores 170 and/or fracture interval outer laterals 172.

In a different area of concern, the toe to heel multi-interval fracture process isolates the lower frac zones upon treatment completion, leaving the hydraulic fracture networks created to "close" on their own over time. In many cases, since shales typically have permeability in the nano-darcy range, fracture closure time often takes days to weeks. During these extended time periods extreme proppant sedimentation and loss of vertical fracture conductivity in the upper half of the fractures occurs. FIG. 12 additionally illustrates how hydraulic fracture and proppant imaging techniques can be used in combination with pressure release tools that can be activated in diagnostic lateral wellbores such as 162, 164, and 166, and fracture laterals 172 which extend from the parallel diagnostic lateral wellbores 162, 164, and 166.

Locations of the pressure release points along the diagnostic lateral wellbores 162, 164 and 166 can be configured to influence the areas which see closure more quickly. Primary propped fracture locations may be favorable locations for initiating fracture network closure, as seen in FIG. 10 and the discussion thereof, supra. Variation in closure locations and closure times can be evaluated on degree of proppant settling. For example, conductive proppant can be imaged by electrolocation techniques. Variations in the size of the proppants or conductive particles can be utilized to determine how closure time may potentially vary within the fracture network system. If the primary lateral wellbores 156 and/or 158 are placed lower in the shale interval than imaging determined information show of a higher permeability or hydrocarbon sweet-spot horizon, then the result will be that the slow natural closure time and resultant extensive proppant sedimentation will more significantly impact reservoir productivity since the sweet-spot horizon fracture closed without proppant present.

It will be appreciated that fracture interval outer laterals 172 may be of moderate length (about 10 independently to about 100 feet; about 3 independently to about 30 meters) for inducing fracture network closure, or may be of extended length (about 100 independently to about 300 feet; about 30 independently to about 91 meters) for inducing fracture network closure at a greater distance and/or over a wider area.

Figure 13:
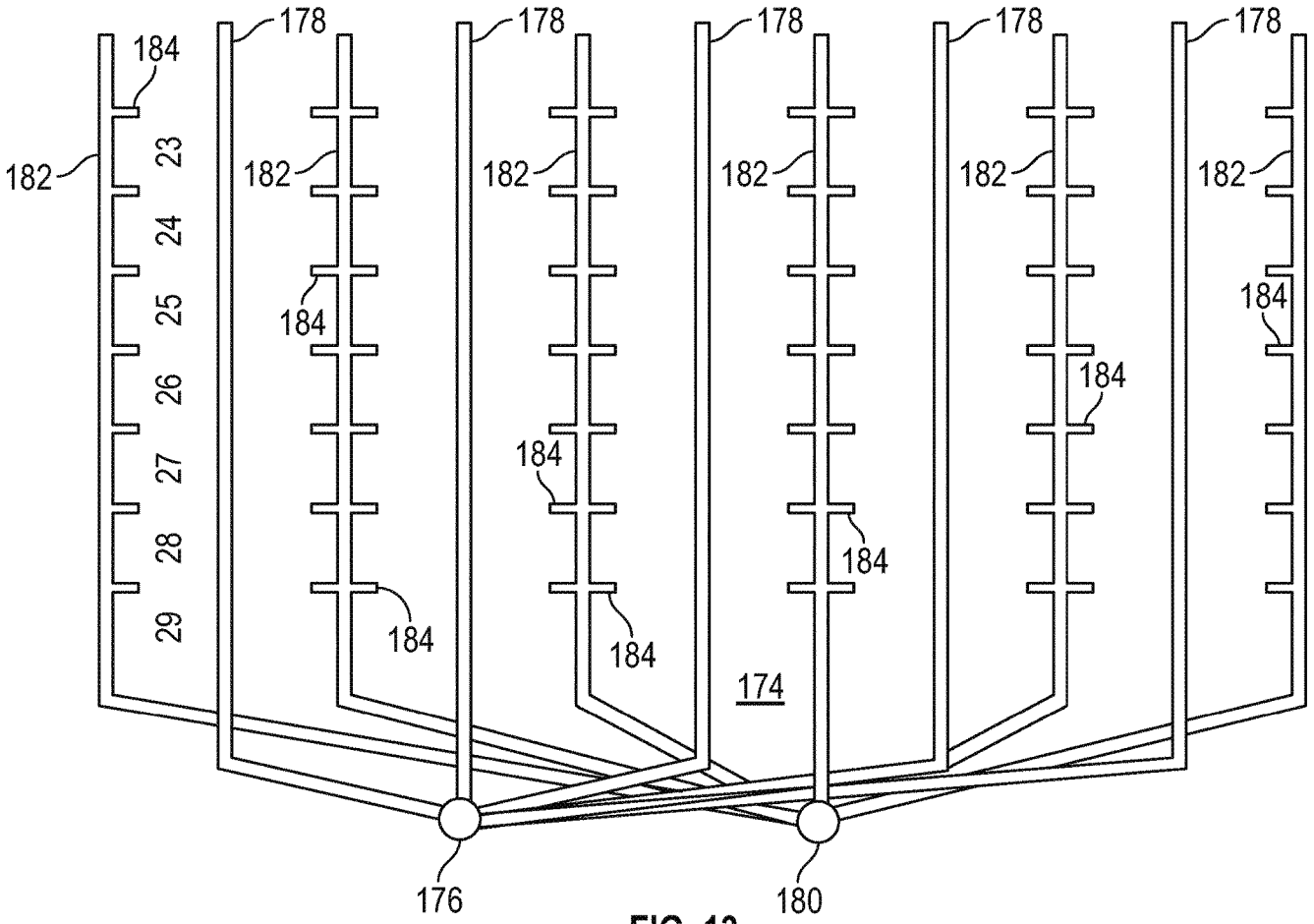
FIG. 13 is a top down, plan view of a subsurface volume schematically illustrating a primary well having five primary lateral wellbores extending therefrom and a diagnostic well having six diagnostic lateral wellbores extending therefrom in the same plane as the primary lateral wellbores in a lateral grid for dual-fracs.

FIG. 13 illustrates a top down, plan view of a subsurface volume 174 schematically illustrating a vertical primary well 176 having five primary lateral wellbores 178, numbered 1-5, extending therefrom and a vertical diagnostic well 180 having six diagnostic lateral wellbores 182 extending therefrom in the same plane as the primary lateral wellbores 178 in a lateral grid for diagnostic-based dual fracturing (where dual fracturing, or "dual-fracs" means a methodology of fracturing the same frac interval simultaneously from two or three adjacent laterals) in frac intervals 23-29. Each of the diagnostic lateral wellbores 182 has fracture interval outer laterals 184 extending into the subsurface volume 174 between each interval 23-29.

Dual fracturing, or dual-injection of frac systems, is injection from two or three adjacent laterals where treatment fluid and fracture networks approach and eventually interact with each other. The injection rates, type of fluid, viscosity of fluid, and stop-start staging of fluid injection may vary from the adjacent wellbores, with parameters and conditions varied to gain diagnostic-based insight of how the reservoir properties and fracture networks may be geometrically controlled and the frac interval reservoir area may be more optimally stimulated. That is, the size, amount, distribution and the like of the hydraulic fractures and related propped and non-propped conductivity generated within the frac interval. This significantly differs from "mono-bore" fracture stimulation methodology for learning how to optimize reservoir stimulated rock volume and related hydrocarbon productivity from geo-specific shales.

Figure 14:
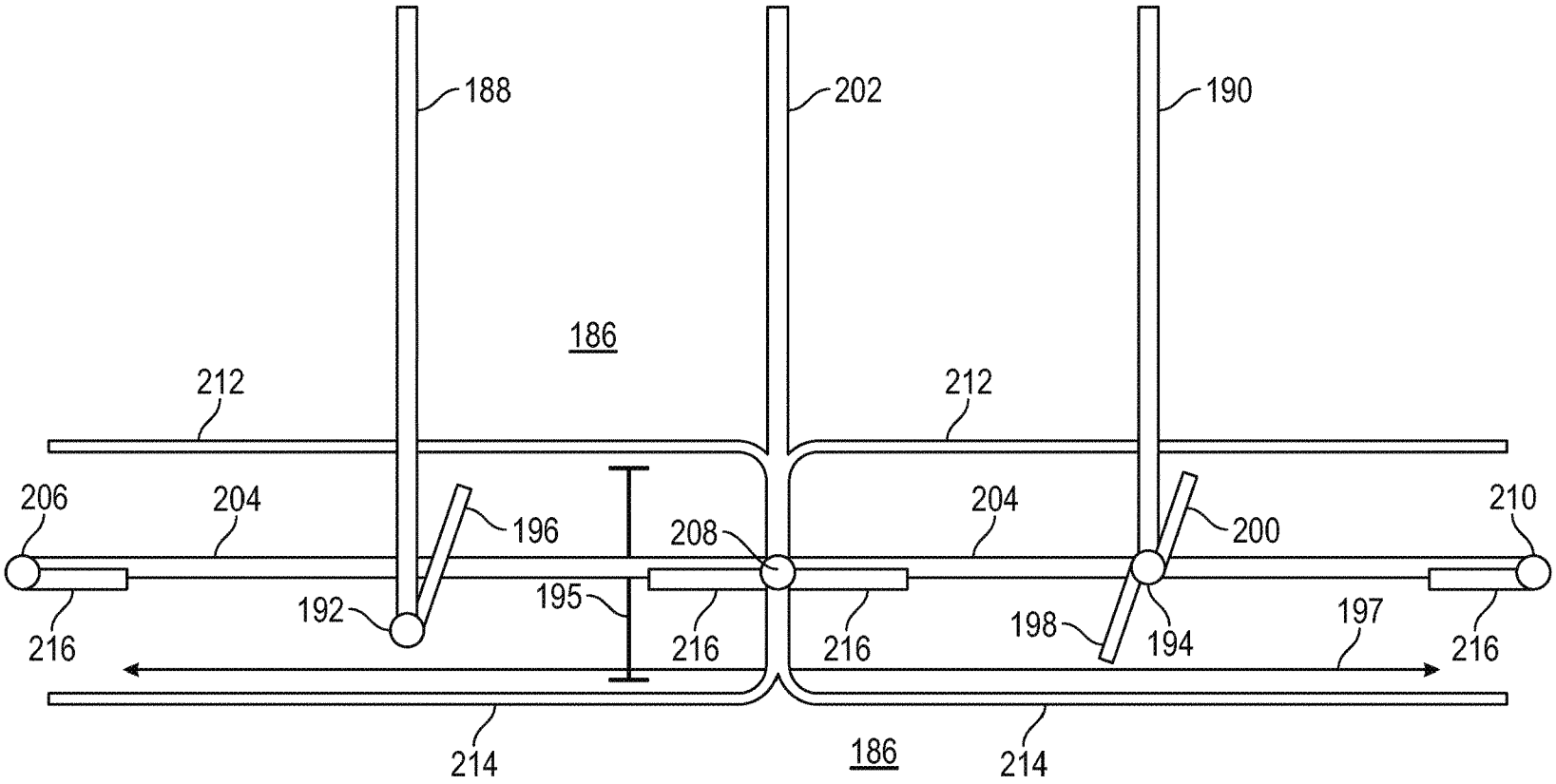
FIG. 14 is a schematic, horizontal sectional view of a subsurface volume illustrating two primary lateral wellbores, each with a primary lateral wellbore seen on end, where a diagnostic wellbore is between the primary wellbores, and from which extends three diagnostic lateral wellbore between and on either side of the primary lateral wellbores, also illustrating upper and lower imaging diagnostic lateral wellbores above and below the primary lateral wellbore, and showing across zone kick-off wellbores.

FIG. 14 schematically illustrates a horizontal sectional view of a subsurface volume 186 illustrating two vertical primary wells 188 and 190, each having a respective primary lateral wellbore 192 and 194 (viewed on end). Primary lateral wellbore 192 has across zone wellbore 196 extending upward therefrom. Across zone wellbore 196 may also be understood as a kickoff wellbore. Primary lateral wellbore 194 is relatively shallower than primary lateral wellbore 192 and has across zone wellbore 198 extending downward from primary lateral wellbore 194 and across zone wellbore 200 extending upward from primary lateral wellbore 194. The shale interval vertical variation is illustrated by limits 195, whereas the shale interval lateral variation is indicated in the direction of arrows 197. FIG. 14 also illustrates a vertical diagnostic well 202 from which extends a diagnostic lateral wellbore 204, which also has three parallel diagnostic lateral wellbores 206, 208 and 210 all in the same plane as each other, but which plane is above primary lateral wellbore 192 and at the same plane as primary lateral wellbore 194. Diagnostic lateral wellbore 208 is between primary lateral wellbores 192 and 194, and diagnostic lateral wellbore 206 is on the left side of the primary lateral wellbore 192 and diagnostic lateral wellbore 210 is on the right side of primary lateral wellbore 194. FIG. 14 also illustrates upper imaging diagnostic lateral wellbores 212 in a plane above primary lateral wellbores 192 and 194 and diagnostic lateral wellbores 206, 208 and 210 and lower imaging diagnostic lateral wellbores 214 below the plane of the primary lateral wellbores 192 and 194 and diagnostic lateral wellbores 206, 208 and 210. FIG. 14 also schematically illustrates relatively shorter diagnostic lateral wellbores 216; diagnostic lateral wellbores 206 and 208 have relatively shorter diagnostic lateral wellbores 216 extending toward primary lateral wellbore 192 and diagnostic lateral wellbores 208 and 210 have relatively shorter diagnostic lateral wellbores 216 extending toward primary lateral wellbore 194. It will be again be appreciated that there are a variety of places in the configuration of FIG. 14 where diagnostic devices may be placed to emit and/or detect signals to analyze at least one parameter of one or more of the primary lateral wellbores 192 and 194, across zone wellbores 196, 198 and 200, and the subsurface volume 186 around them. Such locations include, but are not limited to diagnostic lateral wellbores 204, 206, 208, and 210, upper imaging diagnostic lateral wellbores 212, lower imaging diagnostic lateral wellbores 214 and/or imaging diagnostic lateral wellbores 216.

There are a number of known imaging techniques that may be implemented in the methods and configurations for diagnosing subsurface volumes containing at least primary lateral wellbore, including, but not necessarily limited to the following.

A. R. Rahmani, et al. in "Crosswell Magnetic Sensing of Superparamagnetic Nanoparticles for Subsurface Applications," SPE 166140, *SPE Annual Technical Conference and Exhibition*, New Orleans, La., USA, 30 Sep.-2 Oct. 2013 discloses that stable dispersions of superparamagnetic nanoparticles are capable of flowing through micron-size pores across long distances in a reservoir having modest retention in rock. These particles can change the magnetic permeability of a flooded region, and thus may be used to enhance images of the flood. Propagation of a "ferrofluid slug" in a subsurface volume through primary lateral wellbores may have its response monitored by a crosswell magnetic tomography system as described in this paper. This approach to monitoring fluid movement within a reservoir is built on established electromagnetic (EM) conductivity monitoring techniques.

U.S. Pat. No. 8,253,417 to Baker Hughes Incorporated, incorporated herein by reference in its entirety, discloses an electrolocation apparatus useful for determining at least one dimension of at least one geological feature of an earthen formation from a subterranean well bore which includes at least two electric current transmitting electrodes and at least two sensing electrodes disposed in the well bore. The electric current transmitting electrodes are configured to create an electric field and the sensing electrodes are configured to detect perturbations in the electric field created by at least one target object. This electrolocation apparatus and method can approximate or determine at least one dimension of geological features such as hydraulic fractures.

S. Basu, et al., in "A New Method for Fracture Diagnostics Using Low Frequency Electromagnetic Induction," SPE 168606, *SPE Hydraulic Fracturing Technology Conference*, the Woodlands, Tex., USA, 4-6 Feb. 2014 discloses that at the time of the article, microseismic monitoring is widely used for fracture diagnosis. Since the method monitors the propagation of shear failure events, it is an indirect measure of the propped fracture geometry. The primary focus of the paper is in estimating the orientation and length of the "propped" fractures (in contrast to the created fractures), since this is the principal driver for well productivity. The paper presents a new Low Frequency Electromagnetic Induction (LFEI) method which has the potential to estimate not only the propped length, height and orientation of hydraulic fractures, but also the vertical distribution of proppant within the fracture. The proposed technique involves pumping electrically conductive proppant into the fracture and then using a specially built logging tool that measures the electromagnetic response of the formation. Results are presented for a proposed logging tool that consists of three sets of tri-directional transmitters and receivers at 6, 30 and 60 feet spacing, respectively (1.8, 9.1 and 18 m, respectively). The solution of Maxwell's equation shows that it is possible to use the tool to determine both the orientation and the length of the fracture by detecting the location of these particles in the formation after hydraulic fracturing. Results for extensive sensitivity analysis are presented to show the effect of different propped lengths, height and orientation of planar fractures in a shale formation. Multiple numerical simulations, using a leading edge electromagnetic simulator (FEKO), indicate that fractures up to 250 feet (76 m) in length, 0.2 inches (0.5 cm) wide and with a 45° of inclination may be detected and mapped with respect to the wellbore.

Figure 15:
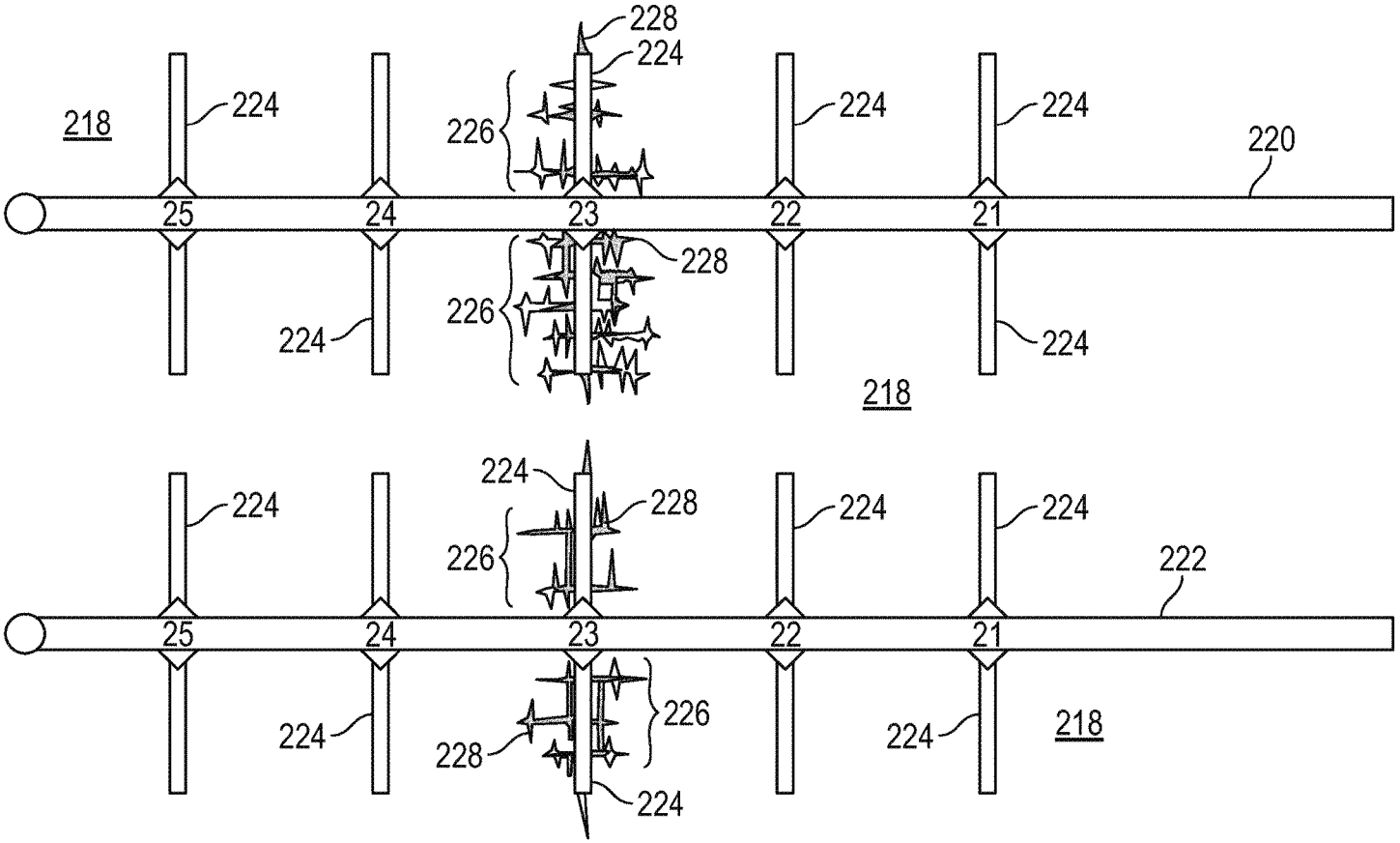
FIG. 15 is a top down, plan sectional view of a subsurface volume illustrating two parallel primary lateral wellbores and fracture plane oriented imaging diagnostic lateral wellbores extending perpendicularly therefrom.

Shown in FIG. 15 is a top down, plan sectional view of a subsurface volume 218 illustrating two parallel primary lateral wellbores 220 and 222, and fracture plane oriented imaging diagnostic lateral wellbores 224 extending perpendicularly therefrom in each of fracture intervals 21, 22, 23, 24, and 25. Complex fracture networks 226 are only shown for fracture interval 23 for simplicity of illustration, but it may be easily imagined that the other fracture intervals also have complex fracture networks 226, and the complex fracture network pattern and/or geometry of 226 can be highly variable and particular to the geo-specific shale geomechanical properties, diagnostic treatment parameters, and the like. Conductive proppant 228—illustrated as in the black-filled part of complex fracture network 226—would be injected into the complex fracture network 226. It will be understood that as a practical matter, it could not be expected that all of the complex fracture network 226 would be filled with conductive proppant 228. Electrolocation apparatus, such as those described above, would be placed in the fracture plane oriented diagnostic lateral wellbores 224 to measure the length, width and orientation of the fractures of complex fracture network 226 generated for the geo-specific rock and specific fracture treatment conditions. Thus, FIG. 15 is one of many possible configurations in which methods for diagnosing, including fracture development and/or proppant placement imaging, within subsurface volumes containing at least one primary lateral wellbore (e.g. 220 and/or 222) that is adjacent to at least one diagnostic lateral wellbore (224) may be practiced for understanding how to stimulate shale reservoirs, and geo-specific shales in particular. More specifically, a diagnostic device may be placed in fracture plane oriented diagnostic lateral wellbore 224 to emit at least one signal to subsurface volume 218, a received signal may be detected by the same or different diagnostic device, and the received signal may then be analyzed to ascertain or determine or measure at least one parameter of the at least one primary lateral wellbore 220 and/or 222 and/or the subsurface volume 218. In one non-limiting example, the FIG. 15 configuration may be used for imaging the dynamic placement and distribution of proppant within a geo-specific shale during a fracture treatment using select treatment parameters.

The methods and configurations of primary lateral wellbores and diagnostic lateral wellbores may take advantage of microseismic fracture mapping. For instance, R. Downie, et al. in "Utilization of Microseismic Event Source Parameters for the Calibration of Complex Hydraulic Fracture Models," SPE 163873, *SPE Hydraulic Fracturing Technology Conference*, the Woodlands, Tex., USA, 4-6 Feb. 2014, notes that observations of microseismic events detected during hydraulic fracturing treatments have provided an incentive to develop complex fracture models. Calibration of these models may be difficult when only the locations and times of the microseismic events are used. Incorporating the microseismic event source parameters into the model calibration workflow reveals changes in fracture behavior that are not easily visualized and provides additional guidance to the selection of modeling parameters. Microseismic events occur when deformation of the reservoir and surrounding formations produces seismic waveforms. Hodogram analysis and travel-time of the recorded waveforms are used to locate the microseismic event sources, while the amplitudes and polarities of the waveforms provide information about the deformation that has occurred. The geophysical property that is derived from the wave amplitudes is known as the seismic moment and is related to the area and displacement of the failure.

The relationship between seismic moment values and the deformations that produced microseismic events may be applied to engineering evaluations to identify variations in microseismic response. Use of this source parameter supplements commonly used visualizations of microseismic response where microseismic activity has been mapped. Mapping of the seismic moment distributions in a three-dimensional viewer provides insights into fracture behavior that can be used to calibrate complex hydraulic fracture models. This is done through an integrated software package that facilitates comparisons of the microseismic evaluation and complex fracture modeling outputs seamlessly. Changes to the complex fracture model inputs can be evaluated easily and quickly to determine if the fracture modeling correlates well with the measured microseismic responses. Production evaluation, history-matching and forward-modeling to test different completion and stimulation design scenarios can be undertake with improved confidence sing the calibrated fracture model. The complex fracture models of SPE 163873 may be improved by using the methods and configurations of at least one primary lateral wellbore adjacent at least one diagnostic lateral wellbore described herein.

The methods and configurations of at least one primary lateral wellbore adjacent at least one diagnostic lateral wellbore which are described herein may also find utility in induced acoustic wave fracture mapping or micro-imaging. "Micro-imaging" is defined herein as image data collected on the scale of a single fracture interval. This technique may use low-frequency high energy (LFHE) (also called low-frequency high intensity or LFHI) acoustic generators in one or more diagnostic lateral wellbore and an array of low-frequency sensors in one or more primary lateral wellbore. The use of sequential or alternate pulse, duration and frequency sweeps of acoustic generator signals (wave propagations) in the high to ultra-high resolution generator-rock-sensor configurations described herein provide greater data clarity and/or degree of resolution for real-time hydraulic fracture generation mapping during fracture treatments, and may give 2D and/or 3D graphic displays of complex fracture networks. The high resolution mapping of complex fracture network generation should provide empirical data of hydraulic fracture-natural fracture interactions for calibrating fracture and reservoir models for improving geo-specific shale stimulation and production.

One non-limiting way of how this may be accomplished is described by A. Bolshakov, et al. in "Deep Fracture Imaging Around the Wellbore Using Dipole Acoustic Logging," SPE 146769, SPE Annual Technical Conference and Exhibition, Denver, Colo., US, 30 Oct.-3 Nov. 2011, which discloses that characterizing fractures in reservoir rocks is important because they provide critical conduits for hydrocarbon production from the reservoir into the wellbore. The standard method uses shallow borehole imaging services, both acoustic and resistivity, which essentially look at the intersection of the fractures at the borehole wall. Cross-dipole technology has extended the depth of evaluation some 2-4 ft (0.6-1.2 m) around the borehole by measuring the fracture-induced azimuthal shear-wave anisotropy. A recently developed shear-wave reflection imaging technique provides a method for fracture characterization in a much larger volume around the borehole with a radial extent of approximately 60 ft (18.3 m). This technique uses a dipole acoustic tool to generate shear waves that radiate away from the borehole and strike a fracture surface. The tool also records the shear reflection from the fracture. The shear-wave reflection, particularly the SH waves polarizing parallel to the fracture surface, is especially sensitive to open fractures, enabling the fractures to be imaged using this dipole-shear reflection data. (SH waves are shear waves that are polarized so that its particle motion and direction of propagation are contained in a horizontal plane.) The authors used case examples to demonstrate the effectiveness of this shear-wave imaging technology that maps fractures up to 60 ft (18.3 m) away and even detects fractures that do not intercept the borehole.

Figure 16:
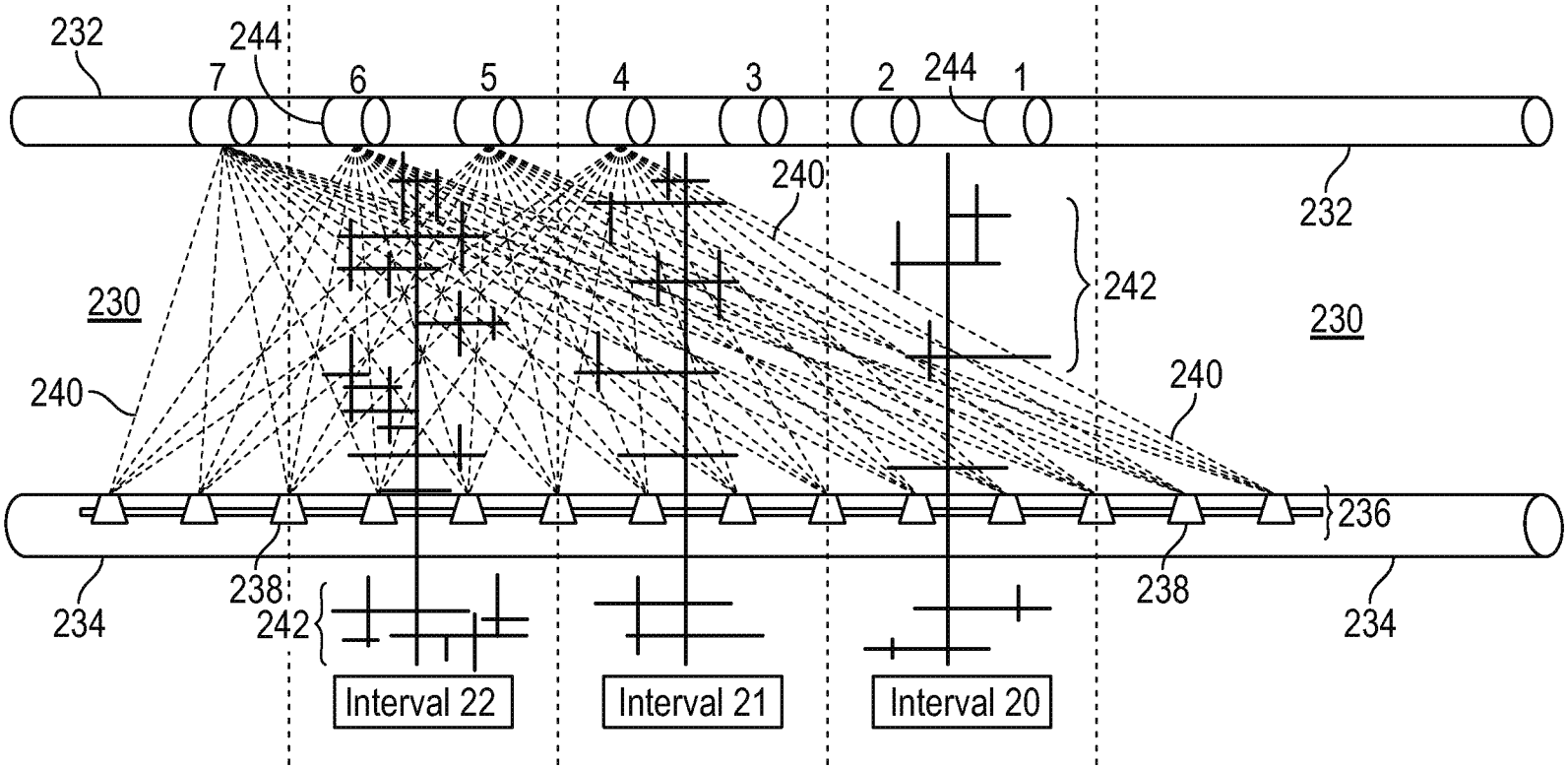
FIG. 16 is a schematic, cross-section of a subsurface volume showing a diagnostic lateral wellbore above and parallel to a primary lateral wellbore, where the diagnostic lateral wellbore has two low frequency, high energy (LFHE) acoustic generators per fracture interval and the primary lateral wellbore has an array of acoustic sensors therein schematically illustrating emitting and detecting signals.

FIG. 16 illustrates a top view schematic of induced acoustic wave fracture imaging of cross-section of a subsurface volume 230 showing a diagnostic lateral wellbore 232 horizontal and parallel to a primary lateral wellbore 234 adjacent to each other. Such adjacent relationships are described and/or schematically illustrated throughout the specification herein. The diagnostic lateral wellbore 232 has two low frequency, high energy (LFHE) acoustic generators 244 per fracture interval 20-22, which are numbered 1-7 in FIG. 16. It will be appreciated that other LFHE generators 244 for other fracture intervals may be readily envisioned and that only a few are shown in FIG. 16 for clarity. Further, the primary lateral wellbore 234 has an array 236 of acoustic sensors 238 therein schematically illustrating emitting and detecting signals 240 through complex fracture networks 242. LFHE acoustic generators 244 and acoustic sensors 238 are non-limiting examples of diagnostic devices suitable for use in the methods and configurations described herein. Changes in baseline signal 240 transit time to each sensor indicates the presence of a fracture, such as in complex fracture networks 242. Working with transit time angles of the signals 240 from each generator to each sensor can indicate fracture size, growth, branching and horizontal network geometry over time.

The acoustic waves generated will have relatively short distances to travel through the shale interval (as contrasted with conventional approaches using only adjacent substantially vertical wellbores) so that the signal type, intensity, amount of distortion and the like will encounter less rock minerals, pores, fluids, natural fractures and the like and thus provide improved information quality, particularly with the control of the intensity, duration, pulse timing, and the like, of the acoustic wave generators for acquiring baseline and changes to the reservoir and hydraulic fractures over time. In other words, the LHFE acoustic generators can be positioned in various diagnostic lateral wellbores with low frequency sensors in adjacent lateral wellbores to give better sampling measurements of the speed, reflection, refraction and the like of acoustic waves for better understanding of the localized shale interval properties and characteristics. The configurations of wellbores and methods described herein will also employ imaging technology that can measure how fractures propagate in specific shales, i.e. how they differ from one shale to another for a given set of treatment parameters. Shale reservoirs in general have differing physical, chemical and mechanical characteristics. How hydraulic fractures are generated and propagated in one shale reservoir to another will differ geographically, even under the same given set of hydraulic fracturing treatment parameters. Thus, the knowledge gained using the configurations and methods described herein can be important to learn how each shale reservoir should be hydraulically fractured for optimum fracture complexity, surface area generated, number of propped fractures, distribution of proppant, better understanding of fracture network conductivity generated, how to determine the select areas of the reservoir that show higher permeability and related criteria for determining the location of hydrocarbon sweet-spot horizons, and the like.

Figure 17:
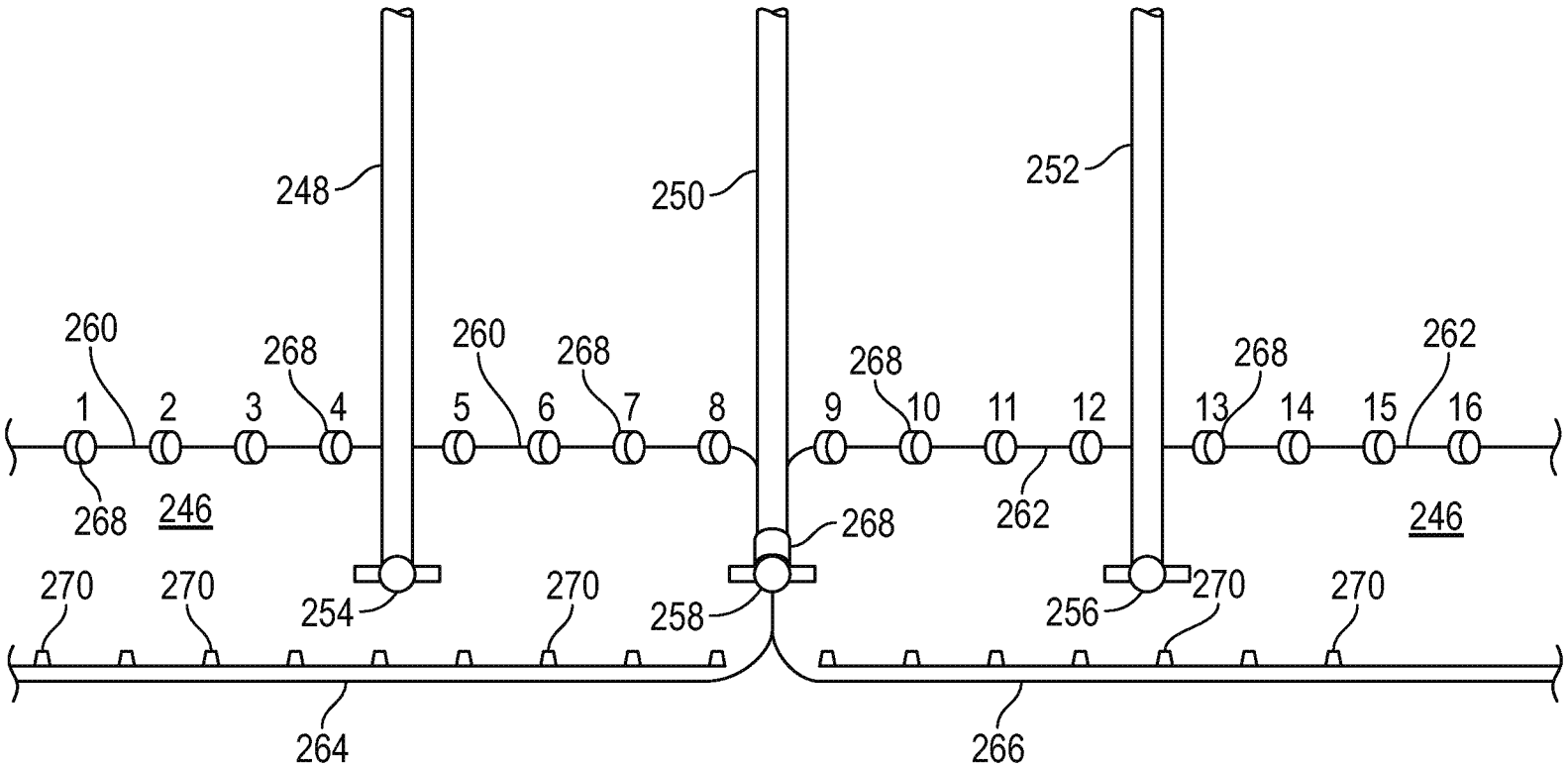
FIG. 17 is a schematic, horizontal cross section of a subsurface volume showing two primary lateral wellbores on either side with a diagnostic lateral wellbore in between (all three seen on-end), illustrating quad diagnostic imaging lateral wellbores, two above and two below the primary lateral wellbores on either side, with a plurality of acoustic generators placed in the upper diagnostic imaging lateral wellbores and a plurality of acoustic sensors placed in the lower diagnostic imaging lateral wellbores.

FIG. 17 is a schematic, horizontal cross section of a subsurface volume 246 showing left vertical primary wellbore 248 having a left primary lateral wellbore 254 and right vertical primary wellbore 252 having a right primary lateral wellbore 256. In between left vertical primary wellbore 248 and right vertical primary wellbore 252 is vertical diagnostic wellbore 250 having a diagnostic lateral wellbore 258. Left primary lateral wellbore 254, right primary lateral wellbore 256 and diagnostic lateral wellbore 258 are seen on end from the point of the viewer of FIG. 17. Left primary lateral wellbore 254, right primary lateral wellbore 256 and diagnostic lateral wellbore 258 are all in the same plane. Extending from diagnostic lateral wellbore 258 are upper imaging diagnostic lateral wellbores 260 and 262 which extend over left primary lateral wellbore 254 and right primary lateral wellbore 256, respectively, and lower imaging diagnostic lateral wellbores 264 and 266 which extend beneath left primary lateral wellbore 254 and right primary lateral wellbore 256, respectively.

Figure 18:
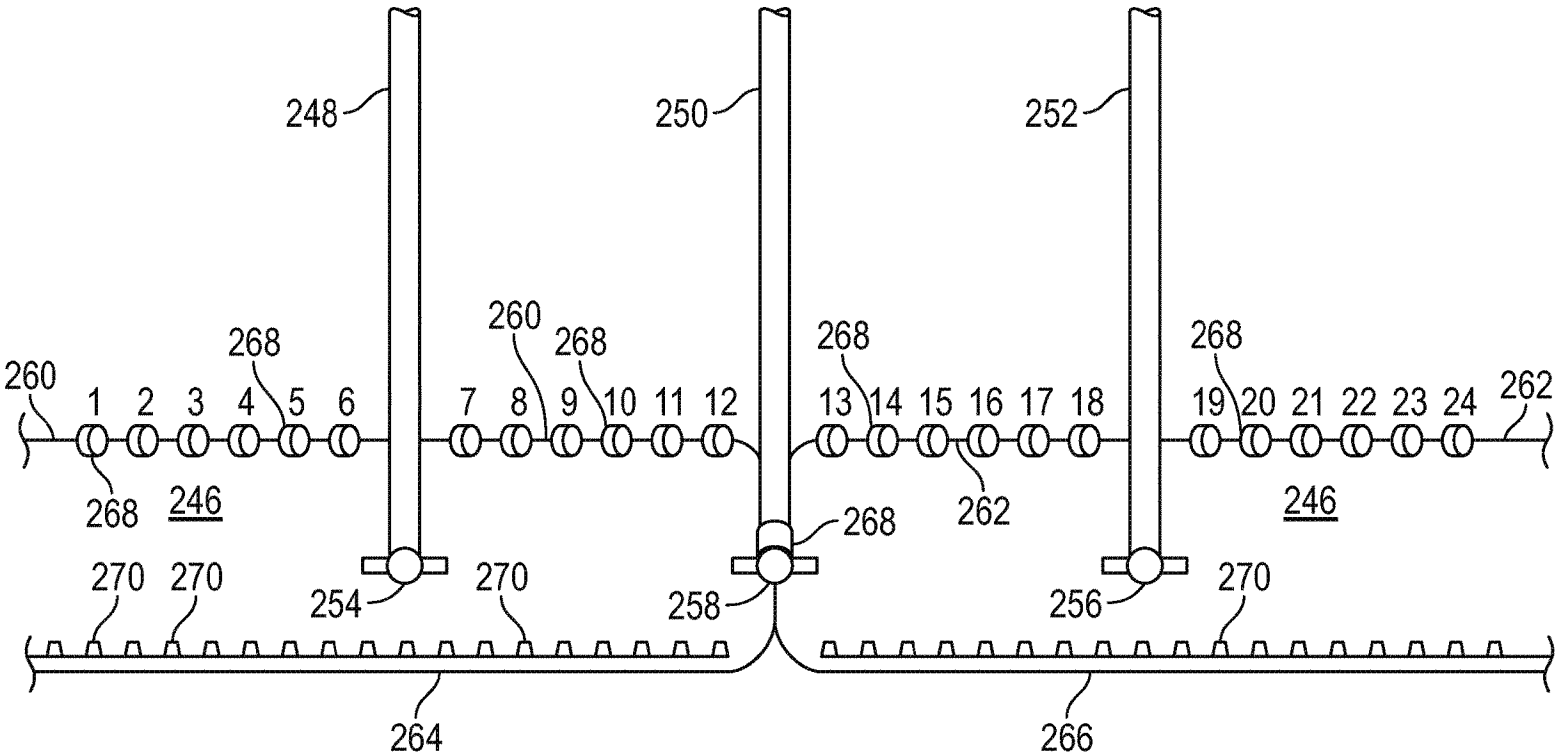
FIG. 18 is a schematic, horizontal cross section of the subsurface volume of FIG. 17 showing two primary lateral wellbores on either side with a diagnostic lateral wellbore in between (all three seen on-end), illustrating quad diagnostic imaging lateral wellbores, two above and two below the primary lateral wellbores on either side, with more acoustic generators placed in the upper diagnostic imaging lateral wellbores and more acoustic sensors placed in the lower diagnostic imaging lateral wellbores than illustrated in FIG. 17 indicating a configuration that can provide greater image resolution.

Within upper imaging diagnostic lateral wellbores 260 and 262 are a plurality of acoustic generators 268, numbered 1-16. Within lower imaging diagnostic lateral wellbores 264 and 266 are a plurality of acoustic sensors 270. Acoustic generators 268 and acoustic sensors 270 are non-limiting examples of diagnostic devices useful in the methods and configurations described herein. That is, although they are described as "acoustic", other signals instead of or in addition to acoustic signals may be used, emitted and detected. It should be noted that one or more acoustic generators 268 may be placed in diagnostic lateral wellbore 258 as schematically illustrated in FIGS. 17 and 18. Acoustic generators 268 may emit at least one signal received and detected by acoustic sensors 270, such as the schematically illustration of emitting and detecting signals through complex fracture networks schematically illustrated in FIG. 16 described and discussed above, which are implied but not shown in FIGS. 17 and 18.

FIG. 18 is a schematic, horizontal cross section of the subsurface volume 246 of FIG. 17, where the same reference numerals are shown for the same structures and/or components, showing two primary lateral wellbores 254, 256 on either side with a diagnostic lateral wellbore 258 in between (all three seen on-end), illustrating quad diagnostic imaging lateral wellbores 260, 262, 264 and 266, two (260 and 262) above and two (264 and 266) below the primary lateral wellbores 254 and 256 on either side, respectively, with more acoustic generators 268 placed in the upper diagnostic imaging lateral wellbores 260 and 262 and more acoustic sensors 270 placed in the lower diagnostic imaging lateral wellbores 264 and 266 than are illustrated in FIG. 17, which indicates a configuration that can provide greater image resolution due to the relatively greater number of acoustic generators 268 and acoustic sensors 270, and thus improved micro-imaging. For instance, in FIG. 18, acoustic generators 268 are numbered 1-24 in contrast to acoustic generators 1-16 shown in FIG. 17. FIGS. 17 and 18 together illustrate placement options of diagnostic devices within imaging diagnostic lateral wellbores, and many other suitable placement options may be imagined.

Figure 19:
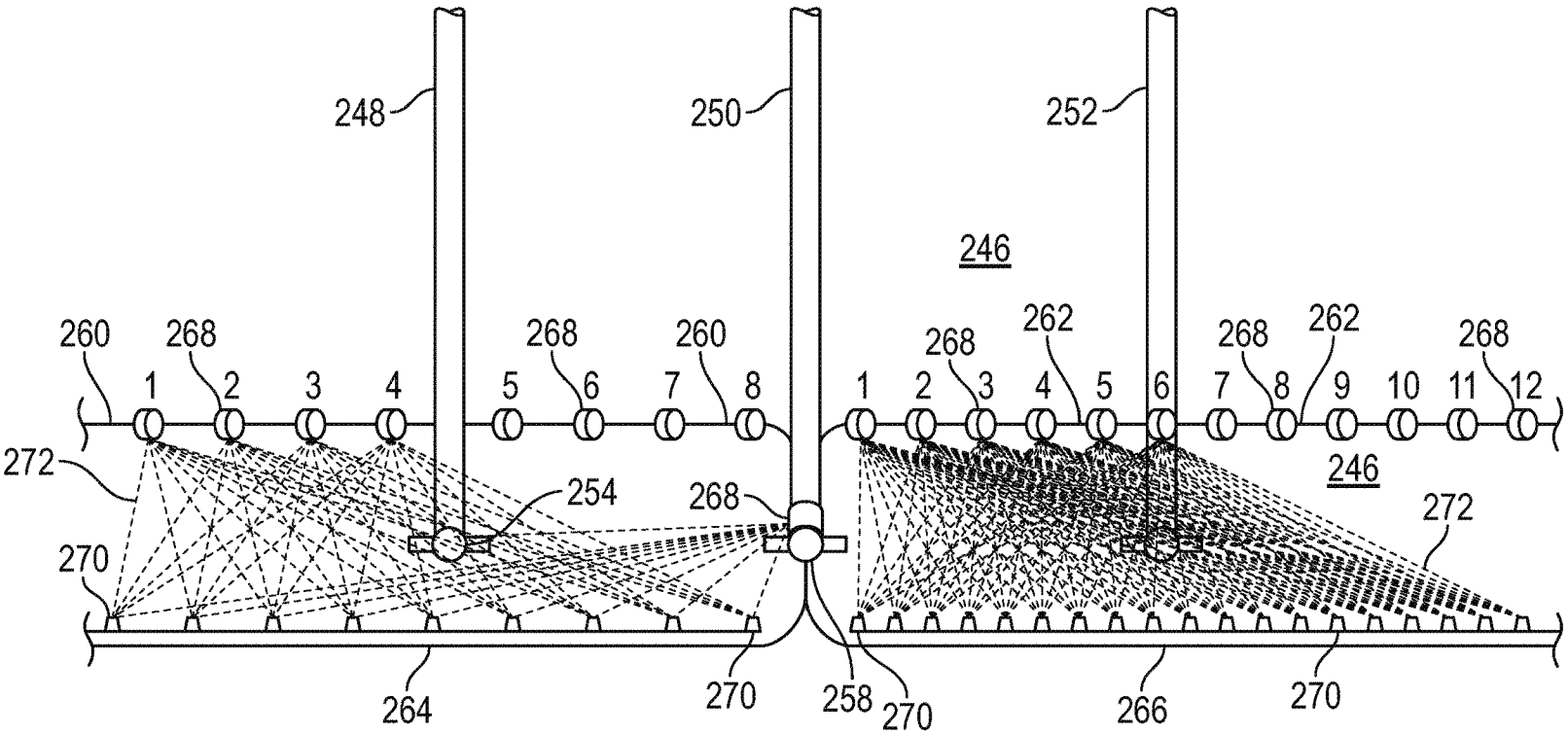
FIG. 19 is a schematic, sectional view of a subsurface volume showing two primary lateral wellbores on either side with a diagnostic lateral wellbore in between (all three seen on-end), illustrating quad diagnostic imaging lateral wellbores, two above and two below the primary lateral wellbores on either side, with more acoustic generators placed in the upper right and more acoustic sensors placed in the lower right diagnostic imaging lateral wellbores as compared with the number in the upper left and lower right diagnostic lateral wellbores, respectively, indicating a configuration that can provide greater image resolution.

FIG. 19 is a schematic, horizontal cross section of a subsurface volume 246 showing left vertical primary wellbore 248 having a left primary lateral wellbore 254 and right vertical primary wellbore 252 having a right primary lateral wellbore 256 (obscured by plurality of signals 272). In between left vertical primary wellbore 248 and right vertical primary wellbore 252 is vertical diagnostic wellbore 250 having a diagnostic lateral wellbore 258. Left primary lateral wellbore 254, right primary lateral wellbore 256 and diagnostic lateral wellbore 258 are seen on end from the point of the viewer of FIG. 19. Left primary lateral wellbore 254, right primary lateral wellbore 256, respectively, and diagnostic lateral wellbore 258 are all in the same substantially horizontal plane. Extending from diagnostic lateral wellbore 258 are upper imaging diagnostic lateral wellbores 260 and 262 which extend over left primary lateral wellbore 254 and right primary lateral wellbore 256 and lower imaging diagnostic lateral wellbores 264 and 266 which extend beneath left primary lateral wellbore 254 and right primary lateral wellbore 256, respectively.

Within upper imaging diagnostic lateral wellbore 260 are a plurality of acoustic generators 268, numbered 1-8. Within lower imaging diagnostic lateral wellbore 264 are a plurality of acoustic sensors 270 (nine in number). Within upper imaging diagnostic lateral wellbore 262 are a plurality of acoustic generators 268, numbered 1-12. Within lower imaging diagnostic lateral wellbore 266 are a plurality of acoustic sensors 270 (nineteen in number). Acoustic generators 268 and acoustic sensors 270 are non-limiting examples of diagnostic devices useful in the methods and configurations described herein. It should again be noted that one or more acoustic generators 268 may be placed in primary lateral wellbore 258 as schematically illustrated in FIG. 19. Acoustic generators 268 may emit at least one signal received and detected by each acoustic sensor 270, such as the schematic illustration of emitting and detecting signals 272 through complex fracture networks (not shown, but similar to those schematically illustrated in FIG. 16).

It will be appreciated that only about half of the signals 272 between the acoustic generators 268 in upper imaging diagnostic lateral wellbore 260 and the acoustic sensors 270 in lower imaging diagnostic lateral wellbore 264 are shown, and similarly, only about half of the signals 272 between the acoustic generators 268 in upper imaging diagnostic lateral wellbore 262 and the acoustic sensors 270 in lower imaging diagnostic lateral wellbore 264 are shown—this is for the sake of simplicity as it will be realized that showing all of signals 272 would unnecessarily obscure FIG. 19. The signals 272 not shown may be readily imagined. Nevertheless, what is dramatically shown in FIG. 19 is that when more acoustic generators 268 and acoustic sensors 270 are used, as shown in the right half of FIG. 19 in contrast with the left half, the acoustic imaging resolution of the quad laterals 262 and 266 may be greatly increased due to the greater number of signals 272 employed. Note how each acoustic generator 268 is detected by multiple acoustic sensors 270, and as one non-limiting example, each acoustic generator is pulsed in intensity, duration, frequency, and time-stamped in sequential series (such as pulsation of generator 1, then generator 2, then generator 3, etc.) for data collected by acoustic sensors 270 for pretreatment (i.e. baseline), during the treatment, and post treatment for characterizing, including, over time, dynamic growth of hydraulic fractures and related fracture networks, and rock stress alterations within interval 246 for determining and understanding how geo-specific shales respond to select treatment parameters and processes. To date, no diagnostic methodology for shale horizontal completions can provide this type and quality of information, as described in this non-limiting example of acoustic transmission, collection, and processing during and after diagnostic-based treatments. The degree of signal resolution within the treated interval is very important to obtaining data that can provide 2D and/or 3D visualization of developed hydraulic fracture networks, and the data needed in order to calibrate fracture models to have predictive skill for other treatments in the geo-specific shale area, that is, considerable acquired understanding (substantially increased learning rate) about how to develop optimized geometric fracture networks in geo-specific shales compared to past trial and error methodology of slow learning curve and sometimes years of extended treatment cost investment before learning how to properly stimulate and complete the targeted reservoir. One non-limiting example of elaborate investment costs and a significantly slow learning curve is recognized by the type of fracture treatment designs (materials, volumes, and processes) utilized in the Eagle Ford shale in 2008 versus in 2010 versus in 2014.

Figure 20:
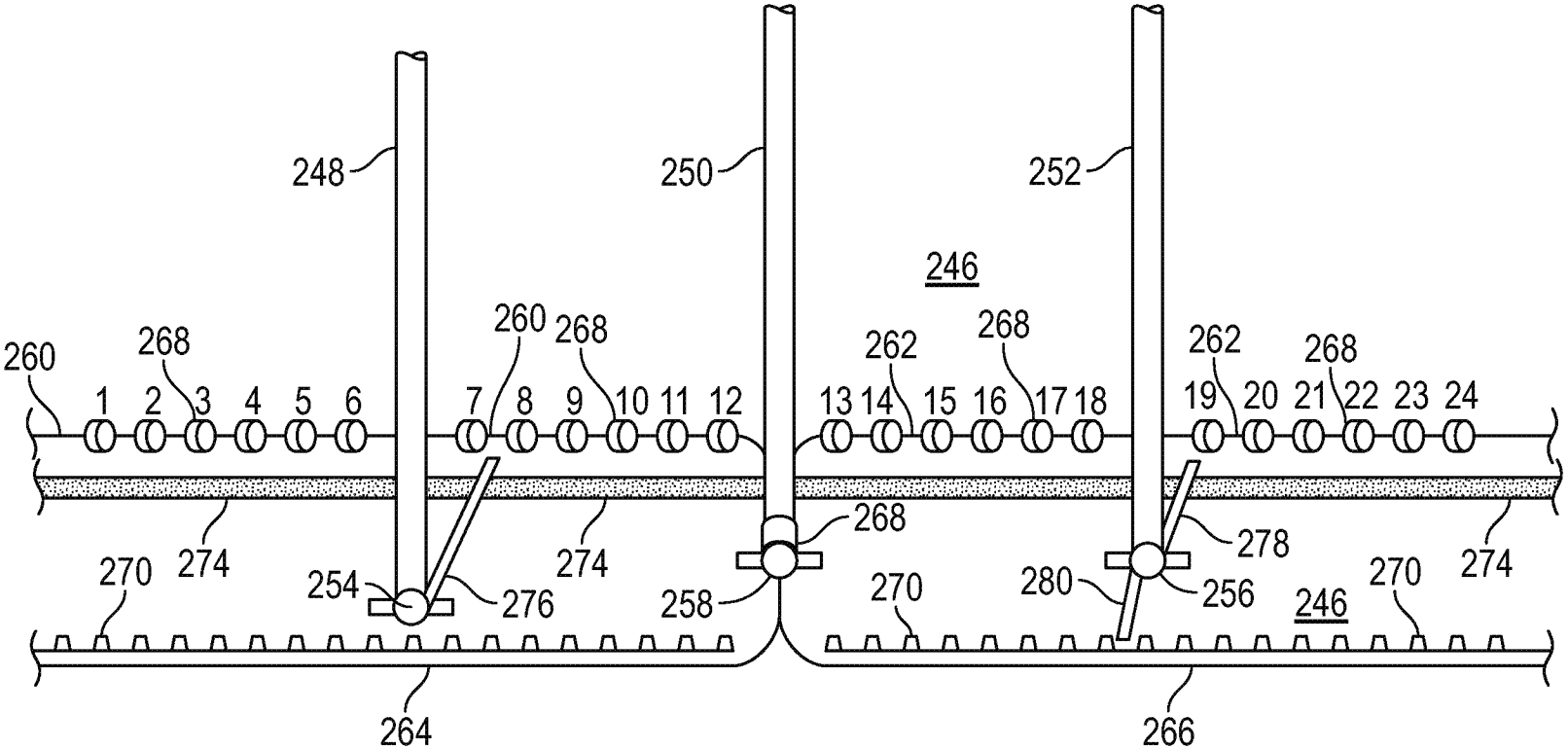
FIG. 20 is a schematic, sectional view of a subsurface volume showing two primary lateral wellbores on either side with a diagnostic lateral wellbore in between (all three seen on-end), illustrating quad diagnostic imaging lateral wellbores, two above and two below the primary lateral wellbores on either side, with acoustic generators placed in the upper diagnostic imaging lateral wellbores and acoustic sensors placed in the lower diagnostic imaging lateral wellbores, where a sweet-spot horizon within the subsurface volume is illustrated and kickoff wellbores from the primary lateral wellbore intersect the sweet-spot horizon.

FIG. 20 is a schematic, sectional view of a subsurface volume 246 showing two primary lateral wellbores 254' and 256 on the left and on the right, respectively, of a diagnostic lateral wellbore 258 (all three seen on-end). Note that while primary lateral wellbore 256 and diagnostic lateral wellbore 258 are in the same substantially horizontal plane, primary lateral wellbores 254' is in a horizontal plane below primary lateral wellbore 256 and diagnostic lateral wellbore 258. FIG. 20 further illustrates quad diagnostic imaging lateral wellbores 260, 262, 264, and 266, two above (260 and 262) and two below (264 and 266) the primary lateral wellbores 254' and 256 on either side, with acoustic generators 268 placed in the upper diagnostic imaging lateral wellbores 260 and 262 and acoustic sensors 270 placed in the lower diagnostic imaging lateral wellbores 264 and 266. FIG. 20 further illustrates a sweet-spot horizon 274 within the subsurface volume 246. Primary lateral wellbore 254' has a kickoff wellbore 276 extending upward from the primary lateral wellbore 254' which intersects the sweet-spot horizon 274. Primary lateral wellbore 256 has a kickoff wellbore 278 extending upward from the primary lateral wellbore 256 which intersects the sweet-spot horizon 274, and a kickoff wellbore 280 extending downward from the primary lateral wellbore 256 which does not intersect the sweet-spot horizon 274. The kickoffs can be open holes or casing-set completions with select and/or controlled distribution of perforations, sliding sleeves, and the like. FIG. 20 thus schematically illustrates how acoustic imaging arrayed between frac intervals can detect sweet-spot horizons using fracture imaging with acoustic generators 268 (numbered 1-24) and acoustic sensors 270, which are non-limiting examples of diagnostic devices suitable for use in the diagnostic configurations and methods described herein. It is expected that sweet-spot horizons may also be more quickly located using the configurations and methods described herein. For instance, the parameters of complex fracture networks extending from kickoff wellbores 276, 278, and 280 may also be ascertained. In one non-limiting example, if fracture growth initiates from primary lateral 254', the conventional fracture initiation practice, then in order to intersect upper sweet-spot 274 the fracture growth will need to proceed upwards in subsurface volume 246 over time before intersecting sweet-spot horizon 274, whereas by placement and injection into kickoff 276 wellbore the fracture growth may, in some cases (particularly when the sweet-spot horizon has greater permeability within subsurface volume 246) initiate and primarily grow within and along sweet-spot horizon 274 within the subsurface volume 246. Thus, the disclosed transmission, collection, and processing of acoustic signals from acoustic generators 268 and acoustic sensors 270 can help ascertain the location, size, and treatment factors for locating and understand best practices for stimulating the sweet-spot of the subsurface volume 246. The methodology illustrated in FIG. 20 can more quickly locate sweet-spots like 274 within geo-specific shale formations 246.

With respect to wildcat wells used to locate shale sweet-spots in new geologic or geo-specific shale plays, a significant amount of work and expense is put forth to find where and how to complete the shale interval with best success for economic return on investment (ROI). Most new play operators need to drill, stimulate and produce well over ten lateral wells to learn the minimum basics of shale geographic characteristics and suitable stimulation methods for best achieving an economic shale play. For this reason, operators need to acquire a suite of information in their initial field evaluation and development phases. Discussed herein are methods to help operators obtain important reservoir and stimulation technique information in a shorter period of time, which also reduces risks in knowing field and interval production potential. Diagnostic lateral wellbores can be used with imaging techniques and diagnostic-based treatments to generate important drilling and completion information for operators evaluating a new geo-specific shale play. For example, when drilling a vertical well to then further drill evaluation lateral wellbores, methods and techniques are proposed where the evaluation laterals do not need to be as long in length, and where one or more diagnostic lateral wellbores are drilled in various configurations adjacent to primary laterals for the purpose of acquiring important information at a faster rate about the reservoir interval and effectiveness of fracturing treatment parameters to generate complex fracture networks, sweet-spot horizon determination, requirements for fracture network cleanup, additional diagnostic information on lateral and vertical heterogeneity of shale rock lithology, petrophysical properties, geomechanical properties, natural fissure properties, hydraulic fracture-natural fracture interactions, methods to optimize natural fracture dilation and extension, best geo-specific practices for acquiring near-wellbore and far-field complex fracture networks, best geo-specific practices for selection and use of proppants for achieving transitional nano-to-micro-to-milli-to-macro darcy conductivity versus abrupt nano-to- and/or micro-to-macro darcy conductivity within the complex fracture network, and the like.

Figure 21B:
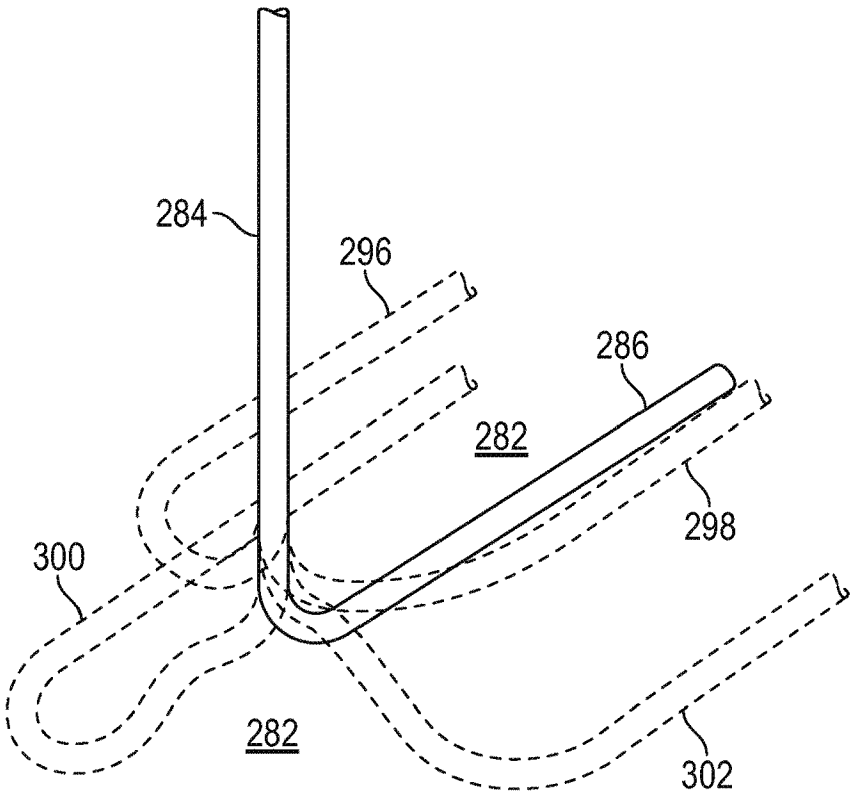
FIG. 21B is a schematic, three-quarters view of a subsurface volume showing a configuration for wildcat diagnostic lateral wellbore services with a vertical wellbore having a relatively shorter primary lateral wellbore extending therefrom, and further showing possible diagnostic lateral wellbores extending from the vertical wellbore on the top left of, on the top right of, on the lower left of, and on the lower right of the primary lateral wellbore and parallel to the primary lateral wellbore.
Figure 21A:
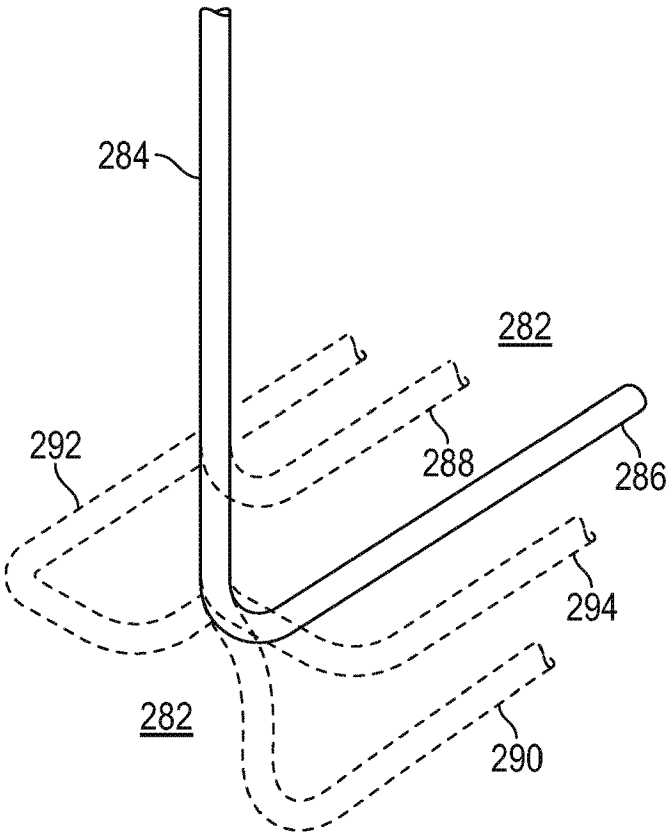
FIG. 21A is a schematic, three-quarters view of a subsurface volume showing a configuration for wildcat diagnostic lateral wellbore services with a vertical wellbore having a relatively shorter primary lateral wellbore extending therefrom, and further showing possible diagnostic lateral wellbores extending from the vertical wellbore above, below on the left side and on the right side of the primary lateral wellbore and parallel to the primary lateral wellbore.

Illustrated in FIG. 21A is a schematic, three-quarters view of a subsurface volume 282 showing a configuration for wildcat diagnostic lateral wellbores services with a vertical primary wellbore 284 having a relatively shorter primary lateral wellbore 286 extending therefrom. By "relatively shorter" is meant from about 200 feet (about 61 meters) independently to about 12,000 feet (about 3700 meters); alternatively from about 600 feet (about 183 meters) independently to about 2500 feet (about 762 meters). The FIG. 21A embodiment further shows a possible diagnostic lateral wellbore 288 extending from the vertical wellbore above the primary lateral wellbore 286, possible diagnostic lateral wellbore 290 below the primary lateral wellbore 286, possible diagnostic lateral wellbore 292 on the left side of the primary lateral wellbore 286, and possible diagnostic lateral wellbore 294 on the right side of the primary lateral wellbore 286. As shown in FIG. 21A, all of these potential diagnostic lateral wellbores are shown as substantially or generally parallel to the primary lateral wellbore 286, and are shown in dashed lines. The diameter of the diagnostic wellbores can be of any size, including coiled tubing drilled slim diameter wellbores. Additionally, the primary lateral and potential diagnostic lateral wellbores can be cased and/or openhole, including various combinations. In one non-limiting example, openhole casing packers with select location of ports, sliding sleeves, and/or removable perforations can be run in the hole during the wellbore completion process, including location of communication and/or signal generator and sensors at the surface before or as the casing is run in the primary and/or potential diagnostic lateral wellbores.

Illustrated in FIG. 21B is a schematic, three-quarters alternate view of a subsurface volume 282 showing another configuration for wildcat diagnostic lateral wellbores services with vertical wellbore 284 having a relatively shorter primary lateral wellbore 286 extending therefrom, and further showing a possible diagnostic lateral wellbore 296 extending from the vertical wellbore 284 on the top left of primary lateral wellbore 286, possible diagnostic lateral wellbore 298 on the top right of primary lateral wellbore 286, possible diagnostic lateral wellbore 300 on the lower left of primary lateral wellbore 286, and possible diagnostic lateral wellbore 302 on the lower right of the primary lateral wellbore 286. Potential diagnostic lateral wellbores 296, 298, 300, and 302 are shown as substantially or generally parallel to the primary lateral wellbore 286, and are shown in dashed lines. Like in FIG. 21A, the diameter of the diagnostic wellbores illustrated in FIG. 21B can be of any diameter, including coiled tubing drilled slim diameter wellbores. Additionally, the primary lateral and potential diagnostic lateral wellbores illustrated in FIG. 21B can be cased and/or openhole, including various combinations thereof. In one non-limiting example, openhole casing packers with select location of ports, sliding sleeves, and/or removable perforation plugs can be run in the hole during the wellbore completion process, including location of signal transmission and/or signal generator and sensors at the surface before or as the casing is run into one or more of the primary and potential diagnostic lateral wellbores.

It will be appreciated that diagnostic devices, including but not necessarily limited to, acoustic generators and acoustic sensors may be placed in diagnostic lateral wellbores 288, 290, 292, 294, 296, 298, 300, and/or 302 and/or relatively shorter primary lateral wellbore 286 to analyze one or more parameter to ascertain at least one parameter of relatively shorter primary lateral wellbore 286 and the subsurface volume 282 around it, including, but not limited to, whole and/or stratified lithology parameters of subsurface volume 282, a hydraulic fracture treatment or treatments of induced complex fracture network(s) adjacent relatively shorter primary lateral wellbore 286. These parameters can provide more precise information about how to find and recover hydrocarbons, that is, the best geo-specific hydraulic fracturing process for generating near-wellbore and/or far-field complex fracture networks, the best geo-specific treatment fluid recovery process, the best or better understanding of differences of geo-specific wellbore completion options and processes (i.e. the amount and distance a part of sliding sleeves and/or perforation clusters, the size of frac interval and number of perforation clusters, the effectiveness of multi-cluster breakdown and hydraulic fracture stimulation of geo-specific shale), and the like from subsurface volume 282. Combination of the methods described herein with known diagnostic tools and measurements, such as fiber optic sensing technologies like Distributed Temperature Sensing (DTS) and Diagnostic Acoustic Sensing (DAS), microseismic, wellbore and reservoir logging tools, and the like can improve the amount and accuracy of knowledge gained during the wildcat drilling, completion, and production process.

Figure 22:
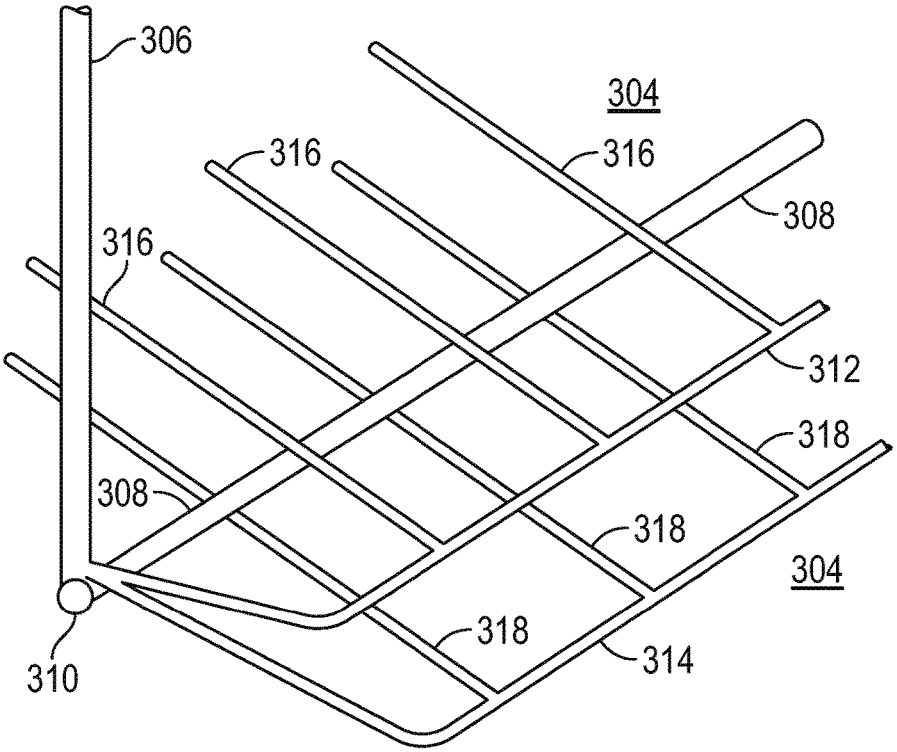
FIG. 22 is a schematic, three-quarters view of a subsurface volume showing a configuration for wildcat diagnostic lateral wellbore services with a vertical wellbore having a relatively shorter diagnostic lateral wellbore extending therefrom, and further showing a top right diagnostic lateral wellbore and a lower right diagnostic lateral wellbore extending from the vertical wellbore parallel to the relatively shorter diagnostic lateral wellbore, and having upper and lower imaging diagnostic lateral wellbore extending perpendicular therefrom, respectively, over the shorter diagnostic lateral wellbore.

FIG. 22 is a schematic, three-quarters view of a subsurface volume 304 showing a configuration for wildcat diagnostic lateral wellbores services with a vertical wellbore 306 having a relatively shorter primary lateral wellbore 308 extending from the heel 310 thereof, and further showing an upper right diagnostic lateral wellbore 312 and a lower right diagnostic lateral wellbore 314 extending from, in this non-limiting illustration, above the heel 310 of vertical wellbore 306 parallel to the relatively shorter primary lateral wellbore 308. Upper right diagnostic lateral wellbore 312 has a plurality of upper imaging diagnostic lateral wellbores 316 extending perpendicular therefrom over the relatively shorter primary lateral wellbore 308. Lower right diagnostic lateral wellbore 314 has a plurality of lower imaging diagnostic lateral wellbores 318 extending perpendicular therefrom under the relatively shorter primary lateral wellbore 308.

Figure 23:
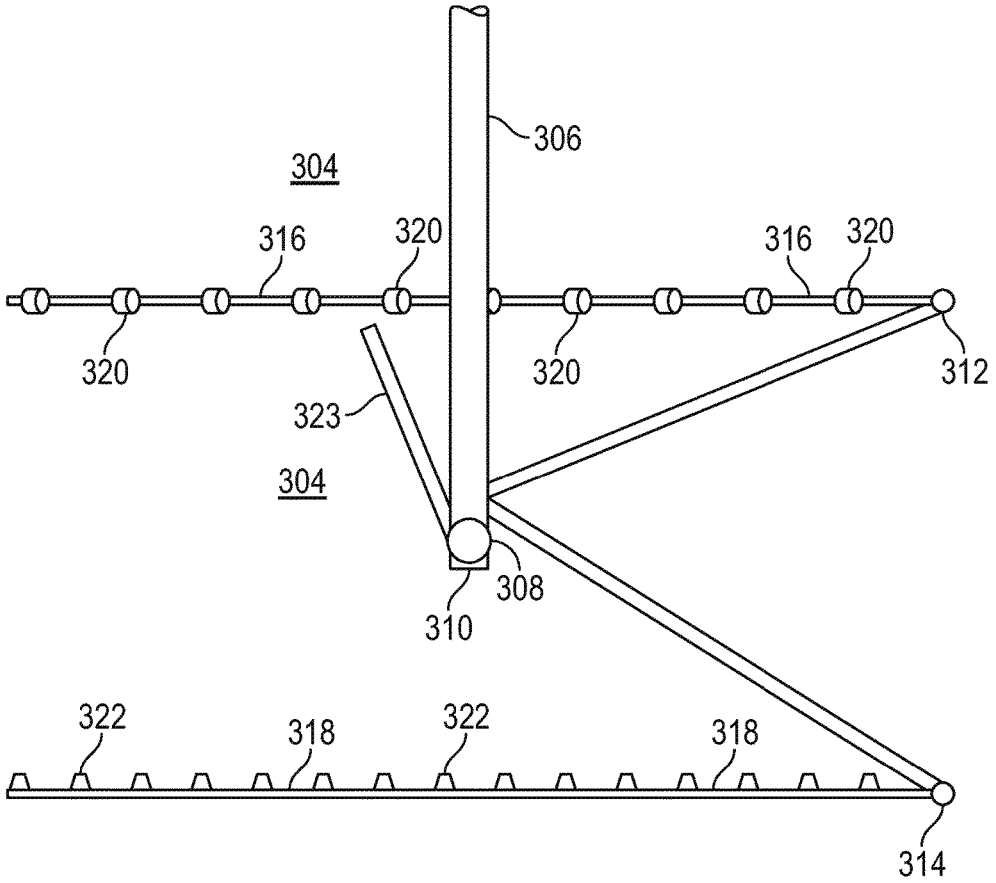
FIG. 23 is a schematic, profile, section view of the subsurface volume of FIG. 22 showing a diagnostic vertical wellbore having a first diagnostic lateral wellbore extending therefrom (seen on end), and a top right second diagnostic lateral wellbore and a lower right third diagnostic lateral wellbore (also seen on end), having an upper imaging lateral wellbore and a lower imaging lateral wellbore, respectively, extending to the left and above and below the first diagnostic lateral wellbore; illustrating acoustic generators in the upper imaging lateral wellbore and acoustic sensors in the lower imaging lateral wellbore.

It will be understood that diagnostic devices, including but not necessarily limited to, acoustic generators and acoustic sensors may be placed in diagnostic lateral wellbores 312 and 314, and/or upper imaging lateral wellbores 316 and/or lower imaging lateral wellbores 318 and/or relatively shorter primary lateral wellbore 308 to analyze one or more parameter to ascertain at least one parameter of fracture treatments performed from relatively shorter primary diagnostic wellbore 308 and the subsurface volume 304 around it, including, but not limited to, a complex fracture network adjacent relatively shorter primary lateral wellbore 308. In a non-limiting example, FIG. 23 is a schematic, profile, section view of the subsurface volume 304 of FIG. 22 (however, differs by the inclusion of one or more kick-off wellbore 323) illustrating a plurality of acoustic generators 320 in upper imaging diagnostic lateral wellbores 316 and a plurality of acoustic sensors 322 in lower imaging diagnostic lateral wellbores 318. The acoustic generators 320 and acoustic sensors 322 can thus emit signals between and through the subsurface volume 304 and the received signals detected by acoustic sensors 322, covering a large amount of subsurface volume 304. The ascertained parameters can provide more precise information about how to find and recover hydrocarbons from subsurface volume 304.

FIG. 23 further illustrates kick-off wellbore 323 extending from primary lateral wellbore 308, which wellbore 323 may cross through multiple shale horizons. It is not shown, but in most cases there can be more than one kick-off wellbore 323 specifically placed along primary lateral wellbore 308. Data, images, and other parameters may be ascertained using the acoustic generators 320 and acoustic sensors 322 or other diagnostic devices from the subsurface volume 304 around wellbore 323 to determine what it has intersected, e.g. a sweet-spot horizon, where stimulation breakdown and fracture initiation and growth originates from, and the like. Additionally, with this illustration and others that are similar (such as FIGS. 12, 14, 17, 18, 20, 22, etc.), by having acoustic generators in the top diagnostic lateral wellbore, as in FIG. 23 wellbore 316, there can be alternating (i.e. such as every other upper diagnostic lateral wellbore) acoustic generators in one upper diagnostic lateral wellbore and acoustic sensors in the next upper diagnostic lateral wellbore, that is, additional or more reservoir area 304 can be examined and more acoustic generators 320 transmission signals detected by acoustic sensors 322 by every other upper diagnostic lateral wellbore 316 having acoustic generators 320 followed by acoustic sensors 322. Likewise, alternating diagnostic lateral wellbores 316, one having acoustic generators 320 and the other diagnostic lateral wellbore 318 having acoustic sensors, may be configured using the lower diagnostic laterals 318, where then the upper diagnostic lateral wellbores 316 each consist of acoustic sensors 322 for data collection. In other words, the locations of acoustic generators and/or acoustic sensors are not limited to any particular embodiment illustrated or described herein.

Figure 24:
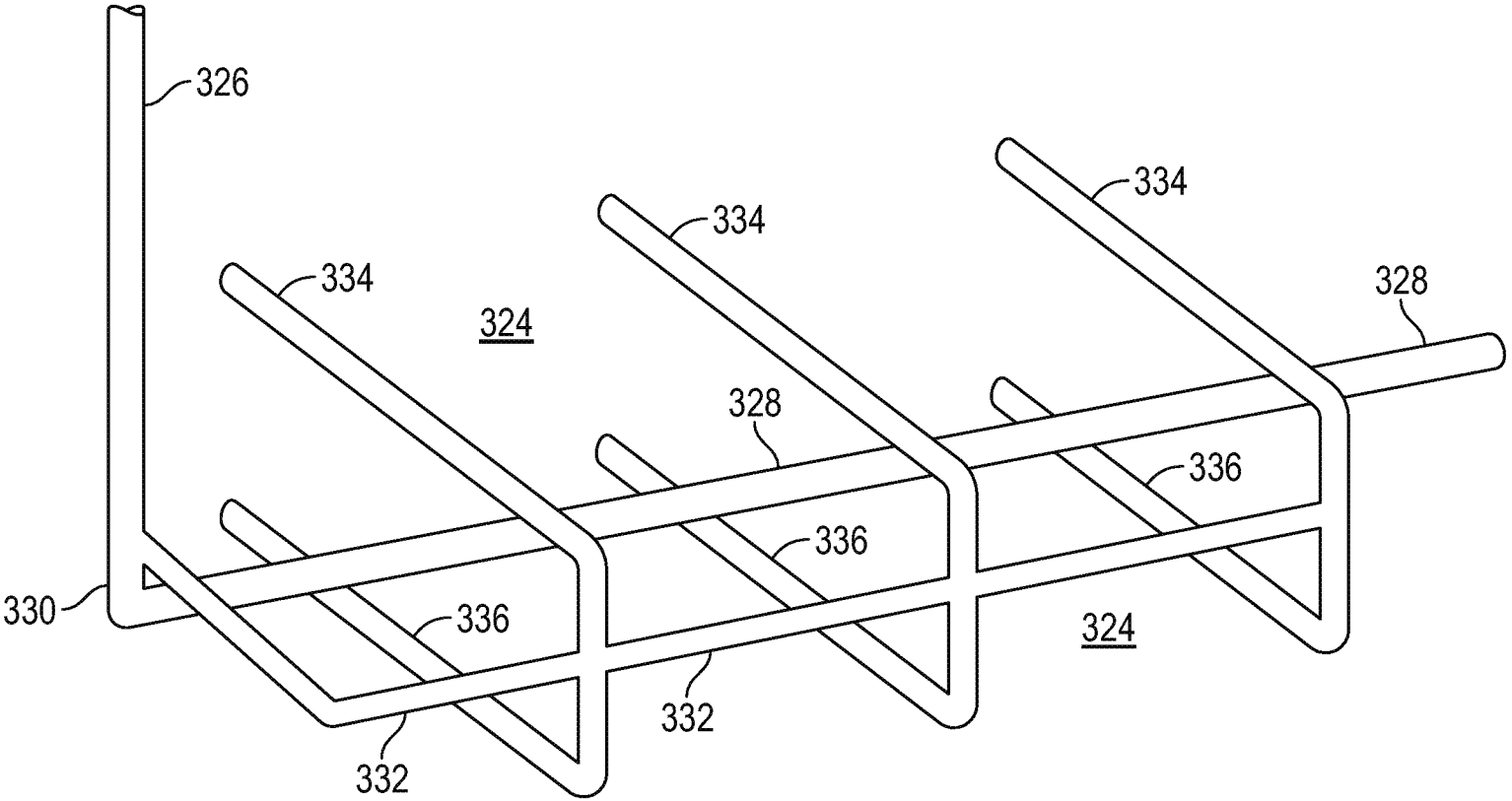
FIG. 24 is a schematic, three-quarters view of a subsurface volume showing a wildcat diagnostic well service configuration illustrating a diagnostic vertical wellbore and a relatively shorter diagnostic lateral wellbore extending therefrom, along with a right diagnostic lateral wellbore having upper imaging lateral wellbores and lower imaging lateral wellbores extending therefrom over and under the relatively shorter diagnostic lateral wellbore.
Figure 25:
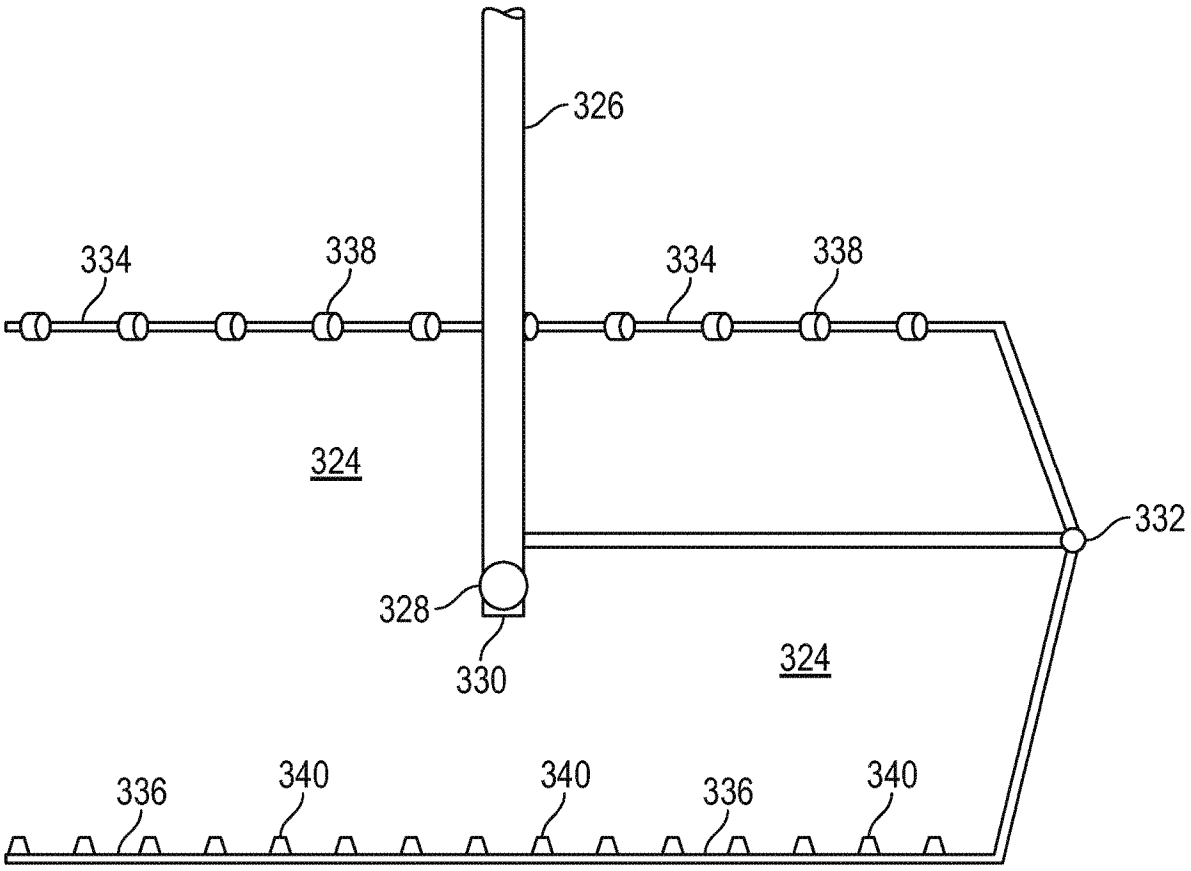
FIG. 25 is a schematic, profile, horizontal sectional view of the subsurface volume of FIG. 24 showing a wildcat diagnostic well service configuration illustrating a diagnostic vertical wellbore and a relatively shorter diagnostic lateral wellbore extending therefrom (see on end), along with a right diagnostic lateral wellbore having an upper imaging lateral wellbore and a lower imaging lateral wellbore extending therefrom over and under the relatively shorter diagnostic lateral wellbore showing acoustic generators in the upper imaging lateral wellbores and acoustic sensors in the lower imaging lateral wellbore.

FIG. 24 presents a schematic, three-quarters view of a subsurface volume 324 showing another non-limiting embodiment of a wildcat diagnostic well service configuration illustrating a diagnostic vertical wellbore 326 and a relatively shorter diagnostic lateral wellbore 328 extending therefrom at heel 330, along with a right diagnostic lateral wellbore 332 extending from vertical wellbore 326 just above heel 330. Unlike upper right and lower right diagnostic lateral wellbores 316 and 318, respectively, of FIGS. 22 and 23, right diagnostic lateral wellbore 332 has both upper imaging lateral wellbores 334 and lower imaging lateral wellbores 336 extending therefrom over and under, respectively, the relatively shorter diagnostic lateral wellbore 328. FIG. 25 presents a schematic, profile, horizontal sectional view of the subsurface volume 324 of FIG. 24 schematically illustrating a plurality of acoustic generators 338 arrayed in upper imaging lateral wellbores 334 and a plurality of acoustic sensors 340 position in lower imaging lateral wellbores 336. Again, the acoustic generators 338 and acoustic sensors 340 can thus emit signals between and through the subsurface volume 324 and the received signals detected by acoustic sensors 340, covering a large amount of subsurface volume 324. The ascertained parameters can provide more precise information about how to find and recover hydrocarbons from subsurface volume 324. Like with other lateral wellbores in the other Figures, the primary and more particularly the diagnostic lateral wellbores may be coiled tubing drilled slimholes, as non-limiting examples of singular and/or combinations of drilling and completions of lateral wellbores illustrated and disclosed herein.

It should be appreciated that the methods and configurations of at least one diagnostic lateral wellbore with at least one primary lateral wellbore may be used to evaluate stress shadow effects on fracture propagation direction and complexity. A "stress shadow" may be defined as a region or area on either side of a primary lateral wellbore formed by pressure injection. This stresses the rock in a lateral direction to provide more control in fracturing the shale. For bi-direction fracturing treatments, there is provided a number of control methods of region, timing, interaction, and the like stress shadow utility and/or control options, in one non-limiting embodiment, the fracturing from the primary lateral wellbore may be initiated first and then stopped, followed by pumping from a diagnostic lateral wellbore and/or a parallel assisting lateral wellbores in one or more cycles, rather than simultaneously. In one non-limiting embodiment this kind of stop/start-low viscosity/high viscosity staged diversion process may be used to create complex fractures. That is, pumping a relatively low viscosity fracturing fluid, stopping the pressure, then pumping a relatively high viscosity fracturing fluid may be used alternatingly or in cycles to create complex fracture networks. Imaging and/or diagnostic devices can be arranged to capture the directions, propagations, and complexity of hydraulic fractures during the fracturing treatment, from only the primary lateral wellbore or by bi-directional fracturing treatments, in contrast to prior fracturing treatments where the fracture pressure and rock stresses have been retained. The diagnostic method may be used to steer the fracturing treatment away from a neighboring interval that might have retained fracture pressure.

One simple technique to evaluate stress shadowing is as follows: a) with two isolated frac intervals, perform a frac treatment on one and retain the treatment pressure; follow then by fracturing the adjacent (e.g. the left side) interval and image the fracture propagation and complexity; b) do the same as at a) above, but follow the first frac treatment with a frac treatment to the other side (e.g. the right side), and image the fracture propagation and complexity. Compare the a) and b) fracture geometry to see if the stress shadow causes fracture propagation to curve or deviate away. Other, more complex techniques can be performed including, but not necessarily limited to, pressurizing a diagnostic lateral wellbore in the frac interval parallel to the primary lateral wellbore to determine how front-placement stress shadow influences fracture growth, direction and complexity.

In another non-limiting embodiment, at least one diagnostic lateral wellbore in close proximity to hydraulic fractures or extending from at least one primary lateral wellbore along the fracture plane can help determine idea locations for high resolution use of several imaging devices and techniques including LFHI, acoustic imaging, electrolocation imaging and noisy particle imaging techniques and materials which can be used to determine placement of proppants in complex fracture networks during and after a fracture treatment, such as during closure on glass beads or other proppants, as one non-limiting example. The ability to image proppant distribution will allow evaluation of the importance of proppant size for placement within narrow fractures and complex fracture network regions in the treated intervals. With the use of diagnostic lateral wellbores improved fracture imaging technology can evaluate conventional and new proppant suspension agents. Suspension agents are used to help prevent or inhibit proppant sedimentation and settling prior to fracture closure. In a non-limiting example, one or more diagnostic lateral wellbore may be used to acquire an image of a particular fracture network at initial distribution and then during and/or after sedimentation of the proppant. Structural, compositional, and/or concentration changes can then be made to the anti-settling agent, density of the proppant, and the like, and continued evaluation of product performance may be made using information generated by the proppant imaging capability. Indeed, many types of conventional and future technologies may be evaluated under field conditions by operators using at least one diagnostic lateral wellbore adjacent to at least one primary lateral wellbore and/or another diagnostic lateral wellbore. That is, there have been major limitations in the ability to accurately, comprehensively and geometrically evaluate the performance of new technology. The ability to differentiate the effectiveness of one technology from another is of significant economic importance for developing and advancing technology for shale completions in the future.

For example, in a four interval series of hydraulic frac treatments where electrolocation devices are placed perpendicularly to the diagnostic lateral wellbore and in the middle of each fracture interval, by using the same frac treatment design and only varying the size and amount of conductive-material coated proppant used in each interval, such as 2 ppa of 30/70 mesh (595/210 microns) in the first interval (i.e. pounds of proppant added to each one gallon volume of treatment fluid), 2 ppa of 150 mesh (112 microns) in the second interval, 4 ppa of 200 mesh (74 microns) in the third interval, and 4 ppa of 1.1 specific gravity 200 mesh proppant material in the fourth interval, measurement of electrolocation signals from each of the zones during and after the frac treatments can be performed to see how proppant size-fracture width influence proppant distribution. The proppant distribution tests will also provide criteria about proppant setting within various fracture widths. Additional evaluation tests could be performed with and without proppant "anti-settling agents" for more accurate determination of performance of these agents. The abbreviation "ppa" refers to pounds of proppant added to one gallon of fluid volume.

Figure 27A:
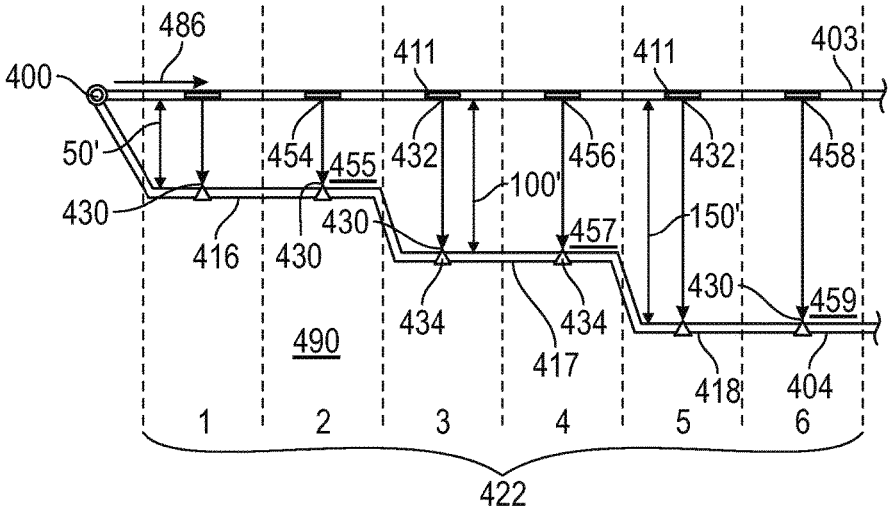
FIG. 27*a* is a schematic plan sectional view of a primary lateral wellbore and a diagnostic lateral wellbore in a parallel configuration to the primary lateral wellbore that may be used to determine fracture hit time.

FIG. 27*a* presents a schematic, top view of diagnostic lateral wellbore 404 with non-limiting illustration of parallel configuration sections at three non-limiting distances from the primary lateral wellbore 403, both in this non-limiting example from vertical wellbore 400; with diagnostic lateral wellbore 404 having parallel section 416 at distance of 50 feet (15.2 m), parallel section 417 at distance of 100 feet (30.5 m), and parallel section 418 at distance of 150 feet (45.7 m). Further illustrated are two frac intervals shown for each parallel lateral wellbore section 416 (intervals 1 and 2), 417 (intervals 3 and 4) and 418 (intervals 5 and 6), for a total of six frac intervals 422 (1-6). Diagnostic injection tests are performed at each of the six frac interval for learning at least one or more parameter(s) about hydraulic fracture treatment interaction with geo-specific shale reservoir 490, including but not limited to, fracture hit time tests for determining the fracture complexity storage modulus, that is, the fracture hit time being the pump time and treatment fluid volume pumped from injection points or sliding sleeves 411 (or the like) to pressure sensors 434, for the time and volume required when pressure is first indicated, and the fracture complexity storage modulus being the total treatment volume ratio to the frac model calculated planar fracture volume between the primary lateral wellbore 403 and diagnostic lateral wellbore 404 (parallel wellbore sections 416, 417 and 418). The diagnostic injection test for each frac interval 422 can consist of one or multiple injection tests besides fracture hit time tests 430, that is, injection tests with different treatment fluids, with and without a chemical diverter, at different injection rates, at different treatment and/or stage volumes, with different sizes and densities of proppant, with or without tracer materials, and the like, as non-limiting examples. Diagnostic tests performed at different lateral distances (i.e. 50 feet, 100 feet and the like) will help generate data specific for amount of fracture complexity near wellbore (such as 0 feet to about 50 feet (15.2 m) as a non-limiting example), for mid-field fracture complexity (such as 50 feet (15.2 m) to about 100 feet (30.5 m) as a non-limiting example), and for far-field fracture complexity generation capability (such as greater than 100 feet (30.5 m) as non-limiting examples). As another non-limiting example, near wellbore fracture complex is from 0 feet to about 40 feet (12.2 m), mid-field fracture complexity is from about 40 feet (12.2 m) to 80 feet (24.4 m), and far-field complex fractures are approximately greater than 80 feet (24.4 m) from the injection lateral. That is, the fracture complexity volume generated in section 416, the first 50 feet (15.2 m) distance frac intervals, would be for determining the near-wellbore fracture complexity for the geo-specific shale evaluated, the fracture complexity volume generated in section 417, the 100 feet (30.5 m) length fracture intervals, would be for determining the approximate mid-field fracture complexity produced, and the fracture complexity volume generated in section 418, the 150 feet (45.7 m) length fracture intervals, would be for determining the approximate far-field fracture complexity produced, and when the resultant difference in hit time and treatment volumes between tests performed on parallel lateral wellbore sections 416, 417, and 418 are calculated, the results would allow an understanding of how difficult far-field complex fractures (i.e. hydraulic fracture/natural fracture interaction and dilations, etc.) are to obtain, and if the amount of far-field fracture complexity can be determined to increase through changes to the set of diagnostic treatment criteria during comparative diagnostic treatments, including injection rate, fluid viscosity, the type and amount and particle size distribution and/or method of using chemical diverters, and the like, as non-limiting examples for performing diagnostic injection tests between lateral wellbores.

Figure 27B:
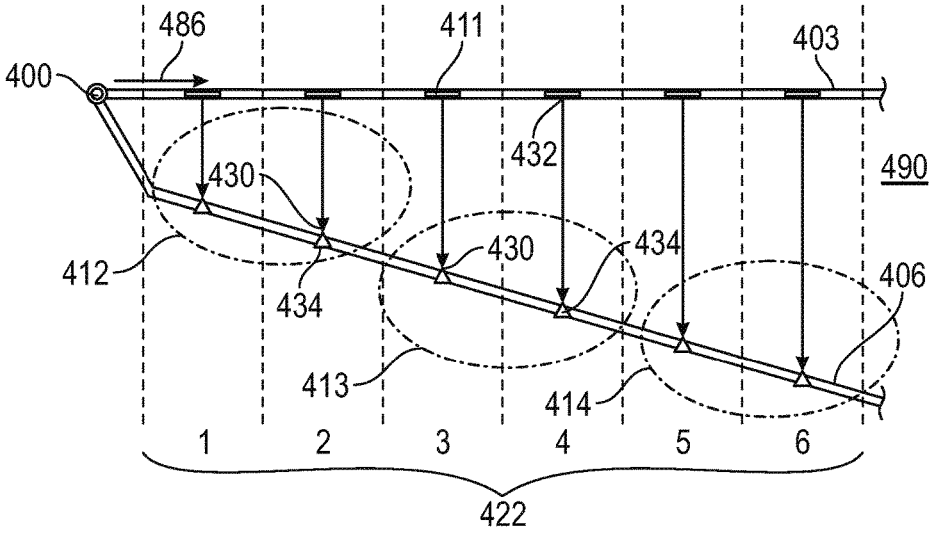
FIG. 27*b* is a schematic plan sectional view of a primary lateral wellbore and a diagnostic lateral wellbore in an angled configuration to the primary lateral wellbore that may be used to determine fracture hit time.

FIG. 27*b* presents a schematic, top view of an angled diagnostic lateral wellbore section 406 that is angled (non-parallel) to the primary lateral wellbore 403. An angled diagnostic lateral wellbore (or wellbore functioning as a diagnostic wellbore) may be at an angle to the primary lateral wellbore with which it is associated (defined as having at least one signal emitted and/or detected from one to another during an diagnostic injection method described herein) ranging from about 2° independently to about 70°; alternatively from about 5° independently to about 40°. A total of six frac intervals 422 are shown (1-6), in one non-limiting illustration, along the angle diagnostic lateral wellbore 406. For each frac interval 422, diagnostic tests are performed for determining the amount of fracture complexity that can be induced for a set of diagnostic fracture treatment criteria, that is, fracture hit time tests can be data-frac tests (injection tests to acquire reservoir-specific treatment data, including empirical based knowledge of what is happening in the reservoir and for determining optimal stimulation engineering parameters) and for determining, understanding, and influencing the hydraulic fracture/natural fracture (i.e. HF/NF) interactions for each geo-specific shale development or field.

As an illustrative non-limiting example of fracture hit time tests 430, injection 486 in primary lateral 403 enters into the reservoir at frac interval 2 of FIG. 27*a* at sliding sleeve 411, generating reservoir injection location 432. Fracture growth can be on each side of primary lateral 403 (i.e. common bi-wing geometry). The planar fracture generated towards diagnostic lateral 404 should be, in most cases, perpendicular to primary lateral 403 and at a given time and injection volume should intersect with diagnostic lateral 404, and thereby increase the pressure of at least one of the pressure sensors 434 in array (see items 420 and 434 illustrated in FIG. 28*b*). At the point of intersection diagnostic lateral wellbore 404 the hydraulic fracture pressure will be picked up (sensor measured) by one or more pressure sensors 434 in array, and this can be called a fracture hit time 430 during the diagnostic injection test on interval 2. The volume amount of treatment fluid in excess to what has been calculated through a frac model for a planar fracture in interval 2 that is in between injection location 454 to pressure detection location 455, will be the inferred volume of complex fracture generated by the HF/NF interactions (fractures that are crossed, sequestered, branched, dilated, extended, sheared, developed, and the like) during the data-frac test, and in the case of interval 2 that has 50 feet (15.2 m) distance between the primary lateral 403 and diagnostic 404 at section 416, will be related to the volume amount of the near-wellbore fracture complexity. (Note: The bi-wing planar fracture and related dual-side complex fractures generated from primary lateral wellbore 403 and in between 454 and 455 can be estimated; and more accuracy can be determined by a different data-frac configuration, such as illustrated in non-limiting examples shown in FIG. 29*c* and FIG. 31*c*). As a continuing non-limiting example of acquiring empirical data of HF/NF interactions, dilations, branching, growth extension, and the like, a treatment fluid injection test can be performed at location 456 of frac interval 4 to acquire fracture hit time data at location 457 on parallel diagnostic section 417, and a third treatment fluid injection test can be performed at injection point 411 (sliding sleeve for example) and reservoir injection location 458 of frac interval 6 to acquire the treatment fluid volume and time required for obtaining a pressure hit time 430 at location 459 on parallel diagnostic section 418. Results from fracture hit time and/or pressure hit time 430 produced for frac interval 2, along with fracture hit time 430 for interval 4, in combination and independently can be subtracted from each other and as a net subtracted from the treatment fluid volume for pressure hit time 430 in interval 6, to derive in approximation of the relative near-wellbore fracture complexity, mid-field area fracture complexity, along with determining the relative amount of far-field fracture complexity generated for the given diagnostic treatment inject tests conditions. Other data-frac tests in near-wellbore 416, mid-field 417, and far-field 418 wellbore sections can be performed in intervals 1, 3 and 5 of FIG. 27*a*, to further determine the volumetric amounts of HF/NF interactions and resultant distribution of fracture complexity when using different treatment parameters as a method to empirically determine the parameters that influence and/or control the most near-wellbore, mid-field, and far-field generation of fracture complexity for the geo-specific shale reservoir 490.

Figure 28A:
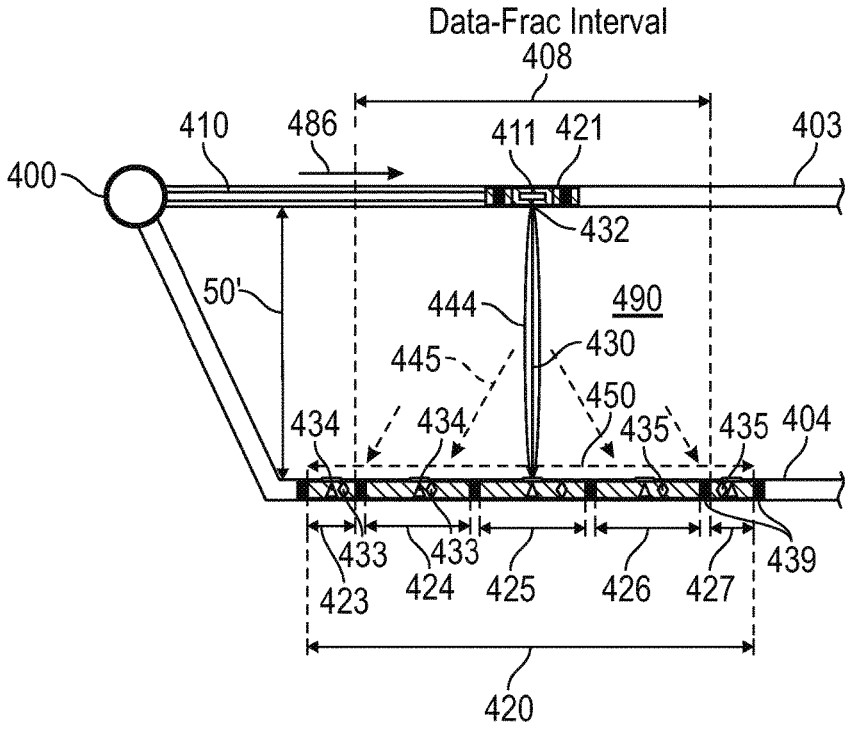
FIG. 28*a* is a schematic plan sectional view of an injection lateral wellbore and a data collection lateral wellbore in a parallel configuration to the primary lateral wellbore, where both extend from the same vertical wellbore, that may be used in first data fracturing interval injection tests.

FIG. 28*a* presents a schematic, top view of a non-limiting illustration of wellbore tools and coiled tubing configuration, for performing a fracture complexity storage modulus determination test across a 50 feet (15.2 m) parallel distance between primary lateral wellbore 403 and diagnostic lateral wellbore 404. Shown within 408 data-frac interval 1, are three isolated pressure sections 424, 425, and 426 containing pressure sensors 434. Also shown as 423 and 427 are additional isolated pressure sections of smaller size, in another non-limiting example of possible tool and pressure, temperature, and/or other sensors that can be placed with respect to the diagnostic data-frac interval 408. Wellbore isolation packers are 439, shown as the black wedges along data collection lateral 404. Treatment isolation packers (or injection tool string assembly) 421 are shown in the primary lateral wellbore 403.

FIG. 28*a* additionally illustrates a fracture hit time 430 with generated planar fracture along anticipated fracture plane 444, and includes dashed arrow lines 445 representing the possible areas where complex fracture generation, dilation, extension, branching, and the like could occur during the diagnostic tests, where the pressure hit can be detected at various points along diagnostic lateral wellbore 404 within pressure measurement section 420, and within one or more isolated subsections 423, 424, 425, 426 and 427, each having pressure sensors 434 for determining fracture hit times and for determining distribution width and other parameters from generated complex fractures during the diagnostic injection test. That is, besides the initial fracture hit time 430, which in one non-limiting embodiment is anticipated to be the planar fracture from reservoir injection point 432 along 444, that by continuation of treatment fluid injection may show additional fracture hit times from non-planar fractures crossing pressure measurement section 420 and detected by pressure sensors 434, and in another non-limiting example by downhole sensors 433 (i.e. other downhole sensors to measure additional treatment and/or reservoir conditions, such as temperature, flow rate, tilt meter, resistivity, pH, and the like). Chokes and/or isolation valves may also be placed in isolated subsections 423-427 rather than or in combination with sliding sleeves 435, and controlled from surface operations if needed (i.e. to regulate or control pressure buildup and/or release at each subsection, induce partial and/or complete fracture network closure, and the like). The sequence of additional fracture hit times, rate of pressure increase in isolated pressure sub-sections, and the like can be inferred to the fracture network growth, relative location and size of complex fractures, and the like. Injection of additional fluids and materials and the like through 411 can provide further information, such as influence of type and amount of chemical diverter, viscosity of fluid, rate of fluid injection, transport of wide-size distribution range proppant, ultra-lightweight proppant, and/or tracer tagged proppant to observe type and amount of proppant retained in reservoir versus produced in diagnostic lateral 404, the effect of proppant on fracture network closure parameters, including closure time, the duration and volume of treatment fluid produced during forced closure compared to different size, density, concentration, sequence of types, and/or the total amount of proppant placed in fracture network, and the like. In one non-limiting example, the data-frac tests can allow an operator to be aware that the geo-specific shale reservoir has anisotropic stress differential combined with very small amount of HF/NF interaction, dilation, and resultant fracture network complexity, by showing very little change in fracture hit time compared to planar calculations, with a single pressure hit point along isolated pressure section 420, and possibly further understood when combined with no other pressure hits in sub-sections 423-427 when changing the injection rate, fluid viscosity, type, amount and/or size of diverter, and the like. In another non-limiting example, fracture complexity may be generated dominantly in the near-wellbore section with very little mid-field and even less far-field fracture complexity generated unless fluid injection rate combined with diverter is used, which change in pressure hit time and pressure hit distribution may change dramatically for far-field interval data-fracs, thereby a method for determining the best parameters for generating both near-wellbore and far-field fracture complexity for the geo-specific shale evaluated. It may be understood that by performing diagnostic injection tests with methods and configurations presented herein that a much quicker and more accurate learning of how to stimulate a geo-specific reservoir is now achievable. Valuable information can thus be generated prior to a lateral field being drilled and/or stimulated. Further, trial and error stimulation design learning can be dramatically reduced in time, effort, and cost for shale plays.

Figure 28B:
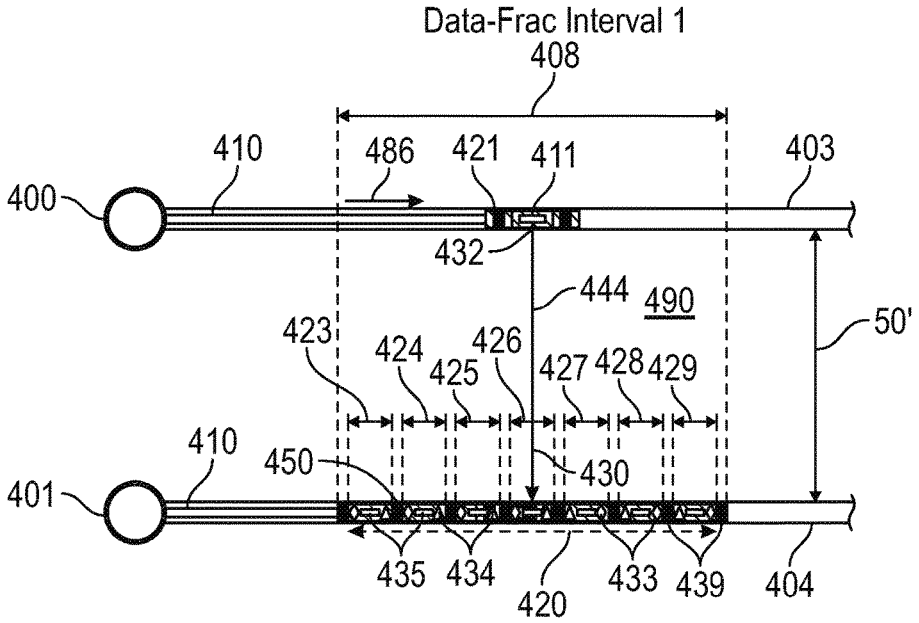
FIG. 28*b* is a schematic plan sectional view of an injection lateral wellbore and a diagnostic lateral wellbore in a parallel configuration to the primary lateral wellbore, where each extend from separate vertical wellbores, that may be used in first data fracturing interval injection tests.

FIG. 28*b* presents a schematic, top view of non-limiting illustration of wellbores and wellbore tools configuration for performing a complexity storage modulus determination test. In this non-limiting example, the primary lateral wellbore 403 is connected to independent vertical wellbore 400, and the diagnostic lateral wellbore 404 is connected to independent vertical wellbore 401. In this configuration the diagnostic treatment parameters evaluated can be further enhanced, such as in non-limiting examples, the collection of fluids and/or materials that enter diagnostic lateral 404 at one or more sliding sleeve 435 (or the like) entry points in isolated pressure sub-sections 423-429, for example, to collect and/or detect proppant (i.e. type, amount, size, location, etc.) detect tracers, for the release of treatment pressure, to observation planar fracture and/or fracture network closure criteria, for use as select injection points to evaluate cleanup processes and parameters, such as cleanup fluid type (gas, slickwater, VES fluid, cleanup micro-emulsions, etc.), cleanup injection rate, stop-start injection cycling, fluid injection volume, and the like, as non-limiting examples. Tools configured are illustrated where an injection 486 in by coiled tubing 410 using isolation packers (or injection tool string assembly) 421 and sliding sleeve 411 that allows injection at 432 and planar fracture generation, as a non-limiting example, along anticipated fracture plane 444 that crosses the 50 feet (15.2 m) distance between laterals in rock volume 490 with at least one fracture hit time 430, where the number of isolated pressure sections of 420 in FIG. 28*b* is a total of seven (items 423-429) within data frac interval 1 listed as 408, in one non-limiting illustration, that shows isolation tools, sliding sleeves, isolation valves, pressure sensors, other downhole sensors, and the like. Various known signal transmission methods can be utilized for delayed and/or real-time valve and/or sleeve actuation and sensor data collection, that is, use of cable, fiber optics, series of electromagnetic signal transmitters/receivers from the surface to downhole, and the like can transfer data from the sensors to the surface for data collection, calculations and other processing, evaluations, display, and the like. Additionally, as generated the sensor data can be stored downhole by various devices (e.g. a flash drive, or other electronic or magnetic storage or the like) configured with the sensors, downhole tools, tools on coiled tubing, and the like.

Figure 28C:
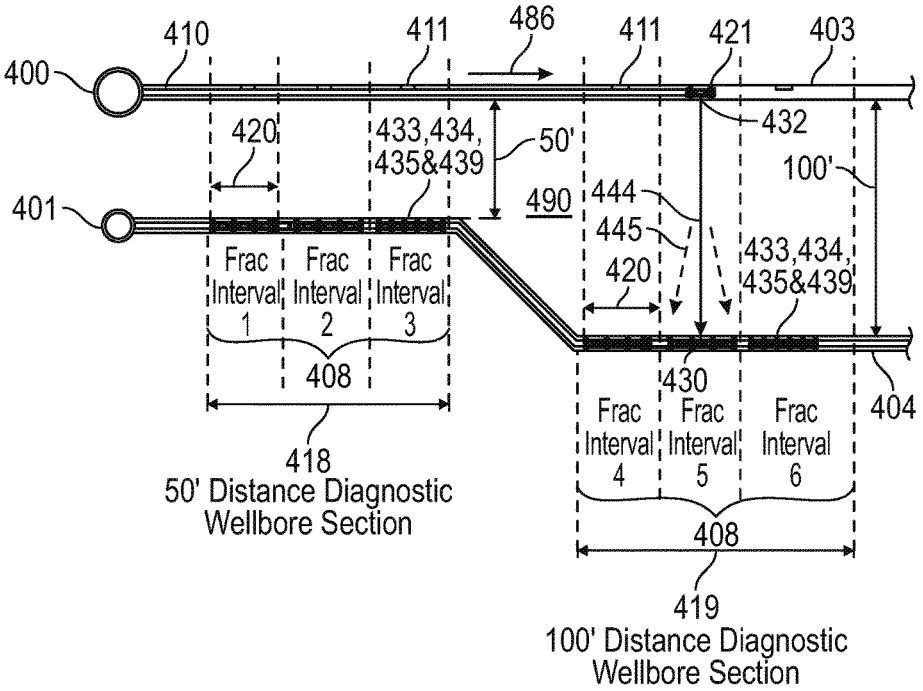
FIG. 28*c* is a schematic plan sectional view of an injection lateral wellbore and a diagnostic lateral wellbore in a parallel configuration to the primary lateral wellbore at 50 feet (15 meter) and 100 feet (30 meter) distances therefrom, where each extend from separate vertical wellbores, that may be used in first data fracturing interval injection tests.

FIG. 28*c* presents a schematic, in top view of non-limiting illustration of primary lateral wellbore 403 connected to vertical wellbore 400 and diagnostic lateral 404 connected to vertical wellbore 401. Shown on primary lateral wellbore 403 are six isolated casing injection points 411, such as sliding sleeves, where coiled tubing 410 (or the like) can be located and the sliding sleeve 411 provides injection isolation, and used with coiled tubing placed isolation packers (or injection tool string assembly) 421, for example frac interval 5 targeted injection and diagnostic treatment process configuration. The diagnostic lateral wellbore 404 illustrates a 50 feet distance parallel wellbore section 418 (frac intervals 1, 2 and 3) from the primary lateral wellbore 403 and a 100 feet (30.5 m) distance parallel wellbore section 419 (frac intervals 4, 5 and 6) from the primary lateral wellbore 403, with each diagnostic lateral wellbore section 418 and 419 each having three frac intervals 408 (1, 2, 3, 4, 5 and 6). Also shown, as a non-limiting example, is coiled tubing 410 placed at frac interval 5 on primary wellbore lateral 403, with injection from sliding sleeve 411 with injection tools and/or assembly 421 at reservoir location 432 to create a planar fracture along fracture plane 444 towards diagnostic lateral wellbore 404, with a fracture hit time 430 and illustrated complex fracture generated within the frac internal 5, shown as dashed arrows 445, with potential complex fracture pressure hits along pressure measurement section 420, showing five subsections, each with pressure sensors 434 and the like devices, as non-limiting illustrative tool and sensor configuration within frac interval 5.

Figure 28D:
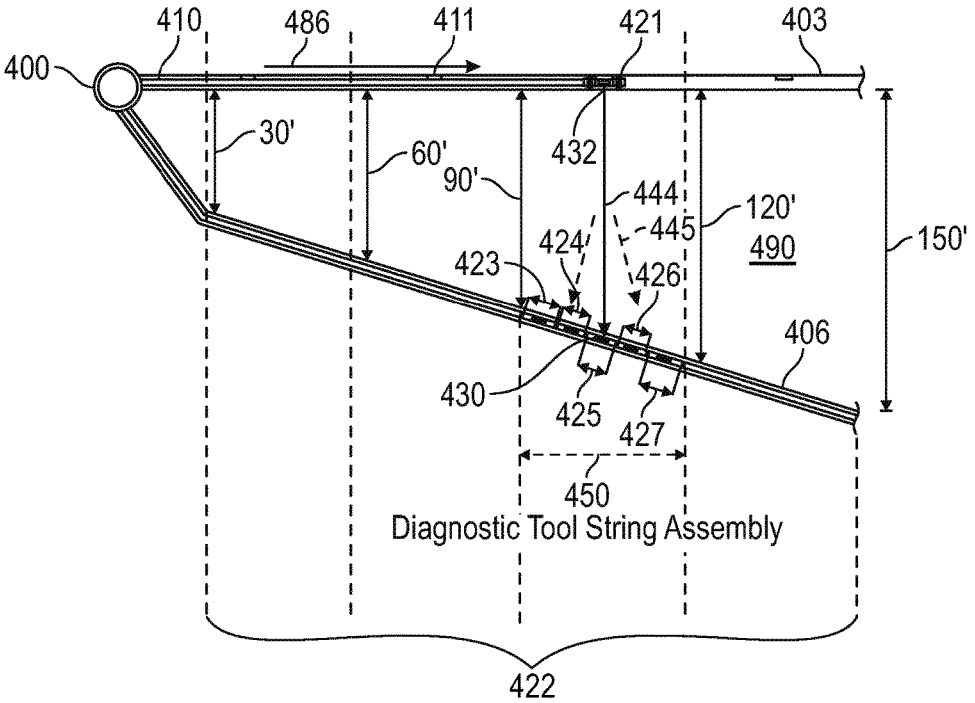
FIG. 28*d* is a schematic plan sectional view of a primary lateral wellbore and a diagnostic lateral wellbore in an angled configuration to the primary lateral wellbore that may be used for multiple injection tests along an angled data fracture interval.

FIG. 28*d* presents similar isolation and sensor tools, differing primarily by illustrated angled diagnostic lateral wellbore 406 with isolation tool 421, downhole sensors 433, pressure sensors 434, sliding sleeves 435, and isolation packers 439 that comprise subsections 423-427 and diagnostic tool string assembly 450, and the like configuration for, in a non-limiting illustration, four data-frac intervals within rock volume 490 that span from approximately 30 feet (9.1 m) to approximately 150 feet (45.7 m) from the primary lateral wellbore 403. Also illustrated, as a non-limiting example, is an injection data-frac test within frac interval 3, where injection is at isolation tool assembly 421 and sliding sleeve 411 and at reservoir injection point 432, with the generation of a planar fracture along fracture plane 444, with possible complex fracture generation 445, and with fracture hit time 430. In this illustration the injection is by coiled tubing 410, with use of one isolation tool string assemblage 421 located within frac interval 3.

It is known in the art that when performing a fracture treatment in conventional land reservoirs and typical offshore frac-pack treatments that the execution of a "data-frac" treatment process is performed before the primary frac treatment to induce, generate, and measure treatment and reservoir parameters for fine-tuning the final fracturing treatment design, that is, to understand the proper injection rate, pad volume, number of proppant stages, the concentration of proppant for the proppant stages, and the like from information generated through an injection step-rate test, fracture breakdown pressure, fracture propagation pressure, reservoir closure time after data-frac injection stops, and for fluid efficiency (fluid spurt and Cw leak-off parameters), and the like. Unfortunately, like other conventional fracturing technology, the data-frac criteria to measure and calculate for customizing the frac treatment design has not been transferable, that is, "data-frac treatments" are not typically performed before shale frac treatments because of shale reservoirs nano-darcy permeability and thus the inability to know fracture network closure time; number, size, spacing and the like of complex fractures versus planar fracture growth, (i.e. HF/NF interactions); and the like. FIGS. 27*a*-*b* and FIGS. 28*a*-*d* herein illustrate configurations and methodologies for performing shale-specific data-fracs, that is, data-frac treatments specific for shale reservoirs to gain and/or measure and calculate information of high importance for the determination of specific stimulation treatment parameters for the specific geographic shale, including but not necessarily limited to: the type of treatment fluids, amount of treatment fluid, fluid injection rate, the size, loading, and total amount of proppant, the effectiveness of chemical diverters, and foremost information on the ability to influence and/or control hydraulic fracture crossing versus dilation interactions with natural fractures and/or weak rock-planes during the fracturing operation. One non-limiting example of executing a shale data-frac is to determine "frac hit times" (schematically illustrated as 430 in the Figures) by injection from the a specific frac interval location in the primary lateral wellbore and observing pressure increase at and along the data collection and/or diagnostic lateral wellbore configured with isolated pressure sections with pressure sensors. In theory, after determining through known or anticipated reservoir parameters, select frac treatment and/or injection test fluid, pump rate, and the like parameters, with use of known frac models a bi-wing planar fracture treatment fluid volume and anticipated time for the planar fracture may be determined to reach the closest point of the diagnostic lateral wellbore, such as 50 feet (15.2 m) away. For terminology reasons the parameter "reservoir complexity storage modulus" is given as the ratio of fluid volume, where the numerator is the total volume of injection and/or frac fluid pumped and the denominator is the frac model calculated volume of fluid for the planar fracture only to reach the diagnostic lateral wellbore. The greater amount of time required, and thereby the greater volume of fluid injected, the bigger the reservoir complexity storage modulus will be. This modulus is in theory the volume of "fracture complexity generated" during the diagnostic data-frac test. Further indirect, inferred and calculated information can be generated, such as number of potential hydraulically induced fractures and/or the average potential width of the non-planar fractures through observation of pressure hits, the relative width or lateral geometry of the potential complex fracture network may be inferred, and the like. Additionally, further injection in the same interval or for the next interval can include tracers of select size particulates, as one non-limiting example, or a chemical diverter as another non-limiting example, and then injected and observed for arrival and/or pressure hits, along the diagnostic lateral wellbore, as well as for fracture hit time changes, and for wider pressure hit distribution along the diagnostic lateral wellbore indicating the diverter improved the hydraulic fracture-natural fracture (and/or weak plane) interaction and complex fracture generation, and the like.

Figure 29A:
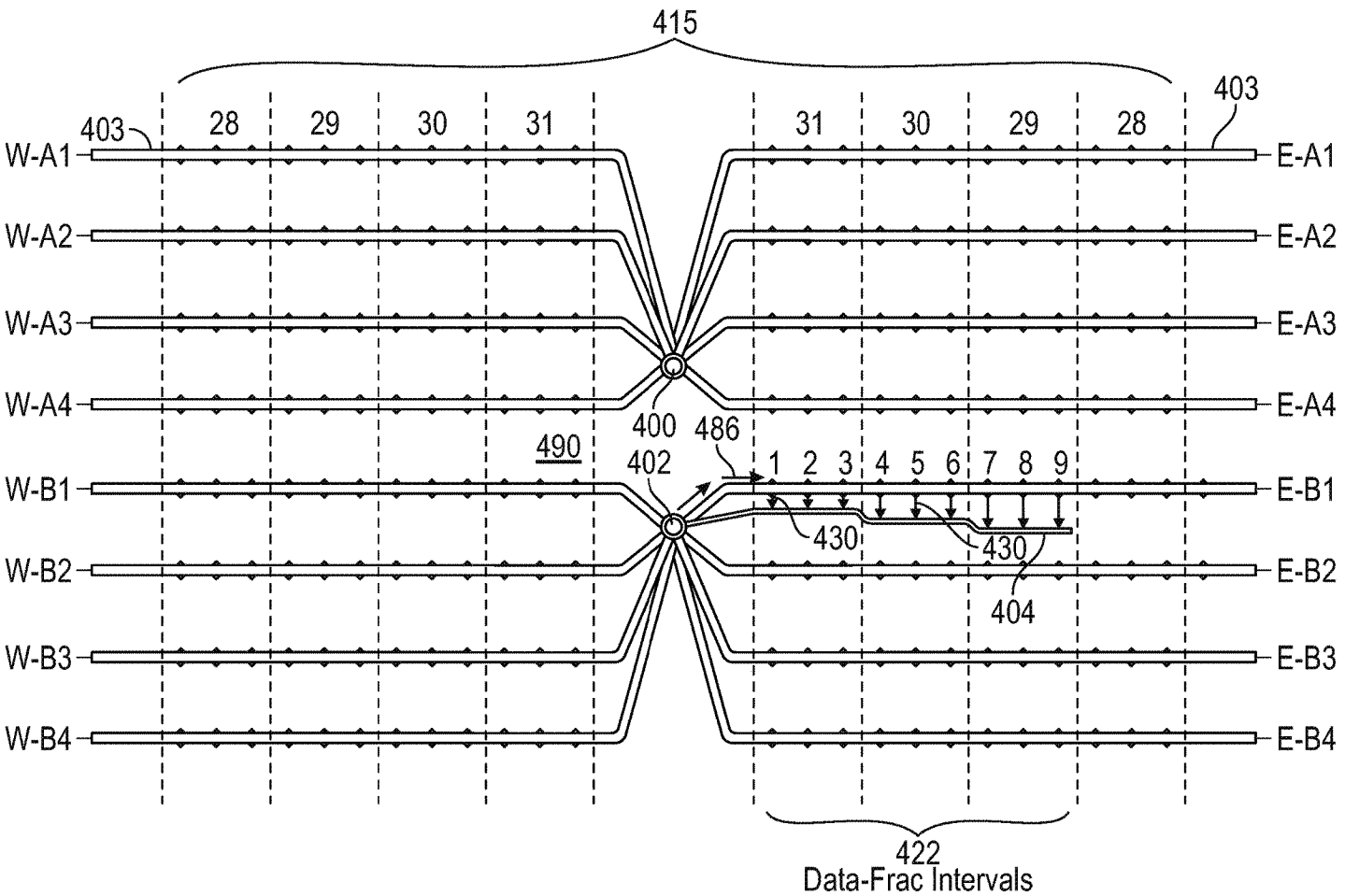
FIG. 29*a* is a schematic plan sectional view of two vertical wellbores each having eight parallel primary lateral wellbores extending therefrom and one parallel diagnostic data collection lateral wellbore at stepped distances from and between two of the parallel primary lateral wellbores.

FIG. 29*a* presents a schematic, top view of a subsurface volume 490 showing a non-limiting embodiment of a lateral field configuration with a stepped diagnostic lateral 404 for performing data-frac treatments. The illustration shows how fracture hit times 430 and related engineering and reservoir information can be acquired by performing diagnostic frac treatments along primary lateral wellbore E-B1, that is, performing data-frac test at locations 1-9 on E-B1. (The eight primary lateral wellbores on the left side of FIG. 29*a* are denoted "W" for west, and the eight primary lateral wellbores on the right side of FIG. 29*a* are denoted "E" for east. The eight primary lateral wellbores extending from vertical wellbore 400 are designated "A", and the eight primary lateral wellbores extending from vertical wellbore 402 are designated "B".) Note how the diagnostic lateral wellbore 404 has three parallel sections at three distances to primary lateral wellbore E-B1 for determining near-wellbore, mid-field, and far-field complexity for rock volume 490. As illustrated, fracture hit time tests 1-3 have a shorter distance within reservoir area 490 to travel before hydraulic planar and/or complex fractures intersect the diagnostic lateral wellbore 404; and where data-frac tests 7-9 have the farthest distance within reservoir area 490 to travel before intersecting the diagnostic lateral wellbore 404. By utilizing fracture hit time treatments 1-9, with pressure sensors configured along the diagnostic lateral wellbore 404, the time and fluid volume required to travel from primary lateral wellbore E-B1 to diagnostic lateral wellbore 404 provides empirical data for determining and quantifying how the hydraulic primary fracture which is initiated from primary lateral wellbore E-B1 interacts with natural fractures and/or weak planes in reservoir area 490. If the hydraulic primary fracture does not interact with natural fractures and/or weak planes then the diagnostic fracture hit time will be consistent with what was modeled. However, if additional time and fluid volume is required then "fracture complexity" can be interpreted to have occurred during primary fracture propagation, that is, the primary fracture interacted with and dilated and injected fluid into natural fractures and/or weak planes proportional to the excess or extra time and fluid volume required for the observed actual fracture hit time, when pressure increase was observed by a pressure sensor on diagnostic lateral wellbore. Additionally, continued pumping of treatment fluid may further show one or more of the isolated pressure sensors located along diagnostic lateral wellbore within the related frac interval to increase in pressure and be indicative of fractures that are branched from and that are now distributed within the frac interval when crossing the diagnostic lateral wellbore locale, indicative of fracture complexity distribution in the frac interval. From the initial pressure increase at the diagnostic lateral any additional pressure increase from other isolated adjacent pressure sensors will indicate multiple fractures hitting and crossing the diagnostic lateral at several points, and will infer the type and amount of fracture network complexity that the specific reservoir rock and the specific frac treatment criteria will physically and volumetrically generate. Up until the discovery described herein the shale industry has not been able to perform data-fracs that would allow it to understand how the reservoir natural fracture network and/or weak planes will respond to select treatment criteria. Utilizing the data-frac methodology disclosed herein the industry may be able to understand and generate treatment designs specific for any particular geo-specific shale lateral field. Past shale lateral field frac treatment design methodology has been conducted only through trial and error execution followed by observation of the production history of the laterals, that is, a slow learning time along with essentially production data-dependent determination for what frac treatment criteria appears to provide the optimum reservoir stimulation and hydrocarbon production for a given lateral field and potential adjacent lateral fields. This trial and error methodology has in some geographic areas taken years for operators to understand the proper or most economically beneficial stimulation design treatments that give the most apparent complex fracture network and maximized propped area conductivity for optimized hydrocarbon production for that particular lateral field and geographic specific shale characteristics.

Figure 29B:
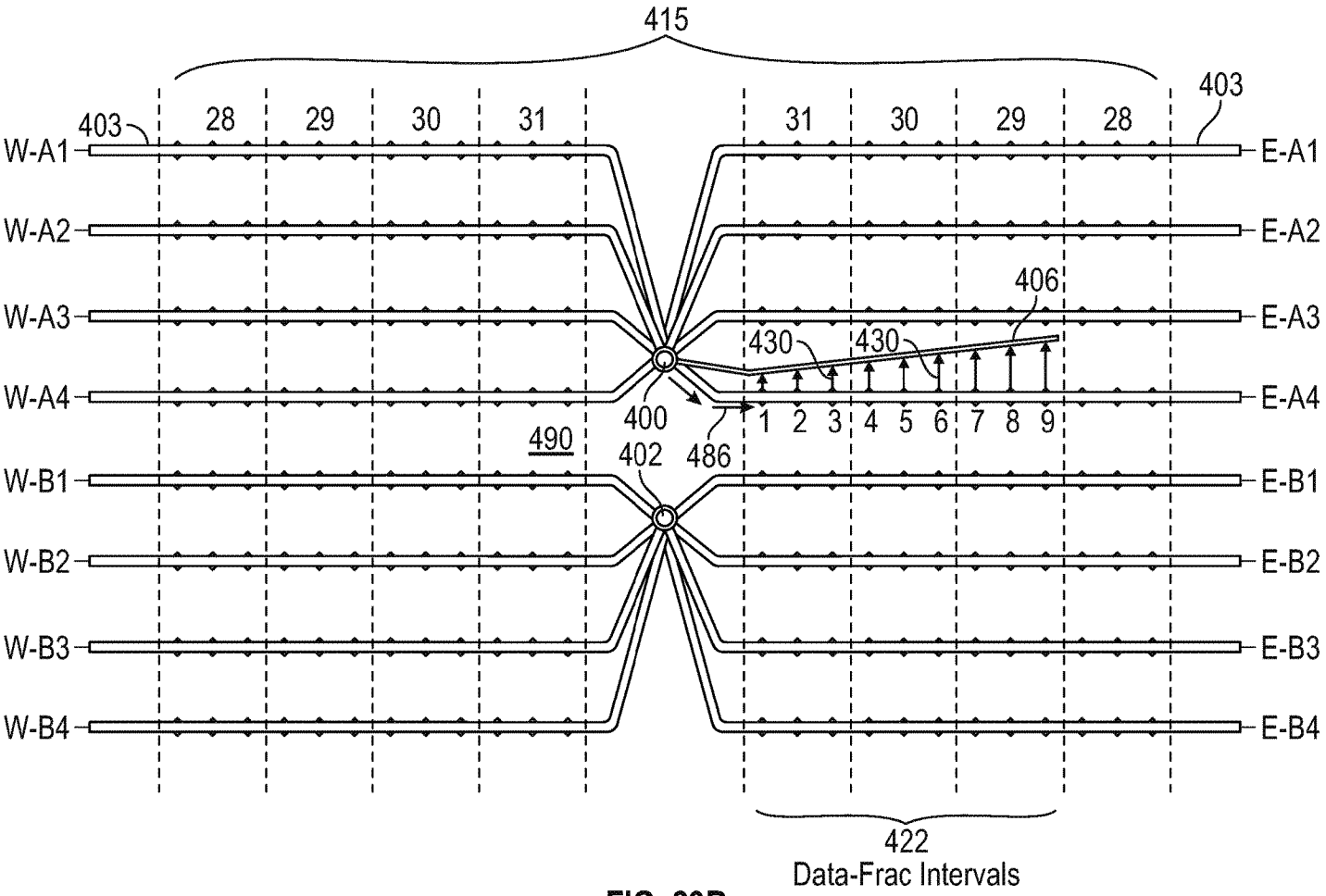
FIG. 29*b* is a schematic plan sectional view of two vertical wellbores each having eight parallel primary lateral wellbores extending therefrom of FIG. 29*a* and one angled diagnostic data collection lateral wellbore between two of the parallel primary lateral wellbores.

FIG. 29*b* presents a schematic, top view of a subsurface volume 490 showing a non-limiting embodiment of a lateral field configuration with a diagnostic lateral 406 that is angled in respect to the primary lateral wellbore E-A4, and shows nine frac intervals 422 for performing data-frac diagnostic injection tests, which can be multiple injections within the same injection interval for diagnostic purposes, such as: slickwater initially until multiple pressure hits are observed at the diagnostic lateral wellbore followed by injection of a chemical diverter within the slickwater followed by observation of pressure hit distribution and/or pressure and/or rate changes observed at the measurement locations on the diagnostic lateral wellbore.

Figure 29C:
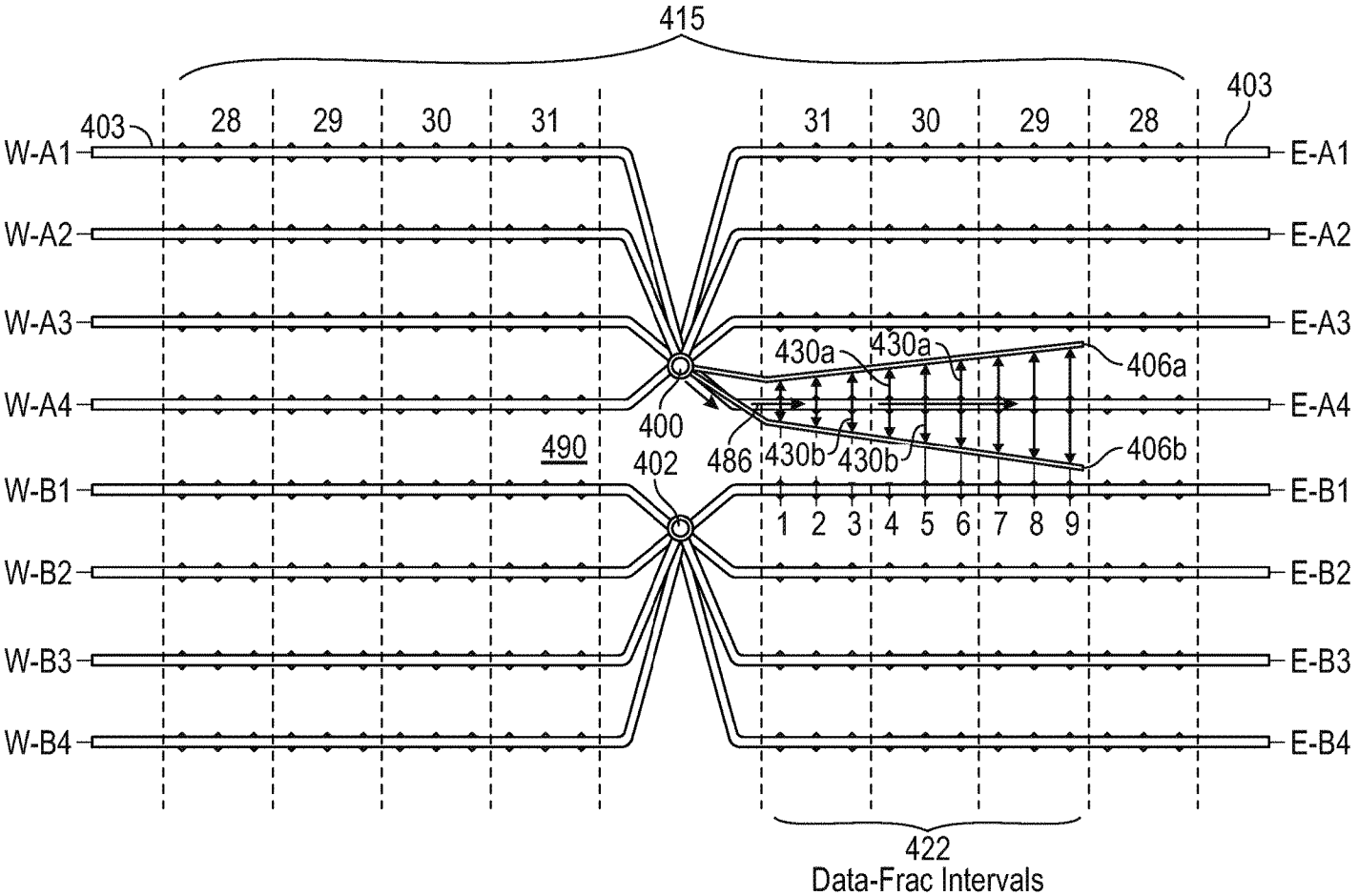
FIG. 29*c* is a schematic plan sectional view of two vertical wellbores each having eight parallel primary lateral wellbores extending therefrom of FIG. 29*a* and one angled diagnostic data collection lateral wellbore between two of the parallel primary lateral wellbores within one set of eight primary lateral wellbore primary lateral wellbores, and one angled diagnostic data collection lateral wellbore between primary lateral wellbores of different sets of eight primary lateral wellbores.

FIG. 29*c* shows for a vertical wellbore 400 how two angled diagnostic laterals (406*a* and 406*b* respectively) extend from each side of a primary lateral E-A4. By having fracture hit times and treatment fluid volumes data collected from diagnostic laterals on each side of the primary lateral wellbore E-A4, the correlation of information will help contribute to more accuracy and better understanding of the HF/NF interactions specific for geographic shale 490.

Figure 30A:
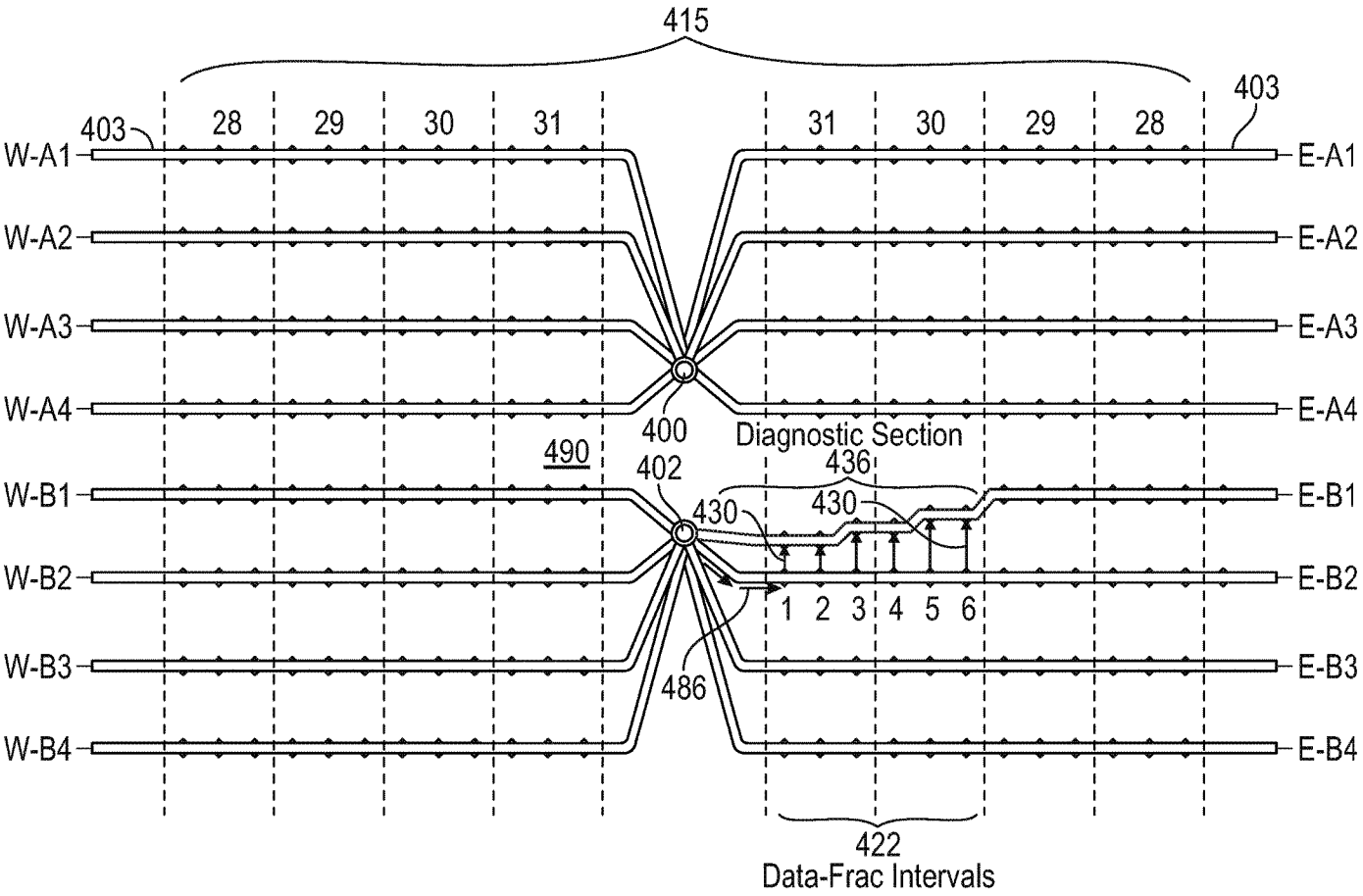
FIG. 30*a* is a schematic plan sectional view of two vertical wellbores each having eight parallel primary lateral wellbores extending therefrom illustrating a lateral field configuration with a parallel data collection interval, where one of the primary lateral wellbores is at stepped distances from an adjacent primary lateral wellbore.

FIG. 30*a* presents a schematic, in top view of non-limiting illustration of primary lateral wellbore E-B2 connected to vertical wellbore 402 and a second primary lateral wellbore E-B1 that has data collection or diagnostic section 436 comprised of three parallel wellbore sections of different parallel distances from primary lateral wellbore E-B2. Illustrated are frac intervals 1-6, with intervals 1 and 2 along the section of E-B1 closest to E-B2, intervals 3 and 4 at mid-distance from E-B2, and intervals 5 and 6 on the parallel section of E-B1 furthest from E-B2. Shown as 430 is the representative fracture hit times to be generated, and related data and diagnostic treatment processes.

Figure 30B:
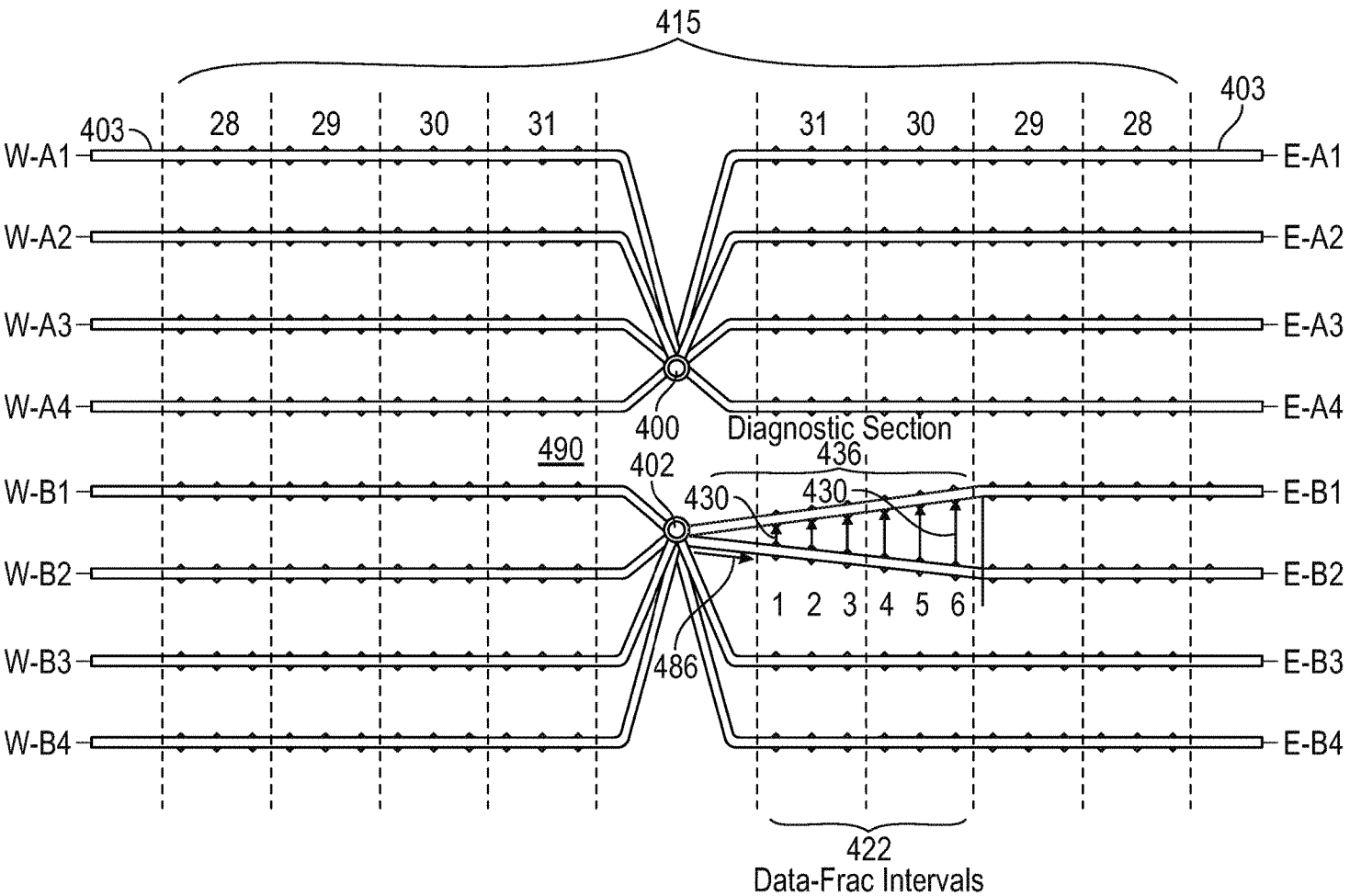
FIG. 30*b* is a schematic plan sectional view of a lateral field configuration with two vertical wellbores, one having eight parallel primary lateral wellbores extending therefrom and one with eight primary lateral wellbores illustrating with two primary lateral wellbores having angled data collection sections.

FIG. 30*b* is similar to FIG. 30*a*, showing how primary laterals 403 within a shale lateral field can be configured to have lateral wellbores used for performing diagnostic data-frac treatments, where one of the primary laterals has a section to use as a diagnostic section 436 for performing fracture hit times 430. Design of angled wellbore sections of primary lateral wellbores E-B1 and E-B2 for the fracture hit time tests is illustrated.

Figure 31A:
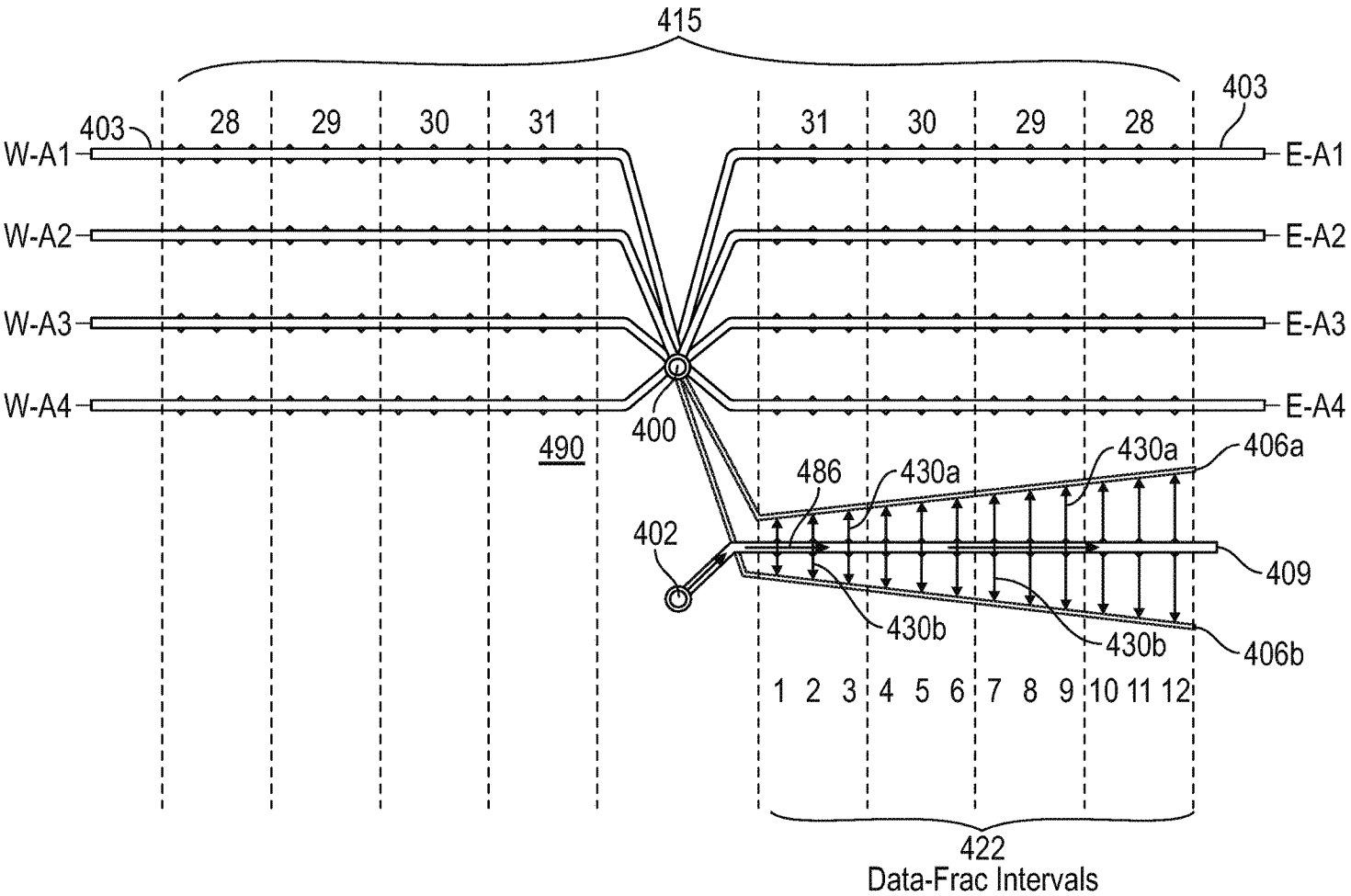
FIG. 31*a* is a schematic plan sectional view of a lateral field configuration with a first vertical wellbore having eight parallel primary lateral wellbores extending therefrom also showing an optional bi-well and angled bi-lateral data fracturing configuration using a parallel diagnostic lateral wellbore extending from a second vertical wellbore.

FIG. 31*a* presents a schematic, top view of a non-limiting illustration of bi-well and angled diagnostics bi-laterals data-frac tests configuration. Illustrated are two diagnostic lateral wellbores originating from vertical wellbore 400, and become angled diagnostic laterals 406*a* and 406*b*, which are on opposite sides of primary lateral wellbore 409 from independent vertical wellbore 402. A total of twelve frac intervals 422 are shown for performing fracture hit times 430*a* and 430*b*.

Figure 31B:
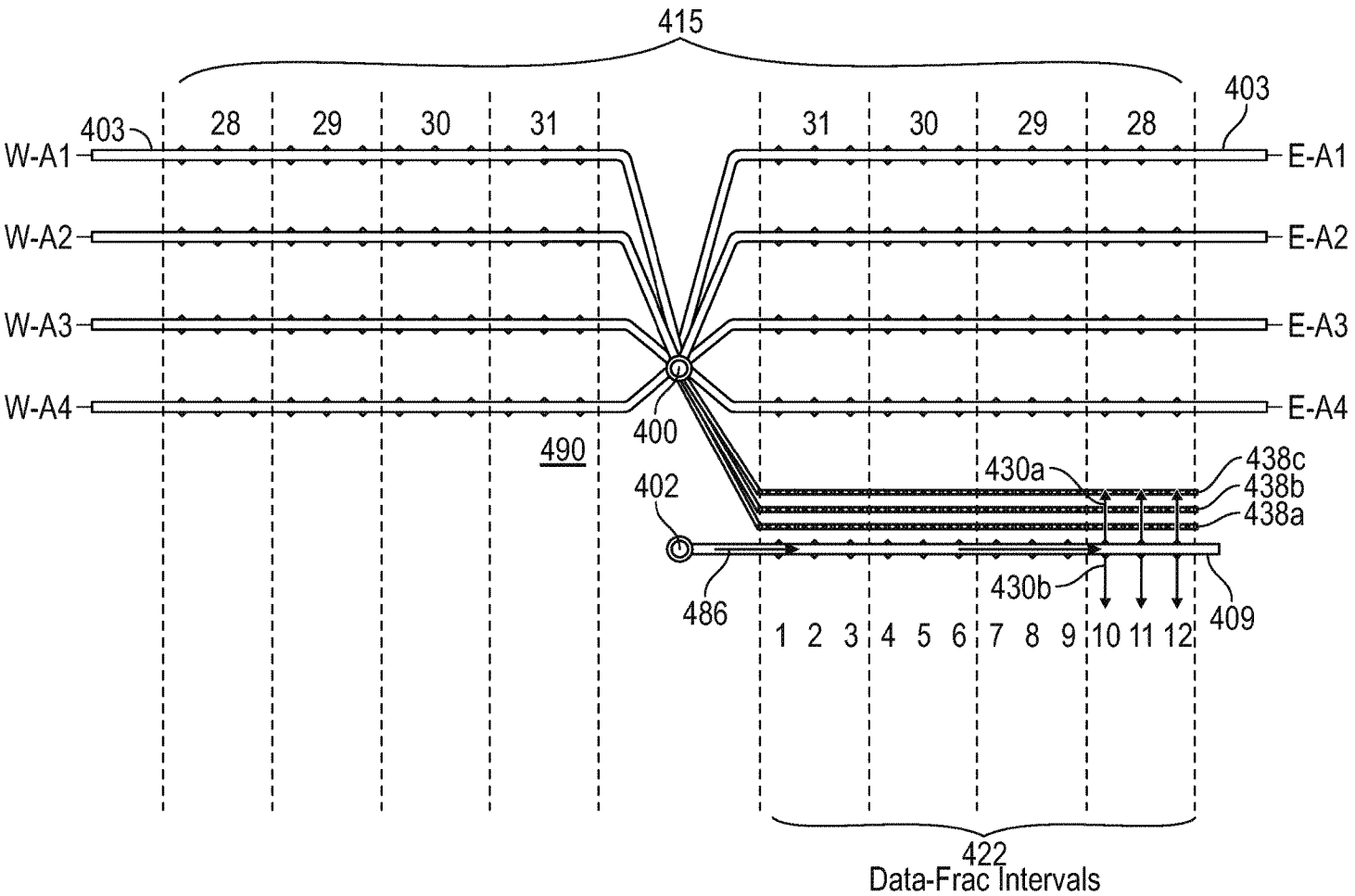
FIG. 31*b* is a schematic plan sectional view of a lateral field configuration with a first vertical wellbore having eight parallel primary lateral wellbores extending therefrom as well as three angle diagnostic lateral wellbores extending therefrom, also showing an optional second vertical wellbore lateral with a data fracturing parallel diagnostic lateral wellbore extending therefrom.

FIG. 31*b* shows a bi-well and parallel tri-lateral data-frac configuration, where the diagnostic lateral wellbores originate from independent vertical wellbore 400, and become parallel diagnostic lateral wellbores 438*a*, 438*b*, and 438*c* located on one side of primary lateral wellbore 409 that is from independent vertical wellbore 402. A total of twelve frac intervals 422 are listed for twelve diagnostic data-fracs, within this non-limiting example, diagnostic lateral 438*a* being the parallel wellbore section 50 feet (15.2 m) from the primary lateral, diagnostic lateral 438*b* being the parallel wellbore section 100 feet from the primary lateral wellbore 409, and diagnostic lateral wellbore 438*c* being the parallel wellbore section 150 feet (45.7 m) from the primary lateral wellbore 409. In this diagnostic lateral wellbore configuration, each frac interval 422 should provide sequentially for 50 feet, followed by 100 feet (30.5 m), followed by 150 feet (45.7 m) fracture hit time data during the same diagnostic test, such as a data-frac test performed at location 10, with the planar fracture crossing and pressure hitting 438*a*, 438*b* and 438*c* during the injection test.

Figure 31C:
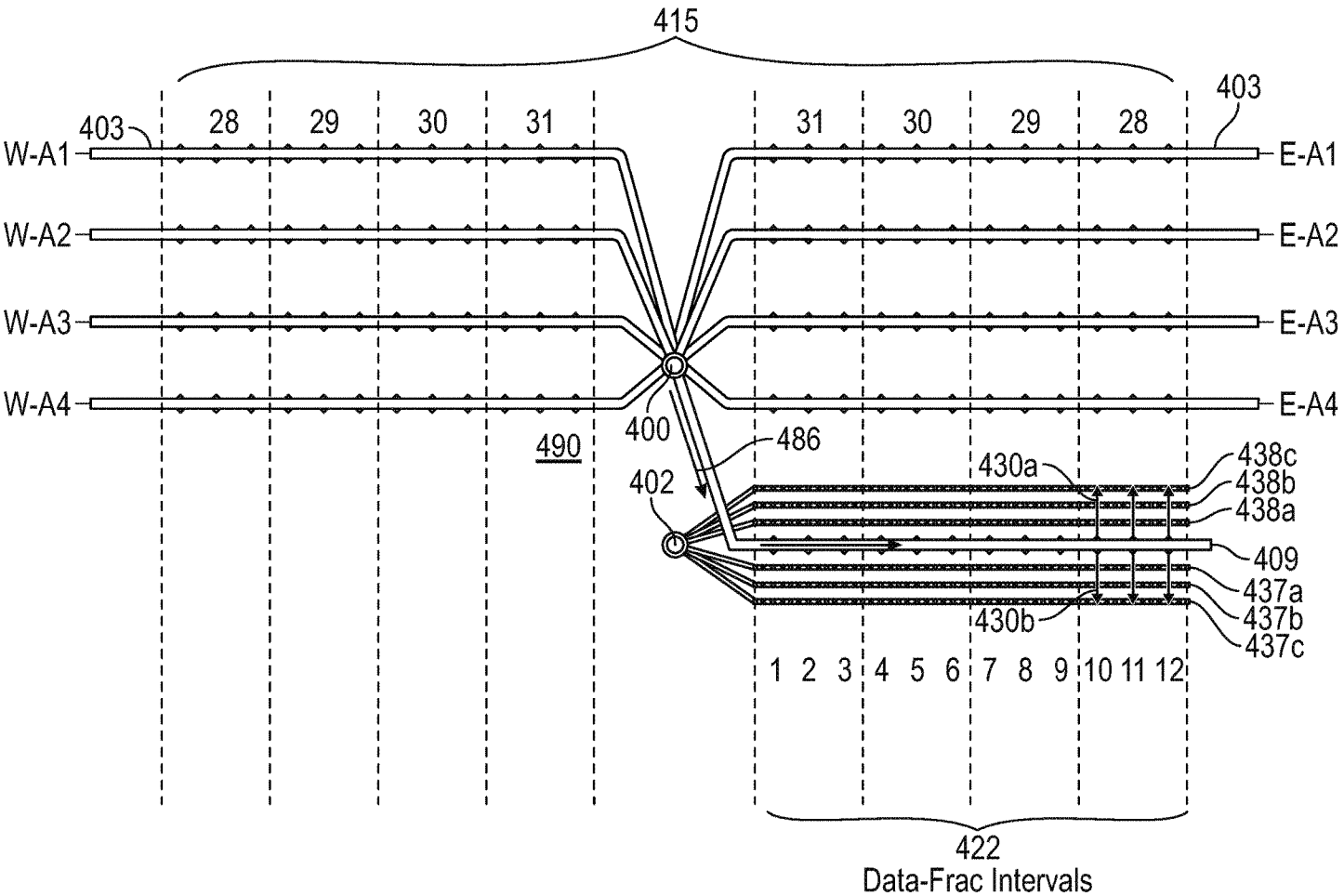
FIG. 31*c* is a schematic plan sectional view of a lateral field configuration with a first vertical wellbore having eight parallel primary lateral wellbores extending therefrom as well as one angle diagnostic lateral wellbore extending therefrom, also showing an optional second vertical wellbore lateral with six data fracturing parallel diagnostic lateral wellbores extending therefrom.

FIG. 31*c* is similar to FIG. 31*b*, but with three additional parallel diagnostics located on the opposite side of primary lateral wellbore 409, for acquiring fracture hit times 430*a* for pressure sensors on diagnostic lateral wellbores 438*a*, 438*c*, and 438*c*, and where diagnostic pressure hit times 430*b* are for sensors located on diagnostic lateral wellbores 437*a*, 437*b*, and 437*c*, which respectively are 50 feet (15.2 m), 100 feet (30.5 m) and 150 feet (45.7 m) parallel distance from primary lateral wellbore 409, similar to diagnostic laterals 438*a*, 438*b*, and 438*c*. For each data-frac test the fracture hit times will be acquired at 50 feet (15.2 m), 100 feet (30.5 m), and 150 feet (45.7 m) on both sides of the injection lateral 409, which will provide exceptional diagnostic data, that is, broadening the data and information that can be generated for understanding how to stimulate geo-specific rock volume 490 prior to multi-stage fracturing the lateral field.

FIG. 31*b* and FIG. 31*c* illustrate lateral well configurations for performing diagnostic injection tests with varying treatment parameters for determining how to generate the most near-wellbore, mid-field, and far-field fracture network complexity. For each data-frac test the fracture hit times will be acquired at 50 feet (15.2 m), 100 feet (30.5 m), and 150 feet (45.7 m) on both sides of the injection lateral 409, which will provide exceptional diagnostic data, that is, broadening the data and information towards optimizing the HF/NF interaction for understanding how to best stimulate the geo-specific rock volume 490 prior to, that is, before the numerous frac treatments within the lateral field.

Another non-limiting embodiment is to perform data-frac tests within existing lateral fields, including lateral fields that are near and/or at the end of their economic hydrocarbon production capacity. Since the laterals are already drilled, having vertical wellbores completed, use of at least one existing horizontal lateral with at least one additional drilling of a diagnostic lateral wellbore may be a more economical means to acquire fracture complexity storage modulus for several economic reasons. Placement of the diagnostic lateral wellbore can be in a non-fraced locale of the field or within areas already fraced, for generation and collection of a range of information. Additionally, for new and older lateral fields, sections of primary and diagnostic laterals can be partially treated, such as eight of sixteen data frac intervals, in one non-limiting example, for determining initial lateral field stimulation treatment design criteria and then for a fracture hit time test at a later time, such as for understanding possible stress changes to the reservoir during a production period, such as for determining engineering and treatment criteria for refrac treatment designs, and the like. That is, the data fracs can be performed at any stage of the well history, and can be staged over a time period for understanding how the reservoirs react initially to stimulation treatment criteria and then also after one or more time periods of reservoir hydrocarbon production. This practice could show limited fracturing initially for some geo-specific shales because later stimulation of sections yet to be fractured may generate, in those sections yet fraced, that more fracture complexity and resultant hydrocarbon production occurs, compared to stimulation of the lateral sections initially and all at once. Much is to still be learned in how to complete and make more economically valuable shale unconventional reservoirs. Later re-injections into prior data-frac treated intervals may also show how over time the hydraulic fracture-natural fracture interactions may change where more fractures are generated, that is, a greater amount of new fractures. It could also be determined if the pressure hits on re-data-fracs give a wider distance of pressure hits along the diagnostic lateral and where the re-data-frac fracture complexity storage modulus showed a substantial increase compared to the initial or first time period data-frac service. Use of data-frac tests may lead to practices such as planning to refrac the same intervals after a time period for generating improved interval fracture geometric complexity and as a method to increase overall production, for instance, injecting from one lateral wellbore to an adjacent diagnostic lateral of relatively close proximity can provide new methods in how to complete and produce lateral fields more economically.

FIGS. 28*a-c* are illustrations of how isolated pressure sections can be configured along the parallel diagnostic lateral wellbore sections relative to the primary lateral wellbore. In these non-limiting illustrations, the pressure isolation sections may each have a pressure gauge, and the width of each pressure isolation section can be optimized for resolution, such as numerous 20 feet (6.1 m) sections, or only a few 40 feet (12.2 m) sections. Additional non-limiting examples include where fracture hit time intervals with diagnostic laterals close to the primary lateral wellbore may only have two of three isolated pressure sections, and for the fracture hit time intervals that are farthest from the primary lateral wellbore, more than four pressure isolation sections can be optional for collecting data on width of fracture complexity. The evaluation of treatment fluid injection rate, fluid viscosity, and/or sequencing of select volumes of low and high viscosity fluids, addition of a chemical diverter throughout or in stages, addition of select size ultra-light weight proppant to see what may be collected at the select pressure isolation sections, for example to determine fracture width for the fractures crossing the diagnostic lateral wellbore locally, and the like. The type and amount of information can be very important in how to most cost effectively generate the most fracture complexity and conductivity for maximizing reservoir hydrocarbon productivity before lateral field stimulation.

In another non-limiting embodiment, data-fracs can be configured without independent diagnostic lateral wellbores, that is, as illustrated in FIG. 30*a* and FIG. 30*b*, the distance between primary laterals, including laterals within a large lateral field, can be intentionally designed during lateral field project development for performing data-fracs. As a non-limiting example, the initial sections of the primary lateral near the vertical wellbore can be configured with spacing and pressure isolation sections and fracture hit time treatment injection for data frac information generation near the vertical wellbore. In another non-limiting example, the primary laterals can be from different vertical wellbores, and where the initial sections or toe sections of each of the adjacent primary laterals are configured for fracture hit time treatments. Additionally, the information generated can be formulated into engineering calculations and computer models for increasing the accuracy and viability of fracture design models for predicting not only the next set of fracture hit time data and observations anticipated, but also for application to the lateral field multi-frac interval fracture treatments, where further calibration of the frac model can be accomplished through integration and/or calibration with the production data, to increase the predictive skill of the computer models on the amount of production results.

Improvements that may be obtained using the diagnostic lateral wellbores include, but are not necessarily limited to, improving the resolution of images of subsurface volumes and features near wellbores particularly micro-images, acquiring and improving information about the stimulation, cleanup, production and refracturing of shale intervals, the character and complexity of hydraulic fracture networks, improving the ability to control fracture closure, improving treatments and processes for fracture treatment fluids, improving fracture network cleanup, and improving production optimization treatments. Techniques of fracturing adjacent wellbores using information obtained from the one or more diagnostic lateral wellbores will help in the distribution of rock stress, treatment pressure, treatment fluids, diversion fluids or agents, clean-up agents, placement of treatment improvement additives, improving far-field propped fracture conductivity, and/or connection of propped primary wellbore fracture extension to far-field fracture networks. The information obtained by the methods and configurations described herein will be important to specify changes in fracture network generation procedures and parameters based on how a specific shale formation behaves and fractures under certain conditions. This will result in increased treatment efficiency to produce greater fracture complexity and fracture conductivity to maximize hydrocarbon production and total hydrocarbon recovery. The methods and configurations described herein will significantly improve the speed and accuracy of using wildcat wells to locate shale sweet-spots in new geologic or geologic or geo-specific shale plays. Useful imaging diagnostic imaging techniques include, but are not necessarily limited to electrolocation, electromagnetic methods, noisy particles, and the like. Combination with known diagnostic tools and measurement devices, such as DTS, DAS, microseismic, wellbore logging, and the like can improve the amount and accuracy of knowledge gained during practice of the disclosed methods and configurations.

In the foregoing specification, the invention has been described with reference to specific embodiments thereof, and has been demonstrated as effective in providing configurations, methods, and compositions for improving the information about, data about, and parameters of subterranean formations that have been and/or will be hydraulically fractured. However, it will be evident that various modifications and changes can be made thereto without departing from the broader scope of the invention as set forth in the appended claims. Accordingly, the specification is to be regarded in an illustrative rather than a restrictive sense. For example, the number and kind of primary and/or diagnostic lateral wellbores, configurations of these wellbores, diagnostic devices, fracturing, cleanup and treatment procedures, specific fracturing fluids, cleanup fluids and gases, treatment fluids, fluid compositions, viscosifying agents, proppants, proppant suspending agents and other components falling within the claimed parameters, but not specifically identified or tried in a particular composition or method, are expected to be within the scope of this invention. Further, it is expected that the primary and lateral assisting wellbores and procedures for fracturing, treating and cleaning up fracture networks may change somewhat from one application to another and still accomplish the stated purposes and goals of the methods described herein. For example, the methods may use different wellbore configurations, components, fluids, wellbores, component combinations, diagnostic devices, different fluid and component proportions, data-frac parameters used, data-frac variables investigated, empirical data generated specific for fracturing software development, and additional or different steps than those described and exemplified herein.

The words "comprising" and "comprises" as used throughout the claims is to be interpreted as "including but not limited to".

The present invention may suitably comprise, consist or consist essentially of the elements disclosed and may be practiced in the absence of an element not disclosed. For instance, there may be provided a method for diagnosing a subsurface volume containing at least one primary lateral wellbore that is adjacent to at least one diagnostic lateral wellbore, where the method consists essentially of or consists of disposing at least one diagnostic device in the at least one diagnostic lateral wellbore, emitting at least one signal between the subsurface volume and the at least one diagnostic device, detecting at least one received signal associated with the at least one emitted signal, and analyzing the at least one received signal to ascertain at least one parameter of the at least one primary lateral wellbore and/or the subsurface volume.

What is claimed is:

1. A method for diagnosing a subsurface volume containing at least one primary lateral wellbore that is adjacent to at least one diagnostic lateral wellbore, the method comprising:

disposing at least one diagnostic device in the at least one diagnostic lateral wellbore;

emitting at least one signal between the subsurface volume and the at least one diagnostic device;

detecting at least one received signal associated with the at least one emitted signal;

analyzing the at least one received signal to ascertain at least one parameter of the at least one primary lateral wellbore and/or the subsurface volume; and hydraulically fracturing the subsurface volume.

2. The method of claim 1 where the at least one primary lateral wellbore and the at least one diagnostic lateral wellbore extend from the same vertical well.

3. The method of claim 1 where the at least one primary lateral wellbore and the at least one diagnostic lateral wellbore extend from different vertical wells.

4. The method of claim 1 where the at least one primary lateral wellbore and at least one diagnostic lateral wellbore are in different planes of the subsurface volume.

5. The method of claim 1 where the at least one primary lateral wellbore is a producing wellbore.

6. The method of claim 1 where a portion of the at least one primary lateral wellbore and a portion of the at least one diagnostic lateral wellbore are within about 50 to about 1200 feet (about 15 to about 366 meters) of each other.

7. The method of claim 6 where the at least one primary lateral wellbore and the at least one diagnostic lateral wellbore are parallel to each other defined as within 0 to about 8° of the same angle as each other.

8. The method of claim 7 where either the at least one primary lateral wellbore and/or the at least one diagnostic lateral wellbore comprise at least two parallel portions with respect to each other that are at different distances from each other.

9. The method of claim 6 where the at least one primary lateral wellbore and the at least one diagnostic lateral wellbore are at an angle to each other ranging from about 2° to about 70°.

10. The method of claim 1 where the subsurface volume comprises hydraulic fractures and the at least one parameter is selected from the group consisting of:

length of a fracture;
width of a fracture;
volume of a fracture;
complexity of a fracture network;
fracture conductivity;
fracture cleanup;
speed of fracture propagation;
spatial extent of fracture propagation;
surface area of a fracture;
an image of a fracture;
location and/or extent of a sweet-spot horizon;
settling of a proppant in a fracture;
a lithological parameter;
saturation;
permeability;
stratification homogeneity;
a stress shadow effect parameter; and
combinations of these.

11. The method of claim 1 where:
the at least one diagnostic lateral wellbore is a first diagnostic lateral wellbore in a first plane of the subsurface volume;
the at least one primary lateral wellbore is in a second, different plane of the subsurface volume from the first diagnostic lateral wellbore;
the at least one primary lateral wellbore and the first diagnostic lateral wellbore are substantially parallel to each other,
where at least one second diagnostic wellbore extends in a direction selected from the group consisting of:
substantially perpendicularly from the first diagnostic lateral wellbore in the first plane toward the at least one primary lateral wellbore; or
substantially perpendicularly from the at least one primary lateral wellbore in the second plane toward the first diagnostic lateral wellbore.

12. The method of claim 11 where the at least one primary lateral wellbore and the first diagnostic lateral wellbore intersect at least two fracture treatment intervals in the subsurface volume, where each of the fracture treatment intervals comprises at least one fracture network, and where the second diagnostic wellbore extends into a position selected from the group consisting of:
at least one of the fracture networks in a fracture treatment interval,
between the two fracture treatment intervals, and
both.

13. The method of claim 1 where:
the at least one diagnostic lateral wellbore is a first diagnostic lateral wellbore in a first plane of the subsurface volume;
the at least one primary lateral wellbore is in a second, different plane of the subsurface volume;
the at least one primary lateral wellbore and the first diagnostic lateral wellbore are substantially parallel to each other,
where at least one diagnostic lateral wellbore has at least one second diagnostic lateral wellbore extending therefrom in a position selected from the group consisting of:
over the primary lateral wellbore;
under the primary lateral wellbore; and
at least one second diagnostic lateral wellbore being in a position over the at least one primary lateral wellbore and at least one third diagnostic lateral wellbore being in a position under the at least one primary lateral wellbore.

14. The method of claim 1 where the at least one diagnostic lateral wellbore extends from the at least one primary lateral wellbore.

15. The method of claim 1 further comprising hydraulically fracturing the subsurface volume from at least one primary lateral wellbore.

16. The method of claim 1 where the at least one primary lateral wellbore has at least one kick-off wellbore.

17. The method of claim 1 where the at least one signal is a first signal and the analyzing is a first analyzing to ascertain at least one first parameter, and subsequent to the first analyzing:
conducting a wellbore treatment; and
further emitting at least one second signal between the subsurface volume and the at least one diagnostic device;
further detecting at least one second received signal associated with the at least one emitted signal;
analyzing the at least one received signal to ascertain at least one second parameter of the at least one primary lateral wellbore and/or the subsurface volume; and
comparing the at least one second parameter with the at least one first parameter to determine the difference.

18. The method of claim 17 where the wellbore treatment is selected from the group consisting of:
closing a fracture network;
cleaning up a fracture network;
placing proppant in a fracture network;
acidizing the subsurface volume;
diverting a composition injected into a wellbore;
refracturing the subsurface volume; and
combinations thereof.

19. A method for diagnosing a subsurface volume containing at least one primary lateral wellbore that is adjacent to at least one diagnostic lateral wellbore, the method comprising:
disposing at least one diagnostic device in the at least one diagnostic lateral wellbore;
emitting at least one signal between the subsurface volume and the at least one diagnostic device;
detecting at least one received signal associated with the at least one emitted signal;
analyzing the at least one received signal to ascertain at least one parameter of the at least one primary lateral wellbore and/or the subsurface volume; and
subsequent to the analyzing, hydraulically fracturing the subsurface volume;
where
the at least one primary lateral wellbore and at least one diagnostic lateral wellbore are in different planes of the subsurface volume;
the at least one primary lateral wellbore and the at least one diagnostic lateral wellbore are parallel to each other defined as within 0 to about 8° of the same angle as each other;
the subsurface volume comprise hydraulic fractures; and
the at least one parameter is selected from the group consisting of:
length of a fracture;
width of a fracture;
volume of a fracture;
complexity of a fracture network;
fracture conductivity;
fracture cleanup;
speed of fracture propagation;
spatial extent of fracture propagation;
surface area of a fracture;

an image of a fracture;
location and/or extent of a sweet-spot horizon;
settling of a proppant in a fracture;
a lithological parameter;
saturation;
permeability;
stratification homogeneity;
a stress shadow effect parameter; and combinations of these.

20. A method for diagnosing a subsurface volume containing at least one primary lateral wellbore that is adjacent to at least one diagnostic lateral wellbore, the method comprising:

disposing at least one diagnostic device in the at least one diagnostic lateral wellbore;

emitting at least one signal between the subsurface volume and the at least one diagnostic device;

detecting at least one received signal associated with the at least one emitted signal; and analyzing the at least one received signal to ascertain at least one parameter of the at least one primary lateral wellbore and/or the subsurface volume;

where:

a portion of the at least one primary lateral wellbore and a portion of the at least one diagnostic lateral wellbore are within about 50 to about 1200 feet (about 15 to about 366 meters) of each other;

where the at least one signal is a first signal and the analyzing is a first analyzing to ascertain at least one first parameter;

and where the method comprises subsequent to the first analyzing:

conducting a wellbore treatment selected from the group consisting of:;
hydraulically fracturing the subsurface volume;
closing a fracture network;
cleaning up a fracture network;
placing proppant in a fracture network;
acidizing the subsurface volume;
diverting a composition injected into a wellbore;
refracturing the subsurface volume; and combinations thereof; and further emitting at least one second signal between the subsurface volume and the at least one diagnostic device;

further detecting at least one second received signal associated with the at least one emitted signal;

analyzing the at least one received signal to ascertain at least one second parameter of the at least one primary lateral wellbore and/or the subsurface volume; and comparing the at least one second parameter with the at least one first parameter to determine the difference.

* * * * *